US010931068B2

(12) United States Patent
Purdy et al.

(10) Patent No.: US 10,931,068 B2
(45) **Date of Patent: *Feb. 23, 2021**

(54) CONNECTOR HAVING A GROUNDING MEMBER OPERABLE IN A RADIAL DIRECTION

(71) Applicant: PPC Broadband, Inc., East Syracuse, NY (US)

(72) Inventors: Eric Purdy, Constantia, NY (US); Noah P. Montena, Syracuse, NY (US); Jeremy Amidon, Waxhaw, NC (US)

(73) Assignee: PPC BROADBAND, INC., East Syracuse, NY (US)

( * ) Notice: Subject to any disclaimer, the term of this patent is extended or adjusted under 35 U.S.C. 154(b) by 34 days.

This patent is subject to a terminal disclaimer.

(21) Appl. No.: 15/431,574

(22) Filed: Feb. 13, 2017

(65) Prior Publication Data

US 2017/0324196 A1 Nov. 9, 2017

Related U.S. Application Data

(63) Continuation of application No. 14/149,225, filed on Jan. 7, 2014, now Pat. No. 9,570,845, which is a (Continued)

(51) Int. Cl.
*H01R 24/40* (2011.01)
*H01R 13/622* (2006.01)
(Continued)

(52) U.S. Cl.
CPC ..... *H01R 24/40* (2013.01); *H01R 9/0524* (2013.01); *H01R 13/5202* (2013.01);
(Continued)

(58) Field of Classification Search
CPC .. H01R 24/40; H01R 13/5202; H01R 13/622; H01R 2103/00
(Continued)

(56) References Cited

U.S. PATENT DOCUMENTS 331,169 A 11/1885 Thomas
1,371,742 A 3/1921 Dringman
(Continued)

FOREIGN PATENT DOCUMENTS

CA 209671000 11/1994
CN 1383594 A 12/2002
(Continued)

OTHER PUBLICATIONS

Declaration of Jeremy Amidon; USDC-NDNY Civil Action No. 5:13-CV-01310-GLS-DEP; Dec. 13, 2013.
(Continued)

*Primary Examiner* — Travis S Chambers
(74) *Attorney, Agent, or Firm* — MH2 Technology Law Group LLP

(57) ABSTRACT

A connector for a coaxial cable. The connector, in one embodiment, includes a post, a coupler and a continuity member configured to produce a radially-directed biasing force. The continuity member provides an electrical connection between the post and the coupler.

19 Claims, 58 Drawing Sheets

Related U.S. Application Data continuation-in-part of application No. 13/652,073, filed on Oct. 15, 2012, now Pat. No. 8,647,136, which is a continuation of application No. 12/633,792, filed on Dec. 8, 2009, now Pat. No. 8,287,320.

(60) Provisional application No. 61/180,835, filed on May 22, 2009.

(51) Int. Cl.

| | |
|---|---|
| ***H01R 24/38*** | (2011.01) |
| ***H01R 9/05*** | (2006.01) |
| ***H01R 13/52*** | (2006.01) |
| *H01R 103/00* | (2006.01) |
| *H01R 4/30* | (2006.01) |

(52) U.S. Cl.
CPC ..... *H01R 13/622* (2013.01); *H01R 24/38* (2013.01); *H01R 4/304* (2013.01); *H01R 2103/00* (2013.01)

(58) Field of Classification Search
USPC ..... 439/322, 578, 583–585, 792
See application file for complete search history.

(56) References Cited

U.S. PATENT DOCUMENTS 1,667,485 A 4/1928 Macdonald
1,766,869 A 6/1930 Austin
1,801,999 A 4/1931 Bowman
1,885,761 A 11/1932 Peirce, Jr.
2,013,526 A 9/1935 Schmitt
2,102,495 A 12/1937 England
2,258,737 A 10/1941 Browne
2,325,549 A 7/1943 Ryzowitz
2,480,963 A 9/1949 Quinn
2,544,654 A 3/1951 Brown
2,549,647 A 4/1951 Turene
2,665,729 A 1/1954 Terry
2,694,187 A 11/1954 Nash
2,694,817 A 11/1954 Roderick
2,754,487 A 7/1956 Carr et al.
2,755,331 A 7/1956 Melcher
2,757,351 A 7/1956 Klostermann
2,762,025 A 9/1956 Melcher
2,805,399 A 9/1957 Leeper
2,816,949 A 12/1957 Curtiss
2,870,420 A 1/1959 Malek
3,001,169 A 9/1961 Blonder
3,015,794 A 1/1962 Kishbaugh
3,091,748 A 5/1963 Takes et al.
3,094,364 A 6/1963 Lingg
3,184,706 A 5/1965 Atkins
3,194,292 A 7/1965 Borowsky
3,196,382 A 7/1965 Morello, Jr.
3,245,027 A 4/1966 Ziegler, Jr.
3,275,913 A 9/1966 Blanchard
3,278,890 A 10/1966 Cooney
3,281,757 A 10/1966 Bonhomme
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,677 A 10/1967 Daum
3,355,698 A 11/1967 Keller
3,373,243 A 3/1968 Janowiak
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark
3,494,400 A 2/1970 McCoy et al.
3,498,647 A 3/1970 Schroder
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone
3,587,033 A 6/1971 Brorein et al.
3,601,776 A 8/1971 Curl
3,629,792 A 12/1971 Dorrell
3,633,150 A 1/1972 Swartz
3,646,502 A 2/1972 Hater et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,706,958 A 12/1972 Blanchenot
3,710,005 A 1/1973 French
3,739,076 A 6/1973 Schwartz
3,744,007 A 7/1973 Horak
3,744,011 A 7/1973 Blanchenot
3,778,535 A 12/1973 Forney, Jr.
3,781,762 A 12/1973 Quackenbush
3,781,898 A 12/1973 Holloway
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,858,156 A 12/1974 Zarro
3,870,978 A 3/1975 Dreyer
3,879,102 A 4/1975 Horak
3,886,301 A 5/1975 Cronin et al.
3,907,399 A 9/1975 Spinner
3,910,673 A 10/1975 Stokes
3,915,539 A 10/1975 Collins
3,936,132 A 2/1976 Hutter
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
4,017,139 A 4/1977 Nelson
4,022,966 A 5/1977 Gajajiva
4,030,798 A 6/1977 Paoli
4,046,451 A 9/1977 Juds et al.
4,053,200 A 10/1977 Pugner
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,106,839 A 8/1978 Cooper
4,109,126 A 8/1978 Halbeck
4,125,308 A 11/1978 Schilling
4,126,372 A 11/1978 Hashimoto et al.
4,131,332 A 12/1978 Hogendobler et al.
4,150,250 A 4/1979 Lundeberg
4,153,320 A 5/1979 Townshend
4,156,554 A 5/1979 Aujla

(56) References Cited

U.S. PATENT DOCUMENTS

| | | | |
|---|---|---|---|
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,194,338 | A | 3/1980 | Trafton |
| 4,213,664 | A | 7/1980 | McClenan |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,359,254 | A | 11/1982 | Gallusser et al. |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo et al. |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,126 | A | 4/1988 | Gutter et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |

(56) References Cited

U.S. PATENT DOCUMENTS 5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,509,823 A 4/1996 Harting et al.
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,767,652 A 6/1998 Bidaud et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,921,793 A 7/1999 Phillips
5,938,465 A 8/1999 Fox, Sr.
5,944,548 A 8/1999 Saito
5,951,327 A 9/1999 Marik
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,162,995 A 12/2000 Bachle et al.
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,090 S 6/2002 Veltri et al.
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan

(56) References Cited

U.S. PATENT DOCUMENTS 6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,705,884 B1 3/2004 McCarthy
6,709,280 B1 3/2004 Gretz
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,752,633 B2 6/2004 Aizawa et al.
6,767,248 B1 7/2004 Hung
6,769,926 B1 8/2004 Montena
6,769,933 B2 8/2004 Bence et al.
6,780,029 B1 8/2004 Gretz
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,817,897 B2 11/2004 Chee
6,848,939 B2 2/2005 Stirling
6,848,940 B2 2/2005 Montena
6,873,864 B2 3/2005 Kai et al.
6,882,247 B2 4/2005 Allison et al.
6,884,113 B1 4/2005 Montena
6,884,115 B2 4/2005 Malloy
6,898,940 B2 5/2005 Gram et al.
6,916,200 B2 7/2005 Burris et al.
6,926,508 B2 8/2005 Brady et al.
6,929,265 B2 8/2005 Holland et al.
6,929,508 B1 8/2005 Holland
6,939,169 B2 9/2005 Islam et al.
6,948,976 B2 9/2005 Goodwin et al.
6,971,912 B2 12/2005 Montena et al.
7,004,788 B2 2/2006 Montena
7,011,547 B1 3/2006 Wu
7,029,304 B2 4/2006 Montena
7,029,326 B2 4/2006 Montena
7,048,579 B2 5/2006 Montena
7,063,565 B2 6/2006 Ward
7,070,447 B1 7/2006 Montena
7,074,081 B2 7/2006 Hsia
7,086,897 B2 8/2006 Montena
7,097,499 B1 8/2006 Purdy
7,097,500 B2 8/2006 Montena
7,102,668 B2 9/2006 Sasaki
7,102,868 B2 9/2006 Montena
7,108,548 B2 9/2006 Burris et al.
7,114,990 B2 10/2006 Bence et al.
7,118,416 B2 10/2006 Montena et al.
7,125,283 B1 10/2006 Lin
7,128,603 B2 10/2006 Burris et al.
7,128,605 B2 10/2006 Montena
7,131,686 B1 11/2006 Jo et al.
7,131,867 B1 11/2006 Foster et al.
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,186,127 B2 3/2007 Montena
7,189,113 B2 3/2007 Sattele et al.
7,198,507 B2 4/2007 Tusini
7,207,820 B1 4/2007 Montena
7,229,303 B2 6/2007 Vermoesen et al.
7,241,172 B2 7/2007 Rodrigues et al.
7,252,546 B1 8/2007 Holland
7,255,598 B2 8/2007 Montena et al.
7,264,503 B2 9/2007 Montena
7,299,520 B2 11/2007 Huang
7,299,550 B2 11/2007 Montena
7,300,309 B2 11/2007 Montena
7,309,255 B2 12/2007 Rodrigues
7,354,309 B2 4/2008 Palinkas
7,371,112 B2 5/2008 Burris et al.
7,371,113 B2 5/2008 Burris et al.
7,375,533 B2 5/2008 Gale
7,393,245 B2 7/2008 Palinkas et al.
7,404,737 B1 7/2008 Youtsey
7,442,081 B2 10/2008 Burke et al.
7,452,237 B1 11/2008 Montena
7,452,239 B2 11/2008 Montena
7,455,549 B2 * 11/2008 Rodrigues ..... H01R 9/0524 439/578
7,455,550 B1 11/2008 Sykes
7,462,068 B2 12/2008 Amidon
7,476,127 B1 1/2009 Wei
7,479,033 B1 1/2009 Sykes et al.
7,479,035 B2 1/2009 Bence et al.
7,480,991 B2 1/2009 Khemakhem et al.
7,488,210 B1 2/2009 Burris et al.
7,494,355 B2 2/2009 Hughes et al.
7,497,729 B1 3/2009 Wei
7,507,117 B2 3/2009 Amidon
7,513,795 B1 4/2009 Shaw
7,544,094 B1 6/2009 Paglia et al.
7,566,236 B2 7/2009 Malloy et al.
7,568,945 B2 8/2009 Chee et al.
7,607,942 B1 10/2009 Van Swearingen
7,644,755 B2 1/2010 Stoesz et al.
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,792,148 B2 9/2010 Carlson et al.
7,794,275 B2 9/2010 Rodrigues
7,798,849 B2 9/2010 Montena
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,828,596 B2 11/2010 Malak
7,830,154 B2 11/2010 Gale
7,833,053 B2 11/2010 Mathews
7,837,501 B2 11/2010 Youtsey
7,845,963 B2 12/2010 Gastineau
7,845,976 B2 12/2010 Mathews
7,845,978 B1 12/2010 Chen
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 * 2/2011 Chen ..... H01R 13/6583 439/578
7,927,135 B1 4/2011 Wlos
7,934,954 B1 5/2011 Chawgo et al.

(56) References Cited

U.S. PATENT DOCUMENTS 7,950,958 B2 5/2011 Mathews
7,955,126 B2 6/2011 Bence et al.
7,972,158 B2 7/2011 Wild et al.
8,029,315 B2 10/2011 Purdy et al.
8,033,862 B2 10/2011 Radzik et al.
8,062,044 B2 11/2011 Montena et al.
8,062,063 B2 11/2011 Malloy et al.
8,075,337 B2 12/2011 Malloy et al.
8,075,338 B1 12/2011 Montena
8,075,339 B2 12/2011 Holliday
8,079,860 B1 12/2011 Zraik
8,113,875 B2 2/2012 Malloy et al.
8,152,551 B2 4/2012 Zraik
8,157,588 B1 4/2012 Rodrigues et al.
8,157,589 B2 4/2012 Krenceski et al.
8,167,635 B1 5/2012 Mathews
8,167,636 B1 5/2012 Montena
8,167,646 B1 5/2012 Mathews
8,172,612 B2 5/2012 Bence et al.
8,186,919 B2 5/2012 Blair
8,192,237 B2 6/2012 Purdy et al.
8,206,176 B2 6/2012 Islam
8,231,406 B2 7/2012 Burris et al.
8,231,412 B2 7/2012 Paglia et al.
8,287,320 B2 10/2012 Purdy et al.
8,313,345 B2 11/2012 Purdy
8,313,353 B2 11/2012 Purdy et al.
8,323,053 B2 12/2012 Montena
8,323,060 B2 12/2012 Purdy et al.
8,328,577 B1 12/2012 Lu
8,337,229 B2 12/2012 Montena
8,348,697 B2 1/2013 Zraik
8,366,481 B2 2/2013 Ehret et al.
8,376,769 B2 2/2013 Holland et al.
8,382,517 B2 2/2013 Mathews
8,398,421 B2 3/2013 Haberek et al.
8,414,322 B2 4/2013 Montena
8,444,445 B2 5/2013 Amidon et al.
8,469,740 B2 6/2013 Ehret et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,529,279 B2 9/2013 Montena
8,556,654 B2 * 10/2013 Chastain ..... H01R 9/0527 439/578
8,562,366 B2 10/2013 Purdy et al.
8,573,996 B2 11/2013 Amidon et al.
8,579,658 B2 * 11/2013 Youtsey ..... H01R 9/05 439/578
8,597,041 B2 12/2013 Purdy et al.
8,647,136 B2 2/2014 Purdy et al.
8,801,448 B2 8/2014 Purdy et al.
8,888,526 B2 11/2014 Burris
8,920,192 B2 * 12/2014 Montena ..... H01R 9/05 439/578
9,039,446 B2 5/2015 Youtsey
9,153,911 B2 * 10/2015 Burris ..... H01R 13/6581
9,190,773 B2 * 11/2015 Shaw ..... H01R 13/622
9,419,389 B2 8/2016 Purdy et al.
9,444,156 B2 * 9/2016 Chastain ..... H01R 43/26
9,496,661 B2 11/2016 Purdy et al.
9,515,432 B2 12/2016 Purdy et al.
9,570,845 B2 * 2/2017 Purdy ..... H01R 9/0524
9,660,398 B2 5/2017 Purdy et al.
9,680,263 B2 6/2017 Purdy et al.
10,290,958 B2 * 5/2019 Burris ..... H01R 9/05
2003/0224657 A1 12/2003 Malloy
2004/0013096 A1 1/2004 Marinier et al.
2004/0077215 A1 4/2004 Palinkas et al.
2004/0102089 A1 5/2004 Chee
2004/0209516 A1 10/2004 Burris et al.
2004/0219833 A1 11/2004 Burris et al.
2004/0229504 A1 11/2004 Liu
2005/0042919 A1 2/2005 Montena
2005/0208827 A1 9/2005 Burris et al.
2005/0233636 A1 10/2005 Rodrigues et al.
2006/0099853 A1 5/2006 Sattele et al.
2006/0110977 A1 5/2006 Matthews
2006/0154519 A1 7/2006 Montena
2006/0166552 A1 7/2006 Bence et al.
2006/0205272 A1 9/2006 Rodrigues
2006/0276079 A1 12/2006 Chen
2007/0026734 A1 2/2007 Bence et al.
2007/0049113 A1 3/2007 Rodrigues et al.
2007/0123101 A1 * 5/2007 Palinkas ..... H01R 9/0521 439/579
2007/0155232 A1 7/2007 Burris et al.
2007/0175027 A1 8/2007 Khemakhem et al.
2007/0243759 A1 10/2007 Rodrigues et al.
2007/0243762 A1 10/2007 Burke et al.
2008/0102696 A1 5/2008 Montena
2008/0192674 A1 8/2008 Wang et al.
2008/0225783 A1 9/2008 Wang et al.
2008/0248689 A1 10/2008 Montena
2008/0289470 A1 11/2008 Aston
2009/0017803 A1 1/2009 Brillhart et al.
2009/0029590 A1 1/2009 Sykes et al.
2009/0098770 A1 * 4/2009 Bence ..... H01R 9/05 439/583
2009/0176396 A1 7/2009 Mathews
2010/0055978 A1 3/2010 Montena
2010/0081321 A1 4/2010 Malloy et al.
2010/0081322 A1 4/2010 Malloy et al.
2010/0105246 A1 4/2010 Burris et al.
2010/0233901 A1 9/2010 Wild et al.
2010/0233902 A1 9/2010 Youtsey
2010/0255720 A1 10/2010 Radzik et al.
2010/0255721 A1 10/2010 Purdy et al.
2010/0279548 A1 11/2010 Montena et al.
2010/0297871 A1 11/2010 Haube
2010/0297875 A1 11/2010 Purdy et al.
2011/0021072 A1 1/2011 Purdy
2011/0027039 A1 2/2011 Blair
2011/0053413 A1 3/2011 Mathews
2011/0086543 A1 4/2011 Alrutz et al.
2011/0111623 A1 5/2011 Burris et al.
2011/0117774 A1 5/2011 Malloy et al.
2011/0143567 A1 6/2011 Purdy et al.
2011/0230089 A1 9/2011 Amidon et al.
2011/0230091 A1 9/2011 Krenceski et al.
2011/0250789 A1 10/2011 Burris et al.
2012/0021642 A1 1/2012 Zraik
2012/0040537 A1 2/2012 Burris
2012/0045933 A1 * 2/2012 Youtsey ..... H01R 9/05 439/578
2012/0094530 A1 4/2012 Montena
2012/0094532 A1 4/2012 Montena
2012/0122329 A1 * 5/2012 Montena ..... H01R 9/05 439/271
2012/0129387 A1 5/2012 Holland et al.
2012/0145454 A1 6/2012 Montena
2012/0171894 A1 7/2012 Malloy et al.
2012/0196476 A1 8/2012 Haberek et al.
2012/0202378 A1 8/2012 Krenceski et al.
2012/0214342 A1 8/2012 Mathews
2012/0222302 A1 9/2012 Purdy et al.
2012/0225581 A1 9/2012 Amidon et al.
2012/0252263 A1 10/2012 Ehret et al.
2012/0270441 A1 10/2012 Bence et al.
2013/0034983 A1 2/2013 Purdy et al.
2013/0065433 A1 3/2013 Burris
2013/0065435 A1 3/2013 Purdy et al.
2013/0072057 A1 3/2013 Burris
2013/0072059 A1 3/2013 Purdy et al.
2013/0102188 A1 4/2013 Montena
2013/0102189 A1 4/2013 Montena
2013/0102190 A1 4/2013 Chastain et al.
2013/0164962 A1 * 6/2013 Shaw ..... H01R 13/622 439/320
2013/0164975 A1 6/2013 Blake et al.
2013/0171869 A1 7/2013 Chastain et al.

(56) References Cited

U.S. PATENT DOCUMENTS

| | | | |
|---|---|---|---|
| 2013/0171870 | A1 | 7/2013 | Chastain et al. |
| 2013/0183857 | A1 | 7/2013 | Ehret et al. |
| 2013/0224995 | A1 | 8/2013 | Montena |
| 2013/0237089 | A1 | 9/2013 | Lu |
| 2013/0337683 | A1 | 12/2013 | Chastain et al. |
| 2014/0051285 | A1 | 2/2014 | Raley et al. |

FOREIGN PATENT DOCUMENTS

| | | | |
|---|---|---|---|
| CN | 10106069000 | | 10/2007 |
| CN | 20114993600 | | 11/2008 |
| CN | 20114993700 | | 11/2008 |
| CN | 20117822800 | | 7/2009 |
| CN | 20190450800 | | 7/2011 |
| CN | 102570073 | A | 7/2012 |
| DE | 4793100 | | 7/1929 |
| DE | 10228900 | | 1/1958 |
| DE | 111768700 | | 11/1961 |
| DE | 119188000 | | 4/1965 |
| DE | 151389800 | | 4/1970 |
| DE | 222576400 | | 12/1972 |
| DE | 222193600 | | 11/1973 |
| DE | 226197300 | | 6/1974 |
| DE | 321100800 | | 10/1983 |
| DE | 900160840 | | 4/1990 |
| DE | 443985200 | | 5/1996 |
| DE | 1995751800 | | 9/2001 |
| EP | 0072104 | A1 | 2/1983 |
| EP | 11615700 | | 8/1984 |
| EP | 16773800 | | 1/1986 |
| EP | 0265276 | A2 | 4/1988 |
| EP | 0428424 | A2 | 5/1991 |
| EP | 119126800 | | 3/2002 |
| EP | 150115900 | | 1/2005 |
| EP | 154889800 | | 6/2005 |
| EP | 170141000 | | 9/2006 |
| EP | 2378614 | A1 | 10/2011 |
| FR | 223284600 | | 1/1975 |
| FR | 223468000 | | 1/1975 |
| FR | 231291800 | | 12/1976 |
| FR | 246279800 | | 2/1981 |
| FR | 249450800 | | 5/1982 |
| GB | 58969700 | | 6/1947 |
| GB | 108722800 | | 10/1967 |
| GB | 127084600 | | 4/1972 |
| GB | 140137300 | | 7/1975 |
| GB | 201966500 | | 10/1979 |
| GB | 207954900 | | 1/1982 |
| GB | 225267700 | | 8/1992 |
| GB | 226420100 | | 8/1993 |
| GB | 233163400 | | 5/1999 |
| GB | 247747900 | | 8/2010 |
| JP | 307486400 | | 1/2001 |
| JP | 2002-015823 | A | 1/2002 |
| JP | 450379300 | | 1/2002 |
| JP | 2002207555600 | | 3/2002 |
| JP | 200110229900 | | 4/2002 |
| JP | 328036900 | | 5/2002 |
| JP | 1503793 | | 7/2010 |
| JP | 4503793 | B2 | 7/2010 |
| KR | 200610062252600 | | 9/2006 |
| TW | 4270440 | | 3/2001 |
| WO | 87/00351 | A1 | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2008051740 | A2 | 5/2008 |
| WO | 2010135181 | A2 | 11/2010 |
| WO | 2011128665 | A1 | 10/2011 |
| WO | 2011128666 | A1 | 10/2011 |
| WO | 2012061379 | A2 | 5/2012 |

OTHER PUBLICATIONS

Federal Circuit Appeal 2015-1364. Brief of Appellant PPC Broadband, Inc. (Feb. 22, 2016).

Federal Circuit Appeals 2015-1361, -1366, -1368, -1369. Brief of Appellant PPC Broadband, Inc. (Feb. 22, 2016).

Jun. 17, 2016 Korean Office Action issue in Korean Patent Application No. 10-2011-7030801.

Jul. 21, 2016 International Preliminary Report on Patentability issued in PCT/US2015/010431.

Aug. 19, 2016 Office Action issued in Korean Patent Application No. 10-2015-7016052.

Decision on Remand, *Corning Optical Communications RF, LLC*, v. *PPC Broadband, Inc*. Case IPR2013-00345, U.S. Pat. No. 8,313,353 B2, Paper 86, Nov. 16, 2016.

Decision on Remand, *Corning Optical Communications RF, LLC*, v. *PPC Broadband, Inc*, Case IPR2013-00346, U.S. Pat. No. 8,287,320 B2, Paper 86, Nov. 16, 2016.

Decision on Remand, *Corning Optical Communications RF, LLC*, v. *PPC Broadband, Inc*., Case IPR2013-00340, U.S. Pat. No. 8,323,060 B2, Paper 89, Nov. 16, 2016.

Decision, *Corning Optical Communications RF LLC*, v. *PPC Broadband, Inc*, Case IPR2015-01952, U.S. Pat. No. 8,647,136 32, Paper 16, Apr. 14, 2016.

Decision, *Corning Optical Communications RF LLC*, v. *PPC Broadband, Inc*, Case IPR2015-01955, U.S. Pat. No. 8,647,136 32, Paper 19, Apr. 15, 2016.

Feb. 24, 2012 Interview Summary issued in U.S. Appl. No. 13/033,127.

Mar. 23, 2012 Office Action Response in U.S. Appl. No. 13/033,127.

Oct. 24, 2011 Office Action issued in U.S. Appl. No. 12/633,792.

Feb. 24, 2012 Office Action response in U.S. Appl. No. 12/633,792.

Jun. 14, 2012 Interview Summary issued in U.S. Appl. No. 12/633,792.

Jun. 25, 2012 Notice of Allowability issued in U.S. Appl. No. 12/633,792.

Dec. 11, 2012 Transmittal of Communication to Third Party Inter Partes Reexamination issued in U.S. Appl. No. 95/002,400.

May 21, 2014 Office Action issued in U.S. Appl. No. 95/002,400.

Sep. 25, 2015 Office Action issued in U.S. Appl. No. 14/104,461.

Inter Partes Review Case IPR2013-00343—U.S. Pat. No. 8,323,060 (Claims 1-9), Final Written Decision, Paper 79, Entered on Nov. 21, 2014, 56 pages.

Inter Partes Review Case IPR2013-00342—U.S. Pat. No. 8,323,060 (Claims 10-25), Final Written Decision, Paper 49, Entered on Nov. 21, 2014, 32 pp.

Inter Partes Review Case IPR2013-00343—U.S. Pat. No. 8,313,353 (Claims 1-6), Judgement, Paper 27, Entered on Apr. 15, 2014, 3 pages.

Inter Partes Review Case IPR2013-00345—U.S. Pat. No. 8,313,353 (Claims 7-27), Final Written Decision, Paper 76, Entered on Nov. 21, 2014, 57 pages.

Inter Partes Review Case IPR2013-00346—U.S. Pat. No. 8,287,320 (Claims 1-8, 10-16, and 18-31), Final Written Decision, Paper 76, Entered on Nov. 21, 2014, 51 pages.

Inter Partes Review Case IPR2013-00347—U.S. Pat. No. 8,287,320 (Claims 9, 17, and 32), Final Written Decision, Paper 77, Entered on Nov. 21, 2014, 44 pages.

Inter Partes Review Case IPR2014-00440—U.S. Pat. No. 8,597,041 (Claims 1, 8, 9, 11, 18-26, and 29), Decision—Institution of Inter Partes Review, Paper 10, Entered on Aug. 19, 2014, 23 pages.

Inter Partes Review Case IPR2014-00441—U.S. Pat. No. 8,562,366 (Claims 31, 37, 39, 41, 42, 55, and 56), Decision—Institution of Inter Partes Review, Paper 10, Entered on Aug. 19, 2014, 29 pages.

U.S. Reexamination Control No. 90/012,835 of U.S. Pat. No. 8,172,612, filed Apr. 11, 2013.

IPR2014-00440. Petition for Inter Partes Review of U.S. Pat. No. 8,597,041 Under 35 U.S.C. .sctn..sctn. 311-319 and 37 C.F.R. .sctn. 42.100 (Feb. 18, 2014).

IPR2014-00440. Decision—Institution of Inter Pules Review—37 C.F.R. .sctn. 42.108 (Aug. 19, 2014).

(56) References Cited

OTHER PUBLICATIONS

IPR2014-00440. Patent Owner Response (Nov. 12, 2014).
IPR2014-00440. Petitioner Reply to Patent Owner Response (Feb. 4, 2015).
IPR2014-00441. Petition for Inter Partes Review of U.S. Pat. No. 8,562,366 (Claims 31, 37, 39, 41, 42, 55, and 56) Under 35 U.S.C. .sctn..sctn. 311-319 and 37 C.F.R. .sctn. 42.100 (Feb. 18, 2014).
IPR2014-00441. Decision—Institution of Inter Pules Review—37 C.F.R. .sctn. 42.108 (Aug. 19, 2014).
IPR2014-00441. Patent Owner Response (Nov. 12, 2014).
IPR2014-00441. Petitioner Reply to Patent Owner Response (Feb. 4, 2015).
U.S. District Court for the Northern District of New York, Civil Action No. 5:13-CV-1310 (Glsidep). Report and Recommendation (Jul. 9, 2015).
U.S. District Court for the Northern District of New York, Civil Action No. 5:14-CV-1170 (GLS/DEP). Report and Recommendation (Jul. 9, 2015).
IP Australia, Patent Examination Report No. 1 from Australian Patent Application No. 2010249855 dated May 12, 2015 (total 3 pages).
EP/14166195.9; Filing Date Apr. 28, 2014; Extended European Search Report; dated Sep. 25, 2014; (6 pages).
Patent Owner's Response to the Action Closing Prosecution in the Inter Partes Reexamination of the '237 Patent; Reexamination Control No. 95/002,400; Jun. 23, 2014.
Transmittal of Communication to Third Party Requester; Reexamination Control No. 95/002,400; Aug. 5, 2015.
Brief of Appellee; Appeal from the United States Patent and Trademark Office, Patent Trial and Appeal Board, Case Nos. IPR2013-00340, IPR2013-00345, IPR2013-00346, and IPR2013-00347; Aug. 10, 2015.
Brief of Appellee; Appeal from the United States Patent and Trademark Office, Patent Trial and Appeal Board, Case No. IPR2013-00342; Aug. 10, 2015.
Report and Recommendation; USDC-NDNY Civil Action No. 5:14-CV-1170; Jul. 9, 2015.
Report and Recommendation; USDC-NDNY Civil Action No. 5:13-CV-1310; Jul. 9, 2015.
Witness Statement of Michael Lawrence; ITC Inv. No. 337-TA-938; Aug. 14, 2015.
Witness Statement of Noah Montena; ITC Inv. No. 337-TA-938; Aug. 14, 2015.
Decision Granting Patent Owner's Motions to Dismiss Petitions for Failure to Name All Real Parties-In-Interest; Appeal from the United States Patent and Trademark Office, Patent Trial and Appeal Board; Case Nos. IPR2014-00440, IPR2014-00441,IPR2014-00736; Aug. 18, 2015.
Witness Statement of Eric Purdy; ITC Inv. No. 337-TA-938; Aug. 14, 2015.
Sep. 25, 2015 Office Action issued in U.S. Appl. No. 14/104,463.
Declaration of Eric Purdy; ITC Inv. No. 337-TA-938; Aug. 12, 2015.
Dec. 11, 2012 Office Action issued in U.S. Appl. No. 95/002,400.
Direct Witness Statement of Ronald P. Locati Regarding Invalidity of U.S. Pat. No. 3,801,448; ITC Inv. No. 337-TA-938; Aug. 14, 2015.
Defendant Corning Gilbert Inc.'s Disclosure of Non-Infringement, Invalidity, and Unenforceability Contentions; US DC-NDNY Civil Action No. 5:12-cv-911; Nov. 19, 2012.
Defendant Corning Gilbert Inc.'s Disclosure of Non-Infringement, Invalidity, and Unenforceability Contentions (Appendix E); USDC-NDNY Civil Action No. 5:12-cv-911; Sep. 15, 2012.
Defendant Corning Gilbert Inc.'s Disclosure of Non-Infringement, Invalidity, and Unenforceability Contentions (Appendix E-Exhibit O); USDC-NDNY Civil Action No. 5:12-cv-911; Oct. 13, 2012.
Defendant Corning Optical Communications RF, LLC's Disclosure of Non-Infringement, Invalidity, and Unenforceability Contentions; USDC-NDNY Civil Action No. 5:14-cv-1170; Jan. 8, 2014.
Declaration of Ronald P. Locati; USDC-NDNY Civil Action No. 5:13-cv-01310; Feb. 18, 2014.
Jun. 2, 2011 Office Action issued in U.S. Appl. No. 13/033,127.
Expert Report of Ronald P. Locati Regarding Invalidity of U.S. Pat. No. 8,801,448; ITC Inv. No. 337-TA-938; Jun. 19, 2015.
Jun. 21, 2011 Interview Summary issued in U.S. Appl. No. 13/033,127.
Jun. 24, 2011 Office Action response to U.S. Appl. No. 13/033,127.
Oct. 25, 2011 Office Action issued in U.S. Appl. No. 13/033,127.
ARRIS1; Digicon AVL Connector. ARRIS Group Inc. [online]. 3 pages. [retrieved on Apr. 22, 2010]. Retrieved from the Intemet<URL: http://www.arrisi.com/special/digiconAVL.asp>.
ISR1; PCT/US2011/057939 Date of Mailing: Apr. 30, 2012 International Search Report and Written Opinion. pp. 8.
LIT10; Defendant's Disclosure of Preliminary Invalidity Contentions, Served Oct. 31, 2013, *PPC Broadband, Inc. d/b/a PPC* v. *Times Fiber Communications, Inc.*, United States District Court Northern district of New York, Civil Action No.5:13-CV-0460-TJM-DEP, 48 pages.
LIT12a; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert,Inc.*, United States District Court Northern District of New York, Civil Action No. 5:12-CV-00911-GLS-DEP, pp. 1-90.
LIT12b; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert,Inc.*, United States District Court Northern District of New York, Civil Action No. 5:12-CV-00911-GLS-DEP, pp. 91-199.
LIT12c; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert,Inc.*, United States District Court Northern District of New York, Civil Action No. 5:12-CV-00911-GLS-DEP, pp. 200-383.
LIT16; Report and Recommendation, Issued Dec. 5, 2013, *John Mezzalingua Associates, Inc., d/b/a PPC*, v. *Corning Gilbert, Inc.*, United States District Court Northern District of New York, Civil Action No. 5:12-CV-00911-GLS-DEP, 52 pages.
NOA1; Notice of Allowance (dated Feb. 24, 2012) for U.S. Appl. No. 13/033,127, filed Feb. 23, 2011.
NOA2; Notice of Allowance (dated Jan. 24, 2013) for U.S. Appl. No. 13/072,350.
NOA3; Notice of Alowance (dated Jun. 25, 2012) for U.S. Appl. No. 12/633,792, filed Dec. 8, 2009.
NOA4; Notice of Allowance (dated Mar. 20, 2012) for U.S. Appl. No. 13/117, 843, filed May 27, 2011.
OA1; Office Action dated Mar. 29, 2013 for U.S. Appl. No. 13/712,470.
OA10; Final Office Action (dated Oct. 25, 2011) for U.S. Appl. No. 13/033,127, filed Feb. 23, 2011.
OA11; Office Action (dated Oct. 24, 2011) for U.S. Appl. No. 12/633,792, filed Dec. 8, 2009.
OA2; Office Action (dated Mar. 6, 2013) for U.S. Appl. No. 13/726,330, filed Dec. 24, 2012.
OA3; Office Action (dated Feb. 20, 2013) for U.S. Appl. No. 13/726,349, filed Dec. 24, 2012.
OA4; Office Action (dated Feb. 20, 2013) for U.S. Appl. No. 13/726,339, filed Dec. 24, 2012.
OA5; Office Action (dated Mar. 11, 2013) for U.S. Appl. No. 13/726,347, filed Dec. 24, 2012.
OA6; Office Action (dated Feb. 20, 2013) for U.S. Appl. No. 13/726,356, filed Dec. 24, 2012.
OA7; Office Action (dated Apr. 12, 2013) for U.S. Appl. No. 13/712,498, filed Dec. 12, 2012.
OA8; Office Action (dated Jun. 11, 2013) for U.S. Appl. No. 13/860,964, filed Apr. 11, 2013.
OA9; Office Action (dated Jun. 2, 2011) for U.S. Appl. No. 13/033,127, filed Feb. 23, 2011.
REEXAM1; U.S. Reexamination Control No. 90/012,300 of U.S. Pat. No. 8,172,612, filed Jun. 29, 2012.

(56) References Cited

OTHER PUBLICATIONS

RES1; Response dated Jun. 24, 2011 to Office Action (dated Jun. 2, 2011) for U.S. Appl. No. 13/033,127, filed Feb. 23, 2011.
TECHDOC1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.
TECHDOC10; PPC Product Guide, 2008.
TECHDOC2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.
TECHDOC3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.
TECHDOC4; Panasonic, "Remaining issues on Persistent scheduling," R2-083311, derived from R2082228 and R2-082229, Agenda Item: 6.1.1.8, 3GPP TSG RAN WG2 #62bis, Warsaw, Poland, Jun. 30-Jul. 4, 2008, 4 pages.
TECHDOC5; Qualcomm Europe, "Release of semi-persistent resources," R2-082500 (was R2-081828), Agenda Item: 5.1.1.8 3GPP TSG-RAN WG2 meeting #62, Kansas City, MO, USA, May 5-9, 2008, 2 pages.
TECHDOC6; Samsung, "C-RNTI and NDI for SPS," R2-084464, Agenda Item: 6.1.1.3, 3GPP TSG-RAN2#63 meeting, Jeju, South Korea, Aug. 18-22, 2008, 3 pages.
TECHDOC7; Nokia Corporation, Nokia Siemens Networks, "Persistent Scheduling for DL," R2-080683 (RS-080018), 3GPP TSG-RAN WG2 Meeting #61, Agenda Item: 5.1.1.8, Sorrento, Italy, Feb. 11-15, 2008, 6 pages.
TECHDOC8; Panasonic, "SPS activation and release," R1-084233, 3GPP TSG-RAN WG1 Meeting #55, Prague, Czech Republic, Nov. 10-14, 2008, 6 pages.
TECHDOC9; PCT International, Inc., Compression Connectors Installation Guide, Aug. 3, 2009.
TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens,Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.
IPR2014-00440. Petition for Inter Partes Review of U.S. Pat. No. 8,597,041 Under 35 U.S.C. §§ 311-319 and 37 C.F.R. § 42.100 (Feb. 18, 2014).
IPR2014-00440. Decision—Institution of Inter Partes Review—37 C.F.R. § 42.108 (Aug. 19, 2014).
IPR2014-00441. Petition for Inter Partes Review of U.S. Pat. No. 8,562,366 (Claims 31, 37, 39, 41, 42, 55, and 56) Under 35 U.S.C. §§ 311-319 and 37 C.F.R. § 42.100 (Feb. 18, 2014).
IPR2014-00441. Decision—Institution of Inter Partes Review—37 C.F.R. § 42.108 (Aug. 19, 2014).
Federal Circuit Appeals 2015-1361, -1366, -1368, -1369. Brief of Appellant PPC Broadband, Inc. (May 26, 2015).
Federal Circuit Appeal 2015-1364. Brief of Appellant PPC Broadband, Inc. (May 26, 2015).
U.S. District Court for the Northern District of New York, Civil Action No. 5:13-CV-1310 (GLS/DEP). Report and Recommendation (Jul. 9, 2015).
Complainant PPC Broadband, Inc.'s Sixth Supplemental and Amended Objections and Responses to Respondent Corning Optical Communications RF, LLC's First Set of Interrogatories-Redacted (No. 28); ITC Inv. No. 337-TA-938. (Oct. 23, 2012).
Brief of Appellant; Appeal from the United States Patent and Trademark Office, Patent Trial and Appeal Board, Case Nos. IPR2013-00340,IPR2013-00345, IPR2013-00346, and IPR2013-00347; May 26, 2015.
Breif of Appellant; Appeal from the United States Patent and Trademark Office, Patent Trial and Appeal Board, Case No. IPR2013-00342; May 26, 2015.
Declaration of Charles A. Eldering, Ph.D; Appeal from the United States Patent and Trademark Office, Patent Trial and Appeal Board, Case No. IPR2014-00441; Nov. 12, 2014.
Declaration of Charles A. Eldering, Ph.D; Appeal from the United States Patent and Trademark Office, Patent Trial and Appeal Board, Case Nos. IPR2013-00340, -00345, -00346, -00347; Mar. 26, 2014.
Declaration of Charles A. Eldering, Ph.D; Appeal from the United States Patent and Trademark Office, Patent Trial and Appeal Board, Case No. IPR2013-00342; Mar. 26, 2014.
Declaration of Dr. Robert S. Mroczkowski for Inter Partes Review of U.S. Pat. No. 8,323,060 (Claims 1-9); Appeal from the United States Patent and Trademark Office, Patent Trial and Appeal Board; Jun. 10, 2013.
Declaration of Dr. Robert S. Mroczkowski Comparing Patent Owner and Petitioner's Connectors; Appeal from the United States Patent and Trademark Office, Patent Trial and Appeal Board, Case Nos. IPR2013-00340, -00345, -00346, -00347; May 16, 2014.
Declaration of Dr. Robert S. Mroczkowski for Inter Partes Review of U.S. Pat. No. 8,323,060 (Claims 10-25); Appeal from the United States Patent and Trademark Office, Patent Trial and Appeal Board, Jun. 10, 2013.
Declaration of Dr. Robert S. Mroczkowski for Inter Partes Review of U.S. Pat. No. 8,313,353 (Claims 1-6); Appeal from the United States Patent and Trademark Office, Patent Trial and Appeal Board; Jun. 10, 2013.
Declaration of Dr. Robert S. Mroczkowski for Inter Partes Review of U.S. Pat. No. 8,313,353 (Claims 7-27); Appeal from the United States Patent and Trademark Office, Patent Trial and Appeal Board, Jun. 10, 2013.
Declaration of Dr. Robert S. Mroczkowski for Inter Partes Review of U.S. Pat. No. 8,287,320 (Claims 1-8, 10-16 and 18-31); Appeal from the United States Patent and Trademark Office, Patent Trial and Appeal Board; Jun. 10, 2013.
Declaration of Dr. Robert S. Mroczkowski for Inter Partes Review of U.S. Pat. No. 8,287,320 (Claims 9, 17 and 32); Appeal from the United States Patent and Trademark Office, Patent Trial and Appeal Board; Jun. 10, 2011.
Declaration of Ronald P. Locati for Inter Partes Review of U.S. Pat. No. 8,597,041; Appeal from the United States Patent and Trademark Office, Patent Trial and Appeal Board; Feb. 18, 2014.
Declaration of Ronald P. Locati for Inter Partes Review of U.S. Pat. No. 8,562,366; Appeal from the United States Patent and Trademark Office, Patent Trial and Appeal Board; Feb. 18, 2014.
Declaration of Ronald O. Locati for Inter Partes Review of U.S. Pat. No. 8,647,136 (Claims 27, 30 and 34-38); Appeal from the United States Patent and Trademark Office, Patent Trial and Appeal Board; Sep. 23, 2015.
Declaration of Ronald P. Locati for Inter Partes Review of U.S. Pat. No. 8,647,136 (Claims 50, 53 and 57-61); Appeal from the United States Patent and Trademark Office, Patent Trial and Appeal Board; Sep. 23, 2015.
Direct Witness Statement of Ronald P. Locati Regarding Invalidity of U.S. Pat. No. 8,801,448; ITC Inv. No. 337-TA-938; Aug. 14, 2015.
Decision Granting Patent Owner's Motion to Dismiss Petitions for Failure to Name All Real Parties-In-Interest; Appeal from the Untied States Patent and Trademark Office, Patent Trial and Appeal Board, Case Nos. IPR2014-00440, -00441, -00736; Aug. 18, 2015.
Decision Granting Owner's Motion to ismiss Petitions for Failure to Name All Real Parties-In-Interest; Appeal from the United States Patent and Trademark Office, Patent Trial and Appeal Board; Case Nos. IPR2014-00440, -00441, -00736; Aug. 18, 2015.
Final Written Decision; Appeal from the United States Patent and Trademark Office, Patent Trial and Appeal Board; Case No. IPR2013-00347; Nov. 21, 2014.
Final Written Decision; Appeal from the United States Patent and Trademark Office, Patent Trial and Appeal Board; Case No. IPR2013-00346; Nov. 21, 2014.

(56) References Cited

OTHER PUBLICATIONS

Final Written Decision; Appeal from the United States Patent and Trademark Office, Patent Trial and Appeal Board; Case No. IPR2013-00342, Nov. 21, 2014.
Final Written Decision; Appeal from the United States Patent and Trademark Office, Patent Trial and Appeal Board; Case No. IPR2013-00345; Nov. 21, 2014.
Final Written Decision; Appeal from the United States Patent and Trademark Office, Patent Trial and Appeal Board; Case No. IPR2013-00340, Nov. 21, 2014.
Decision; Institution of Inter Partes Review; Appeal from the United States Patent and Trademark Office, Patent Trial and Appeal Board; Case No. IPR2014-00441; Aug. 19, 2014.
Decision; Institution of Inter Partes Review; Appeal from the United States Patent and Trademark Office, Patent Trial and Appeal Board; Case No. IPR2014-00440; Aug. 19, 2014.
Judgment; Request for Adverse Judgment; Appeal from the United States Patent and Trademark Office, Patent Trial and Appeal Board; Case No. IPR2013-00343; Apr. 15, 2014.
Decision; Institution of Inter Partes Review; Appeal from the United States Patent and Trademark Office, Patent Trial and Appeal Board; Case No. IPR2013-00345; Dec. 5, 2013.
Decision; Institution of Inter Partes Review; Appeal from the United States Patent and Trademark Office, Patent Trial and Appeal Board; Case No. IPR2013-00343; Dec. 5, 2013.
Decision; Institution of Inter Partes Review; Appeal from the United States Patent and Trademark Office, Patent Trial and Appeal Board; Case No. IPR2013-00347; Nov. 26, 2013.
Decision; Institution of Inter Partes Review; Appeal from the United States Patent and Trademark Office, Patent Trial and Appeal Board; Case No. IPR2013-00346; Nov. 26, 2013.
Decision; Institution of Inter Partes Review; Appeal from the United States Patent and Trademark Office, Patent Trial and Appeal Board; Case No. IPR2013-00342; Nov. 26, 2013.
Decisions; Institution of Inter Partes Review; Appeal from the United States Patent and Trademark Office, Patent Trial and Appeal Board; Case No. IPR2013-00340; Nov. 26, 2013.
Declaration of Ronald P. Locati (Exhibit A); USDC-NDNY Civil Action No. 5:13-cv-01310; Feb. 18, 2014.
Declaration of Ronald P. Locati (Exhibit B); USDC-NDNY Civil Action No. 5:13-cv-01310; Feb. 18, 2014.
Declaration of Ronald P. Locati (Exhibit C); USDC-NDNY Civil Action No. 5:13-cv-01310; Jun. 10, 2013.
Declaration of Ronald P. Locati (Exhibit E); USDC-NDNY Civil Action No. 5:13-cv-01310; Apr. 9, 2010.
Declaration of Ronald P. Locati (Exhibit I); USDC-NDNY Civil Action No. 5:13-cv-01310; Nov. 26, 2013.
Declaration of Ronald P. Locati (Exhibit J); USDC-NDNY Civil Action No. 5:13-cv-01310; Feb. 18, 2014.
Declaration of Ronald P. Locati (Exhibit K); USDC-NDNY Civil Action No. 5:13-cv-01310; Feb. 18, 2014.
Declaration of Ronald P. Locati (Exhibit L); USDC-NDNY Civil Action No. 5:13-cv-01310; Feb. 18, 2014.
Expert Report of Ronald P. Locati Regarding Invalidity of U.S. Pat. No. 8,801,448 (Exhibit 34); ITC Inv. No. 337-TA-938, Jun. 19, 2015.
Expert Report of Ronald P. Locati Regarding Invalidity of U.S. Pat. No. 8,801,448 (Exhibit 35); ITC Inv. No. 337-TA-938, Jun. 19, 2015.
Expert Report of Ronald P. Locati Regarding Invalidity of U.S. Pat. No. 8,801,448 (Exhibit 37); ITC Inv. No. 337-TA-938, Jun. 19, 2015.
Expert Report of Ronald P. Locati Regarding Invalidity of U.S. Pat. No. 8,801,448 (Appendix A); ITC Inv. No. 337-TA-938, Jun. 19, 2015.
Feb. 9, 2016 Office Action issued in U.S. Appl. No. 14/134,892.
Declaration of David H. Jackson; Appeal from the United States Patent and Trademark Office, Patent Trial and Appeal Board, Case Nos. IPR2013-00340, IPR2013-00345, IPR2013-00346, IPR2013-00347; Mar. 25, 2014.
Rebuttal Expert Report of Dr. Charles A. Eldering Regarding Validity of U.S. Pat. No. 8,801,448; ITC Inv. No. 337-TA-938; Jul. 10, 2015.
Declaration of Charles A. Eldering, Ph.D.; Appeal from the United States Patent and Trademark Office, Patent Trial and Appeal Board, Case No. IPR2014-00440; Nov. 12, 2014.
Declaration of David H. Jackson; Appeal from the United States Patent and Trademark Office, Patent Trial and Appeal Board, Case No. IPR2014-00440; Nov. 12, 2014.
Declaration of David H. Jackson; USDC-NDNY Civil Action No. 5:13-cv-01310-GLS-DEP; Dec. 16, 2013.
Rebuttal of Witness Statement of Dr. Charles A. Eldering; ITC Inv. No. 337-TA-938; Aug. 28, 2015.
Witness Statement of David H. Jackson; ITC Inv. No. 337-TA-938; Aug. 14, 2015.
Reply Declaration of Dr. Charles A. Eldering; USDC-NDNY Civil Action No. 5:13-CV-1310 (GLS/DEP); Feb. 24, 2014.
Jeremy Amidon; Loose Connectors Contribute Significantly to Emerging System Issues; A PPC Whitepaper; Dec. 16, 2013.
Jeremy Amidon; Loose Connectors: Frequency of Occurance, Defining Continuous Shielding Connectors as a Solution, and Case Studies Highlighting Impact on Coaxial Cable Networks; A PPC Whitepaper; Dec. 16, 2013.
TECHSPEC1A; "3rd Generation Partnership Project; Technical Specification Group Radio Access Network; Requirements for Evolved Utra (E-UTRA) and Evolved UTRAN (E-UTRAN) (Release 7)," Technical Report, 3GPP TR 125.913 V7.3.0, Mar. 2006, 18 pages.
TECHSPEC2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2(Release 8)," Technical Specification, 3GPP TS 36.300 V8.5.0, May 2008, 134 pages.
TECHSPEC3A; "3rd Generation Partnership Project; Technical Specification Group Radio Access Network; Evolved Universal Terrestrial Radio Access (E-UTRA) Medium Access Control (MAC) protocol specification (Release 8)," Technical Specification, 3GPPTS 36.321 V8.2.0, May 2008, 32 pages.
TECHSPEC4A; "3rd Generation Partnership Project; Technical Specification Group Radio Access Netowrk; Evolved Universal Terrestrial Radio Access (E-UTRA); Physical layer procedures (Release 8)," Technical Specification, 3GPP TS 36.213 V8.4.0, Sep. 2008, 60 pages.
TECHSPEC5A; Society of Cable Telecommunications Engineers, Engineering Committee, Interface Practices Subcommittee; American National Standard; ANSI/SCTE 01 2006; "Specification for "F" Port, Female, Outdoor". Published Jan. 2006. 9 pages.
TECHSPEC6A; Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
Patent Application No. GB1109575.9 Examination Report Under Section 18(3); Report dated Jun. 23, 2011. 3 pp.
Patent No. ZL2010202597847; Evaluation Report of Utility Model Patent; Report dated Sep. 2, 2011. 8 pages. (Chinese version with English Translation (10 pages) provided).
PCT/US2010/034870; International Filing Date May 14, 2010. International Search Report and Written Opinion, dated Nov. 30, 2010. 7 pages.
Request for Inter Partes Reexamination (filed Sep. 13, 2012) of Purdy et al. U.S. Pat. No. 8,192,237 issued Jun. 5, 2012. 150 pages.
U.S. Reexamination Control No. 90/012,749 of U.S. Pat. No. 7,114,990, filed Dec. 21, 2012.
LIT8.sub.-Appendix.sub.-ABC; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendices A, B and C, Dated Nov. 19, 2012. 55 pages.
LIT8.sub.-Appendix.sub.-D; *John Mezzalingua Associates, Inc., d/b/a PPC*, v. *Corning Gilbert, Inc*., USDC, Northern District of New York, Case No. 5:12-cv-00911-GLS-DEP, Defendant Corning

(56) References Cited

OTHER PUBLICATIONS

Gilbert Inc.'s Disclosure of Non-Infringement, Invalidity,and Unenforceability Contentions with Appendix D, Dated Nov. 19, 2012. 108 pages.
LIT8.sub.-Appendix.sub.-E1; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 1-90 pages.
LIT8.sub.-Appendix.sub.-E2; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 91-182 pages.
LIT8.sub.-Appendix.sub.-E3; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 183-273 pages.
LIT8.sub.-Appendix.sub.-E4; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 274-364 pages.
LIT8.sub.-Appendix.sub.-E5; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 365-450 pages.
LIT8.sub.-Appendix.sub.-E6; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 451-483 pages.
LIT8.sub.-Appendix.sub.-E7; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity,and Unenforceability Contentions with Appendix E, Dated Nov. 19, 2012. 33 pages.
LIT8.sub.-CG.sub.-Infringement; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement,Invalidity, and Unenforceability Contentions with Appendices, Dated Nov. 19, 2012. 20 pages.
LIT8.sub.-Ex1-23; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity, andUnenforceability Contentions, Exhibits 1-23, Dated Nov. 19, 2012. 229 pages.
LIT8.sub.-Ex24-45; *John Mezzalingua Associates, Inc., d/b/a PPC*, v. *Corning Gilbert, Inc*., USDC, Northern District of New York, Case No. 5:12-cv-00911-GLS-DEP, Defendant Corning Gilbert Inc.'s Disclosure of Non-Infringement, Invalidity, andUnenforceability Contentions, Exhibits 24-45, Dated Nov. 19, 2012. 200 pages.
Jun. 17, 2016 Korean Office Action issued in Korean Patent Application No. 10-2011-7030801.
Decision, *Corning Optical Communications RF LLC*, v. *PPC Broadband, Inc*, Case IPR2015-01952, U.S. Pat. No. 8,647,136 B2, Paper 16, Apr. 14, 2016.
Decision, *Corning Optical Communications RF LLC*, v. *PPC Broadband, Inc*, Case IPR2015-01955, U.S. Pat. No. 8,647,136 B2, Paper 19, Apr. 15, 2016.
Jun. 26, 2017 Exended European Search Report issued in European Application No. 15734864.0.
Jun. 21, 2018 Office Action issued in European Patent Application No. 15734864.0.
Apr. 29, 2019 Office Action issued in corresponding Chinese Patent Application No. 201580012516.0.
Mar. 13, 2020 Office Action issued in U.S. Appl. No. 15/601,967.

* cited by examiner

CONNECTOR HAVING A GROUNDING MEMBER OPERABLE IN A RADIAL DIRECTION

CROSS-REFERENCE TO RELATED APPLICATIONS

This application is a Continuation of U.S. application Ser. No. 14/149,225 filed Jan. 7, 2014, now U.S. Pat. No. 9,570,845, which in turn is a Continuation-in-Part of U.S. application Ser. No. 13/652,073, filed on Oct. 15, 2012, now U.S. Pat. No. 8,647,136, which is a Continuation of U.S. application Ser. No. 12/633,792, filed on Dec. 8, 2009, now U.S. Pat. No. 8,287,320, which is a non-provisional of U.S. Provisional Patent Application No. 61/180,835, filed on May 22, 2009. The disclosure of the prior applications is hereby incorporated by reference herein in its entirety.

This application is related to the following commonly-owned, patent applications: (a) U.S. patent application Ser. No. 14/134,892, now U.S. Pat. No. 9,660,398, filed on Dec. 19, 2013; (b) U.S. patent application Ser. No. 14/104,463, now U.S. Pat. No. 9,419,389, filed on Dec. 12, 2013; (c) U.S. patent application Ser. No. 14/104,393, now U.S. Pat. No. 9,496,661, filed on Dec. 12, 2013; (d) U.S. patent application Ser. No. 14/092,103, now U.S. Pat. No. 8,920,182, filed on Nov. 27, 2013; (e) U.S. patent application Ser. No. 14/092,003, now U.S. Pat. No. 8,915,754, filed on Nov. 27, 2013; (f) U.S. patent application Ser. No. 14/091,875, now U.S. Pat. No. 8,858,251, filed on Nov. 27, 2013; (g) U.S. patent application Ser. No. 13/971,147, now U.S. Pat. No. 8,801,448, filed on Aug. 20, 2013; (h) U.S. patent application Ser. No. 13/913,043, now U.S. Pat. No. 9,608,345, filed on Jun. 7, 2013; (i) U.S. patent application Ser. No. 13/758,586, now U.S. Pat. No. 9,017,101, filed on Feb. 4, 2013; and (j) U.S. patent application Ser. No. 13/712,470, now U.S. Pat. No. 8,920,192, filed on Dec. 12, 2012.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. Moreover, typical component elements and structures of common connectors may permit loss of ground and discontinuity of the electromagnetic shielding that is intended to be extended from the cable, through the connector, and to the corresponding coaxial cable interface port.

Hence a need exists for an improved connector having structural component elements to improve ground continuity between the coaxial cable, the connector and its various applicable structures, and the coaxial cable connector interface port.

SUMMARY

Part I

The present disclosure is directed toward a first aspect of providing a coaxial cable connector comprising; a connector body; a post engageable with the connector body, wherein the post includes a flange; a nut, axially rotatable with respect to the post and the connector body, the nut having a first end and an opposing second end, wherein the nut includes an internal lip, and wherein a second end portion of the nut corresponds to the portion of the nut extending from the second end of the nut to the side of the lip of the nut facing the first end of the nut at a point nearest the second end of the nut, and a first end portion of the nut corresponds to the portion of the nut extending from the first end of the nut to the same point nearest the second end of the nut of the same side of the lip facing the first end of the nut; and a continuity member disposed within the second end portion of the nut and contacting the post and the nut, so that the continuity member extends electrical grounding continuity through the post and the nut.

A second aspect of the present disclosure provides a coaxial cable connector comprising a connector body; a post engageable with the connector body, wherein the post includes a flange; a nut, axially rotatable with respect to the post and the connector body, the nut having a first end and an opposing second end, wherein the nut includes an internal lip, and wherein a second end portion of the nut starts at a side of the lip of the nut facing the first end of the nut and extends rearward to the second end of the nut; and a continuity member disposed only rearward the start of the second end portion of the nut and contacting the post and the nut, so that the continuity member extends electrical grounding continuity through the post and the nut.

A third aspect of the present disclosure provides a coaxial cable connector comprising a connector body; a post operably attached to the connector body, the post having a flange; a nut axially rotatable with respect to the post and the connector body, the nut including an inward lip; and an electrical continuity member disposed axially rearward of a surface of the internal lip of the nut that faces the flange.

A fourth aspect of the present disclosure provides a method of obtaining electrical continuity for a coaxial cable connection, the method comprising: providing a coaxial cable connector including: a connector body; a post operably attached to the connector body, the post having a flange; a nut axially rotatable with respect to the post and the connector body, the nut including an inward lip; and an electrical continuity member disposed axially rearward of a surface of the internal lip of the nut that faces the flange; securely attaching a coaxial cable to the connector so that the grounding sheath of the cable electrically contacts the post; extending electrical continuity from the post through the continuity member to the nut; and fastening the nut to a conductive interface port to complete the ground path and obtain electrical continuity in the cable connection.

Part II

Another aspect of the present disclosure provides a connector including a post having an outer surface and a coupler having an inner surface. The coupler is configured to receive at least part of the post so that there is a space between the inner and outer surfaces. The connector also includes an electrical continuity member positionable within the space. The electrical continuity member includes (a) a first part which is engageable with the post; and (b) a second part which is disengageable from the post and engageable with the coupler, the second part being moveable in the radial direction relative to the post.

A different aspect of the present disclosure provides a connector including a post extending along an axis. The post includes an outer surface having a flange. The connector includes a coupler with an inner surface. The inner surface includes a protrusion. The connector also includes a continuity member positionable between the protrusion and the flange. The continuity member has a plurality of sections which are moveable in a radial direction relative to each other and the continuity member is configured to (a) simultaneously exert (i) a first biasing force directed radially inward against the outer surface of the post; and (ii) a second biasing force directed radially outward against the inner surface of the coupler; and (b) electrically connect the post and the coupler.

Yet another aspect of the present disclosure provides a connector includes a component extending along an axis. The component is configured to be inserted into a coaxial cable and has an outer surface. The connector includes a coupler rotatably attachable to the component. The coupler is configured to receive at least part of the component and has an inner surface. The connector also include a continuity member having a plurality of portions which are radially moveable relative to each other when the continuity member is between the component and the coupler. The portions include (a) a component engagement portion configured to be engaged with the outer surface while being disengaged from the inner surface; and (b) a coupler engagement portion configured to be engaged with the inner surface while being disengaged from the outer surface, the continuity member configured to maintain an electrical connection between the component and the coupler while the component and coupler have different positions relative to each other.

Additional features and advantages of the present disclosure are described in, and will be apparent from, the following Brief Description of the Drawings and Detailed Description.

DETAILED DESCRIPTION

Part I

Although certain embodiments of the present disclosure are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
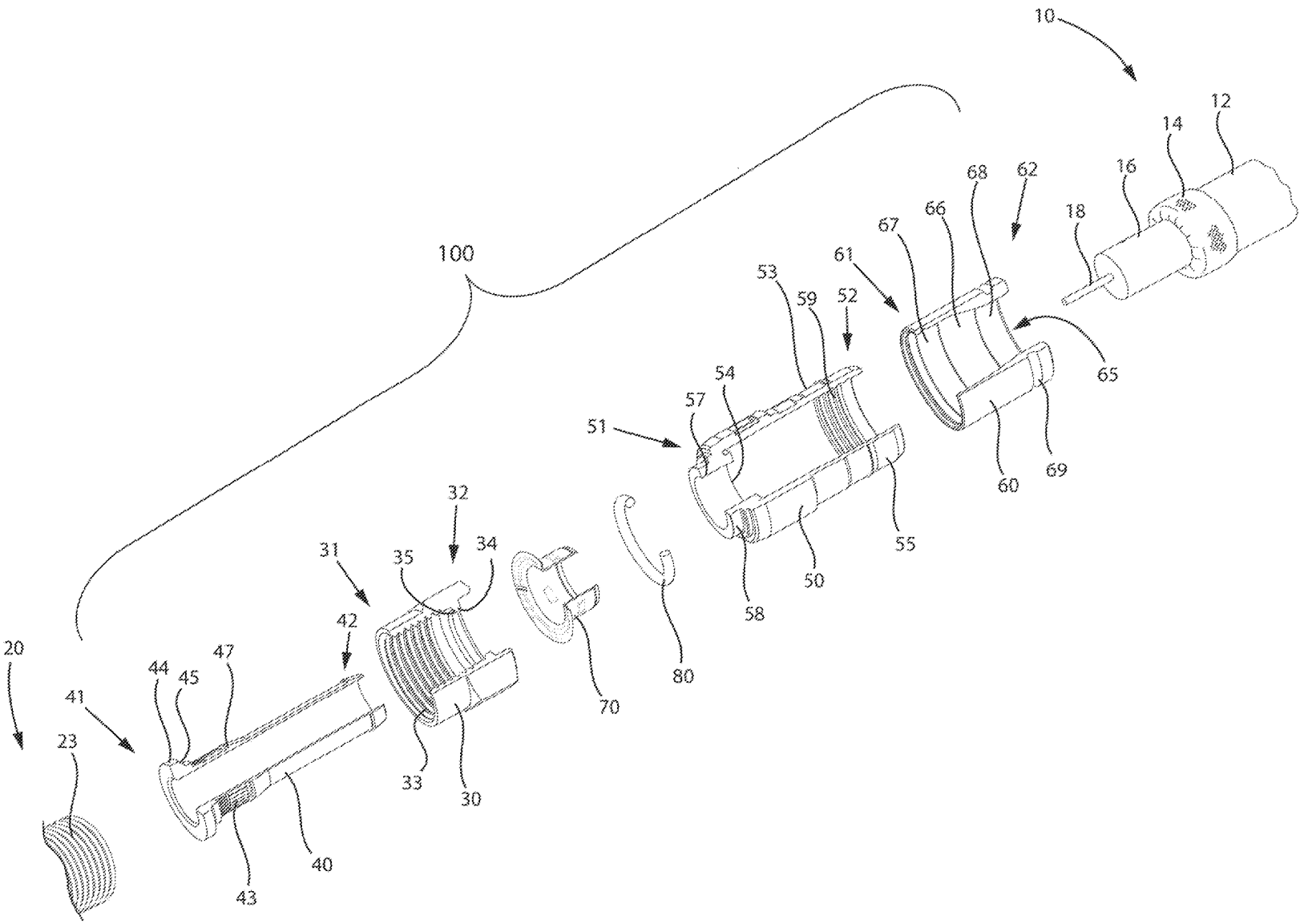
FIG. 1 depicts an exploded perspective cut-away view of an embodiment of the elements of an embodiment of a coaxial cable connector having an embodiment of an electrical continuity member, in accordance with the present disclosure.

Referring to the drawings, FIG. 1 depicts one embodiment of a coaxial cable connector 100 having an embodiment of an electrical continuity member 70. The coaxial cable connector 100 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may also include a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, an embodiment of a coaxial cable connector 100 may further comprise a threaded nut 30, a post 40, a connector body 50, a fastener member 60, a continuity member 70 formed of conductive material, and a connector body sealing member 80, such as, for example, a body O-ring configured to fit around a portion of the connector body 50.

The threaded nut 30 of embodiments of a coaxial cable connector 100 has a first forward end 31 and opposing second rearward end 32. The threaded nut 30 may comprise internal threading 33 extending axially from the edge of first forward end 31 a distance sufficient to provide operably effective threadable contact with the external threads 23 of a standard coaxial cable interface port 20 (as shown, by way of example, in FIG. 20). The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 100. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with an interface port 20. Moreover, the second rearward end 32, of the nut 30 may extend a significant axial distance to reside radially extent, or otherwise partially surround, a portion of the connector body 50, although the extended portion of the nut 30 need not contact the connector body 50. Those in the art should appreciate that the nut need not be threaded. Moreover, the nut may comprise a coupler commonly used in connecting RCA-type, or BNC-type connectors, or other common coaxial cable connectors having standard coupler interfaces. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 of the post 40 when operably assembled in a connector 100, so as to allow the nut to rotate with respect to the other component elements, such as the post 40 and the connector body 50, of the connector 100.

Referring still to FIG. 1, an embodiment of a connector 100 may include a post 40. The post 40 comprises a first forward end 41 and an opposing second rearward end 42. Furthermore, the post 40 may comprise a flange 44, such as an externally extending annular protrusion, located at the first end 41 of the post 40. The flange 44 includes a rearward facing surface 45 that faces the forward facing surface 35 of the nut 30, when operably assembled in a coaxial cable connector 100, so as to allow the nut to rotate with respect to the other component elements, such as the post 40 and the connector body 50, of the connector 100. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of a continuity member 70 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of an interface port 20 (as shown in exemplary fashion in FIG. 20). The post 40 should be formed such that portions of a prepared coaxial cable 10 including the dielectric 16 and center conductor 18 (examples shown in FIGS. 1 and 20) may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

Embodiments of a coaxial cable connector, such as connector 100, may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature 54 that facilitates the secure location of a continuity member 70 with respect to the connector body 50 and/or the post 40, by physically engaging the continuity member 70 when assembled within the connector 100. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of electrical continuity member 70 with respect to the connector body 50. Nevertheless, embodiments of a continuity member 70 may also reside in a secure position with respect to the connector body 50 simply through press-fitting and friction-fitting forces engendered by corresponding tolerances, when the various coaxial cable connector 100 components are operably assembled, or otherwise physically aligned and attached together. In addition, the connector body 50 may include an outer annular recess 58 located proximate or near the first end 51 of the connector body 50. Furthermore, the connector body 50 may include a semi-rigid, yet compliant outer surface 55, wherein an inner surface opposing the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61 and opposing second end 62. In addition, the fastener member 60 may include an internal annular protrusion 63 (see FIG. 20) located proximate the first end 61 of the fastener member 60 and configured to mate and achieve purchase with the annular detent 53 on the outer surface 55 of connector body 50 (shown again, by way of example, in FIG. 20). Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 (such as shown, by way of example, in FIG. 20) may also be similar to the way a cable is fastened to a common CMP-type connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50. A coupler or nut 30 at the front end of the inner post 40 serves to attach the connector 100 to an interface port. In a CMP-type connector having an insertable compression sleeve, the structural configuration and functional operation of the nut 30 may be similar to the structure and functionality of similar components of a connector 100 described in FIGS. 1-20, and having reference numerals denoted similarly.

Figure 2:
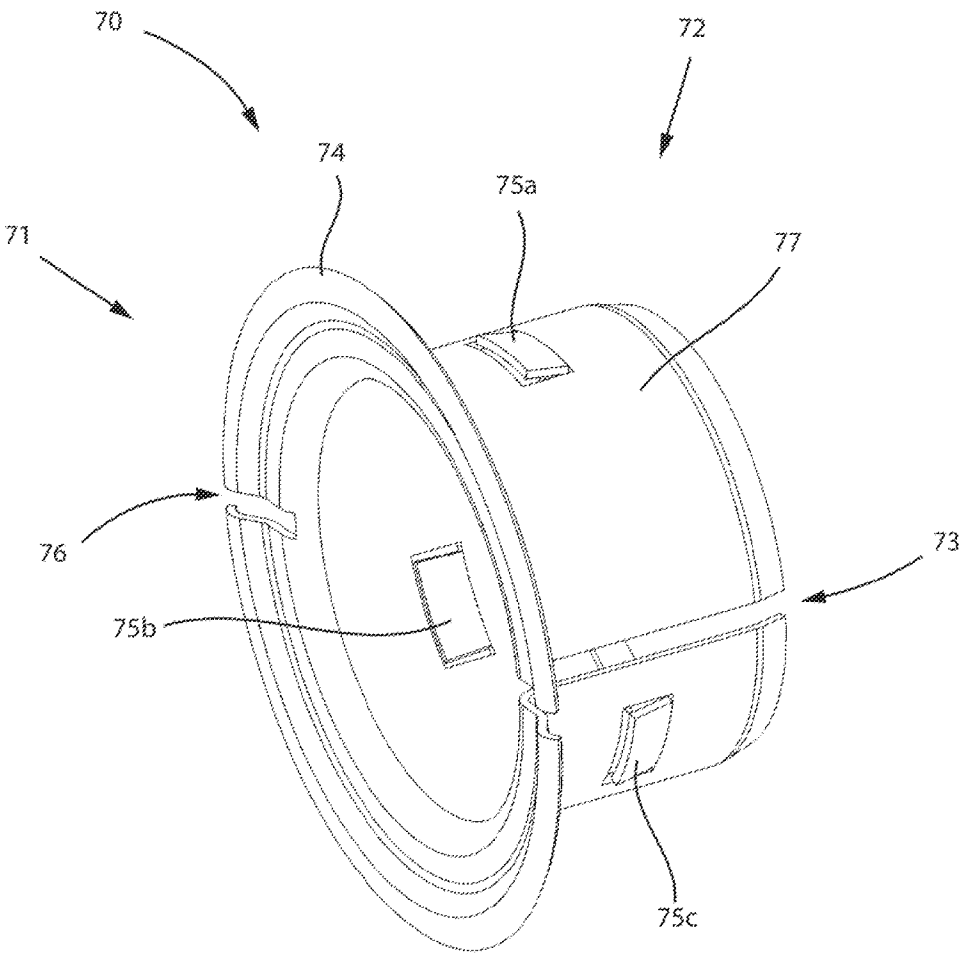
FIG. 2 depicts an isometric view of an embodiment of the electrical continuity member depicted in FIG. 1, in accordance with the present disclosure.
Figure 3:
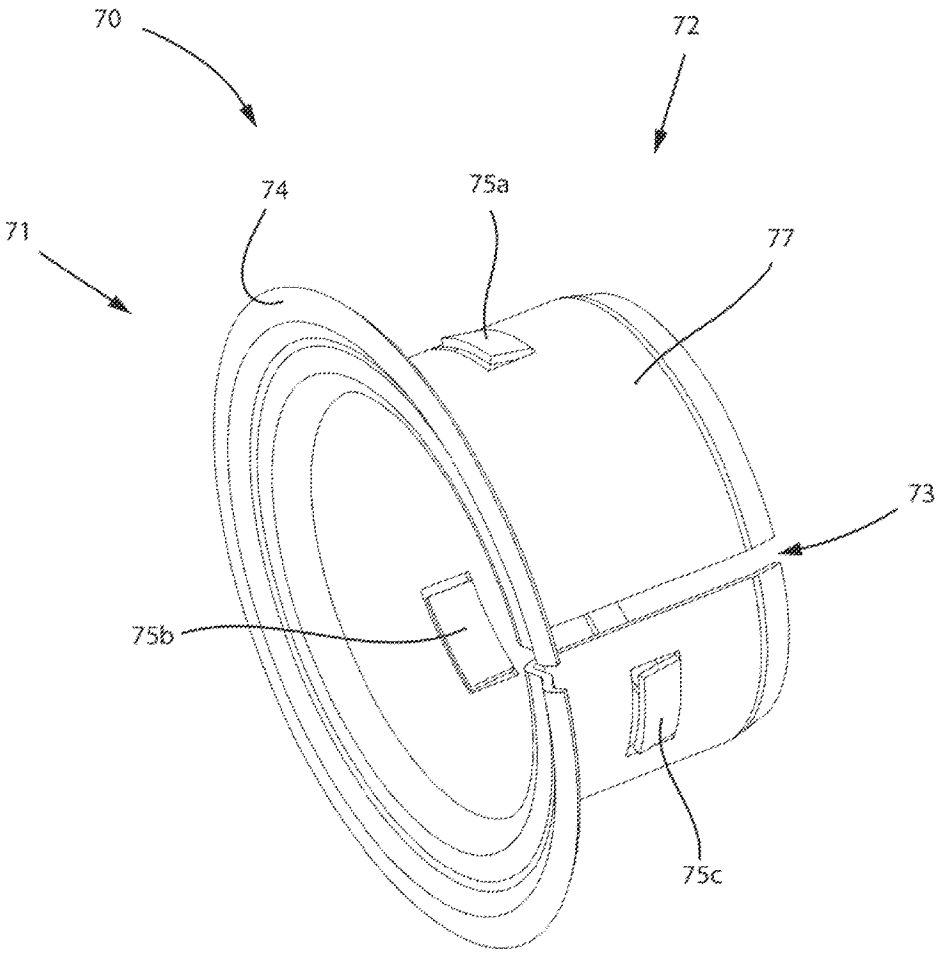
FIG. 3 depicts an isometric view of a variation of the embodiment of the electrical continuity member depicted in FIG. 1, without a flange cutout, in accordance with the present disclosure.
Figure 4:
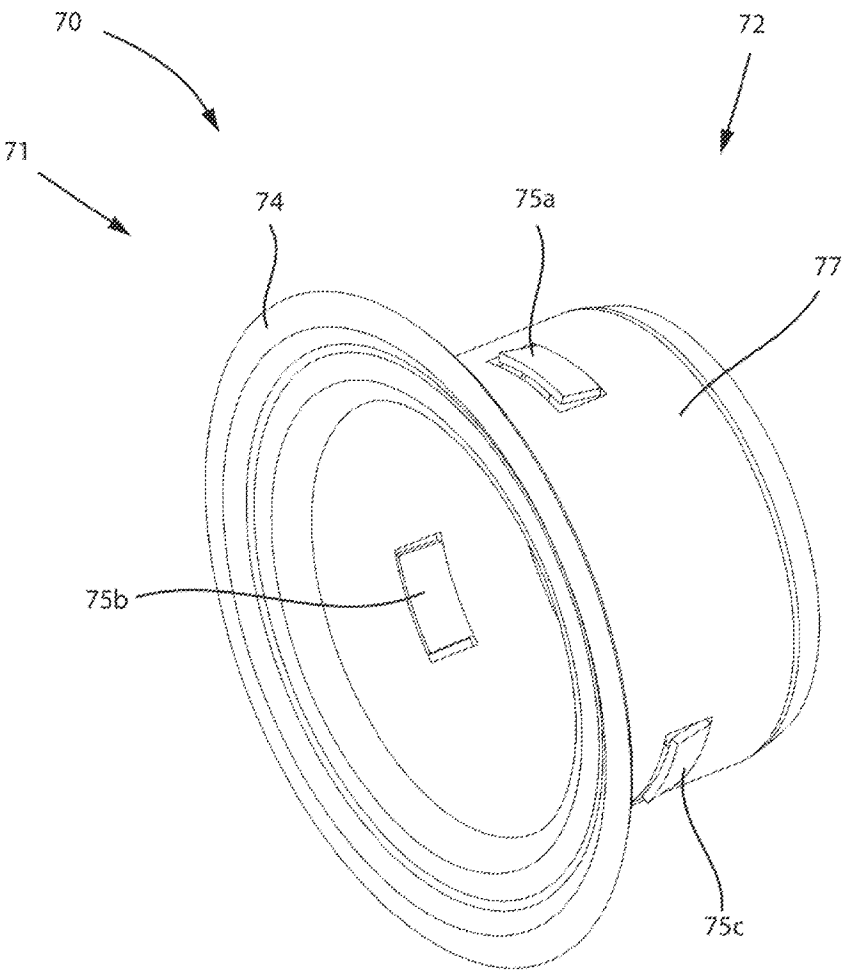
FIG. 4 depicts an isometric view of a variation of the embodiment of the electrical continuity member depicted in FIG. 1, without a flange cutout or a through-slit, in accordance with the present disclosure.

Turning now to FIGS. 2-4, variations of an embodiment of an electrical continuity member 70 are depicted. A continuity member 70 is conductive. The continuity member may have a first end 71 and an axially opposing second end 72. Embodiments of a continuity member 70 include a post contact portion 77. The post contact portion 77 makes physical and electrical contact with the post 40, when the coaxial cable connector 100 is operably assembled, and helps facilitate the extension of electrical ground continuity through the post 40. As depicted in FIGS. 2-4, the post contact portion 77 comprises a substantially cylindrical body that includes an inner dimension corresponding to an outer dimension of a portion of the post 40. A continuity member 70 may also include a securing member 75 or a plurality of securing members, such as the tabs 75*a-c*, which may help to physically secure the continuity member 70 in position with respect to the post 40 and/or the connector body 50. The securing member 75 may be resilient and, as such, may be capable of exerting spring-like force on operably adjoining coaxial cable connector 100 components, such as the post 40. Embodiments of a continuity member 70 include a nut contact portion 74. The nut contact portion 74 makes physical and electrical contact with the nut 30, when the coaxial cable connector 100 is operably assembled or otherwise put together in a manner that renders the connector 100 functional, and helps facilitate the extension of electrical ground continuity through the nut 30. The nut contact portion 74 may comprise a flange-like element that may be associated with various embodiments of a continuity member 70. In addition, as depicted in FIGS. 2-3, various embodiments of a continuity member 70 may include a through-slit 73. The through-slit 73 extends through the entire continuity member 70. Furthermore, as depicted in FIG. 2, various embodiments of a continuity member 70 may include a flange cutout 76 located on a flange-like nut contact portion 74 of the continuity member 70. A continuity member 70 is formed of conductive materials. Moreover, embodiments of a continuity member 70 may exhibit resiliency, which resiliency may be facilitated by the structural configuration of the continuity member 70 and the material make-up of the continuity member 70.

Embodiments of a continuity member 70 may be formed, shaped, fashioned, or otherwise manufactured via any operable process that will render a workable component, wherein the manufacturing processes utilized to make the continuity member may vary depending on the structural configuration of the continuity member. For example, a continuity member 70 having a through-slit 73 may be formed from a sheet of material that may be stamped and then bent into an operable shape, that allows the continuity member 70 to function as it was intended. The stamping may accommodate various operable features of the continuity member 70. For instance, the securing member 75, such as tabs 75*a-c*, may be cut during the stamping process. Moreover, the flange cutout 76 may also be rendered during a stamping process. Those in the art should appreciate that various other surface features may be provided on the continuity member 70 through stamping or by other manufacturing and shaping means. Accordingly, it is contemplated that features of the continuity member 70 may be provided to mechanically interlock or interleave, or otherwise operably physically engage complimentary and corresponding features of embodiments of a nut 30, complimentary and corresponding features of embodiments of a post 40, and/or complimentary and corresponding features of embodiments of a connector body 50. The flange cutout 76 may help facilitate bending that may be necessary to form a flange-like nut contact member 74. However, as is depicted in FIG. 3, embodiments of a continuity member 70 need not have a flange cutout 76. In addition, as depicted in FIG. 4, embodiments of a continuity member 70 need also not have a through-slit 73. Such embodiments may be formed via other manufacturing methods. Those in the art should appreciate that manufacture of embodiments of a continuity member 70 may include casting, extruding, cutting, knurling, turning, coining, tapping, drilling, bending, rolling, forming, component overmolding, combinations thereof, or other fabrication methods that may provide efficient production of the component.

Figure 5:
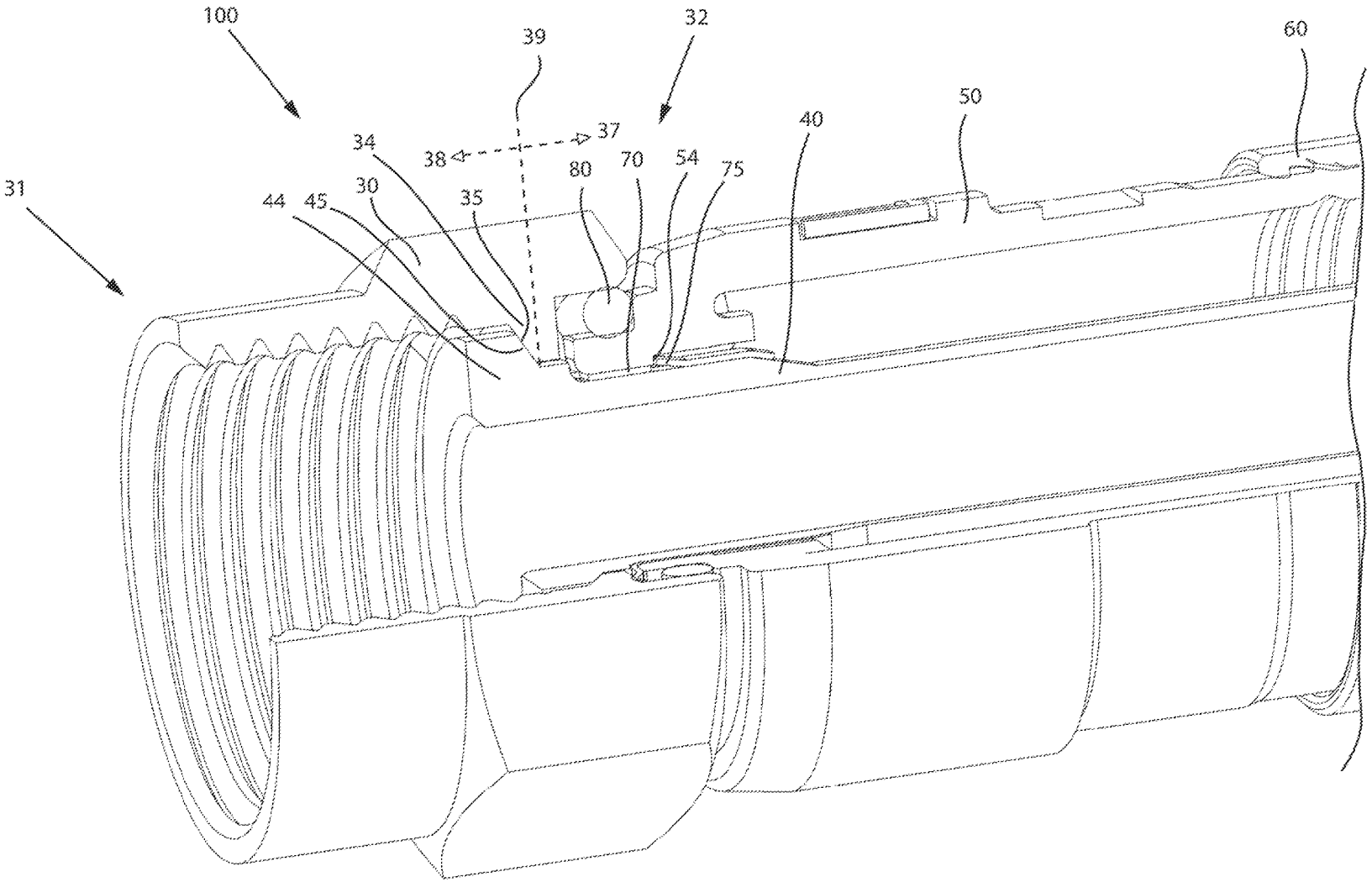
FIG. 5 depicts an isometric cut-away view of a portion of the embodiment of a coaxial cable connector having an electrical continuity member of FIG. 1, as assembled, in accordance with the present disclosure.
Figure 6:
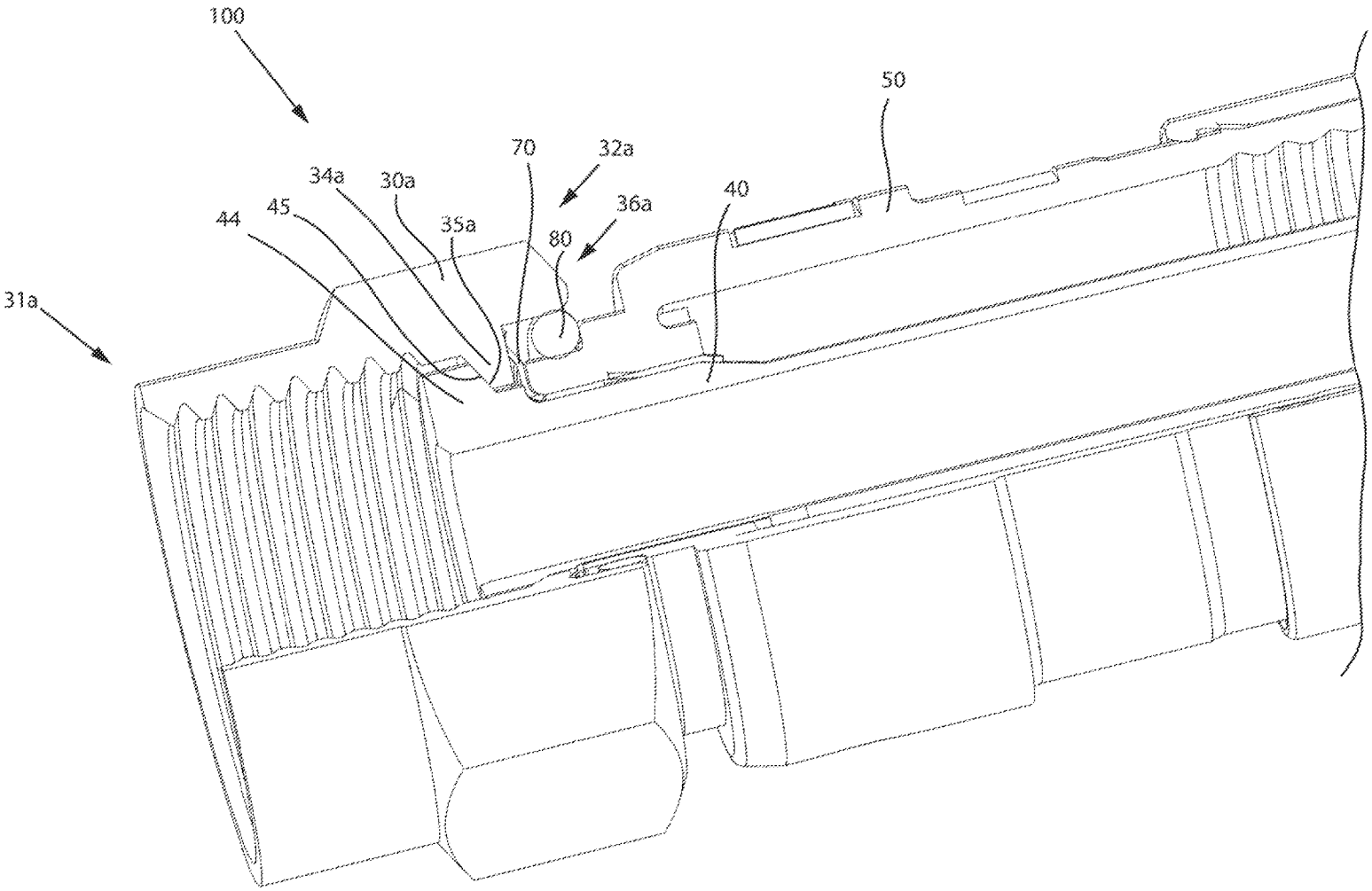
FIG. 6 depicts an isometric cut-away view of a portion of an assembled embodiment of a coaxial cable connector having an electrical continuity member and a shortened nut, in accordance with the present disclosure.
Figure 7:
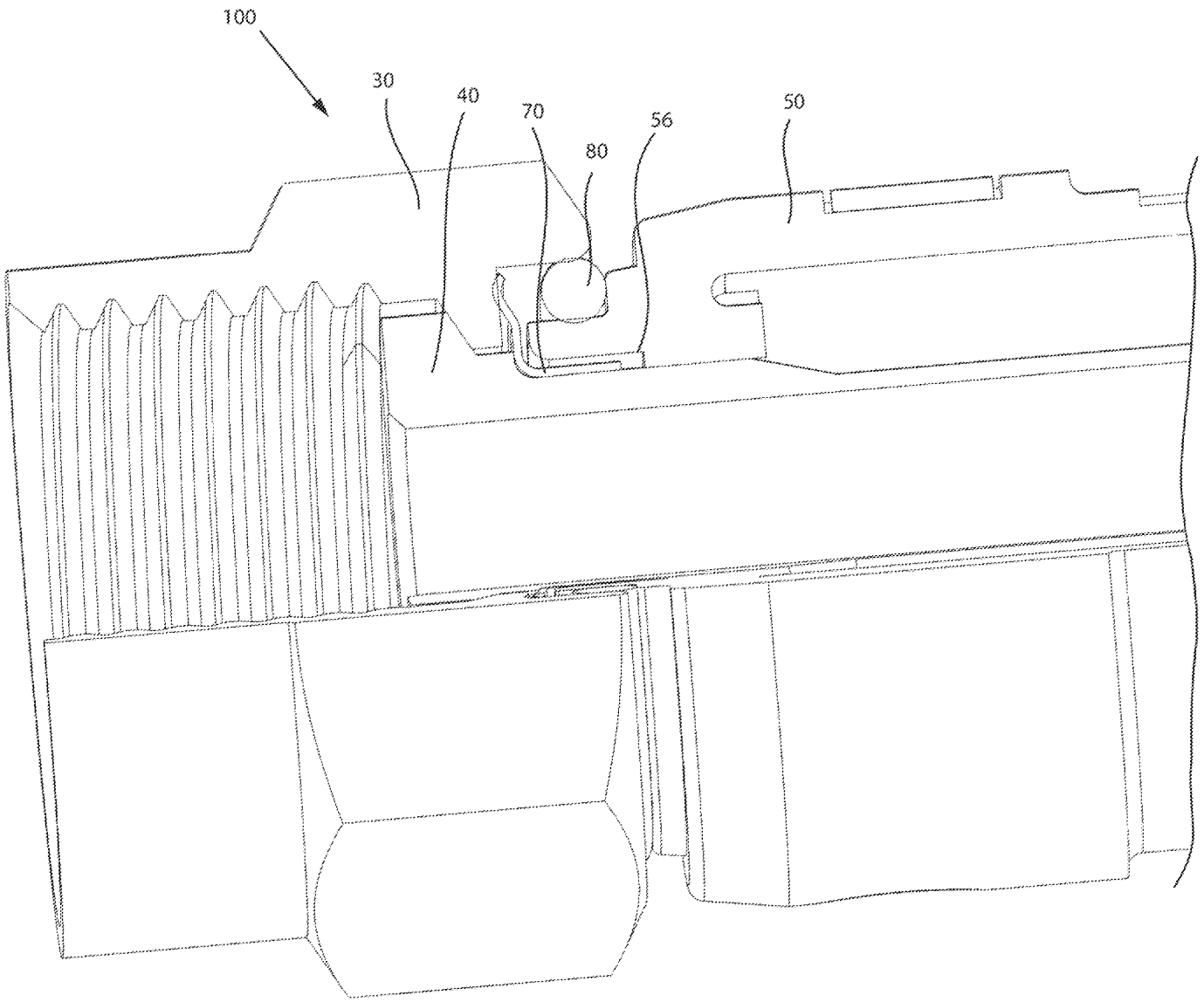
FIG. 7 depicts an isometric cut-away view of a portion of an assembled embodiment of a coaxial cable connector having an electrical continuity member that does not touch the connector body, in accordance with the present disclosure.
Figure 8:
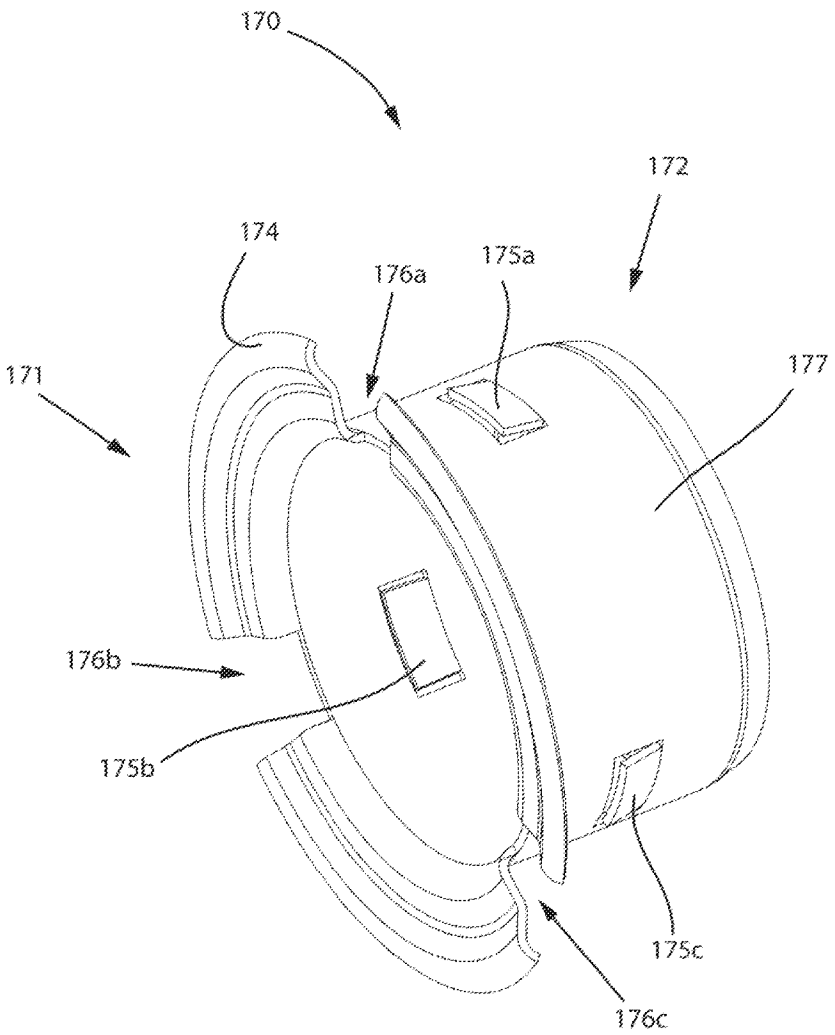
FIG. 8 depicts an isometric view of another embodiment of an electrical continuity member, in accordance with the present disclosure.
Figure 9:
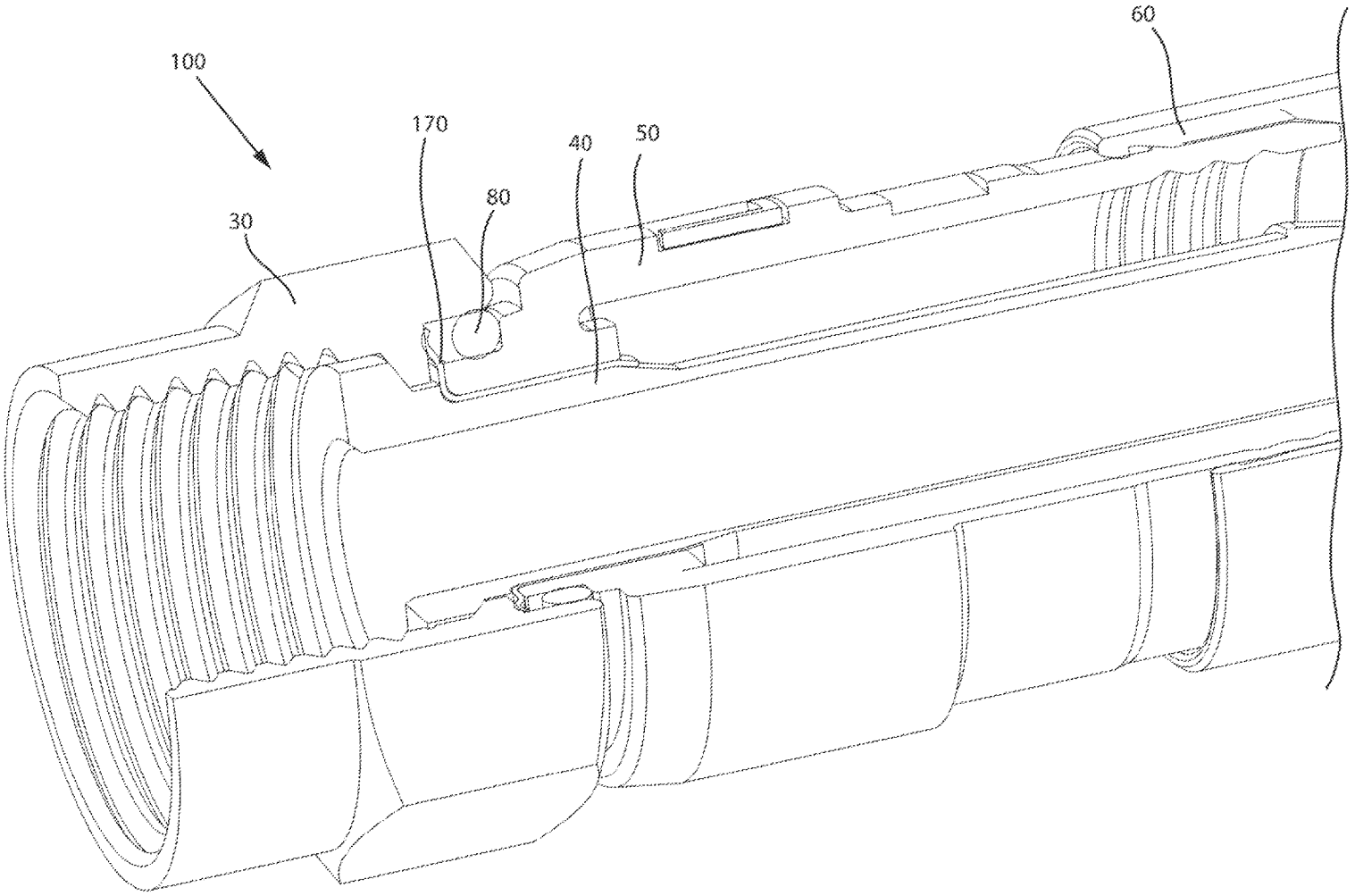
FIG. 9 depicts an isometric cut-away view of a portion of an assembled embodiment of a coaxial cable connector having the electrical continuity member of FIG. 8, in accordance with the present disclosure.
Figure 10:
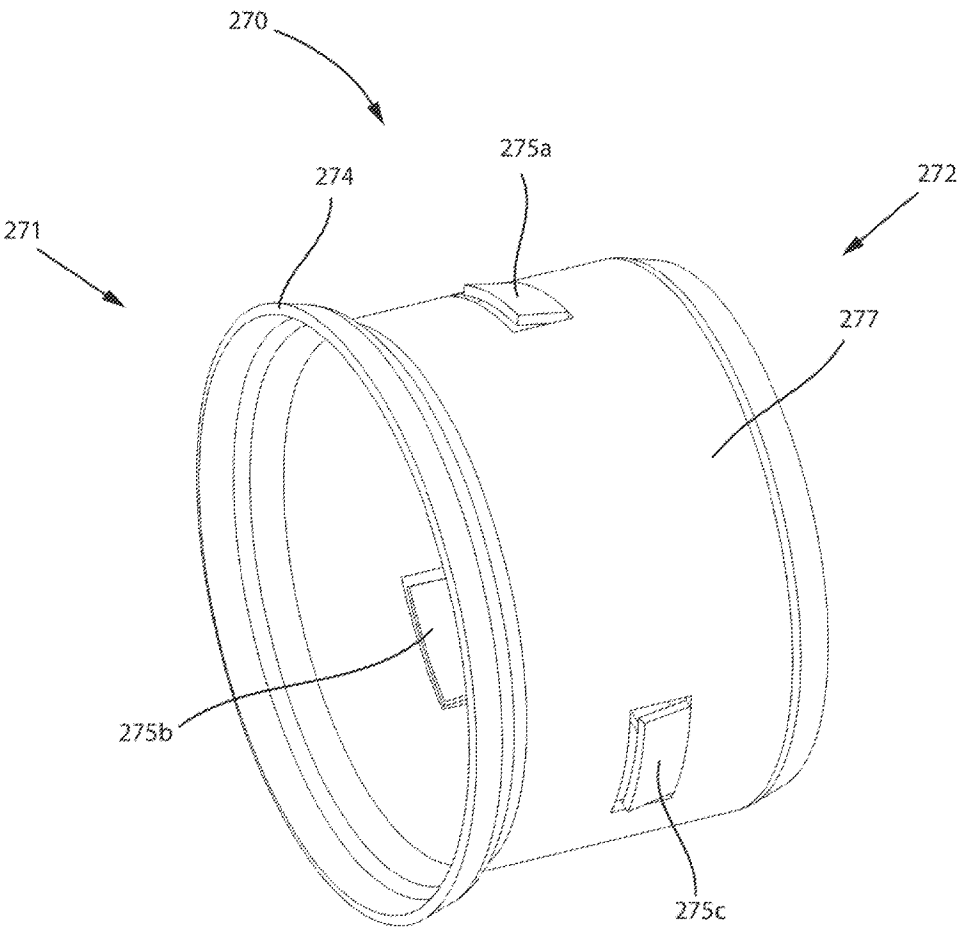
FIG. 10 depicts an isometric view of a further embodiment of an electrical continuity member, in accordance with the present disclosure.
Figure 11:
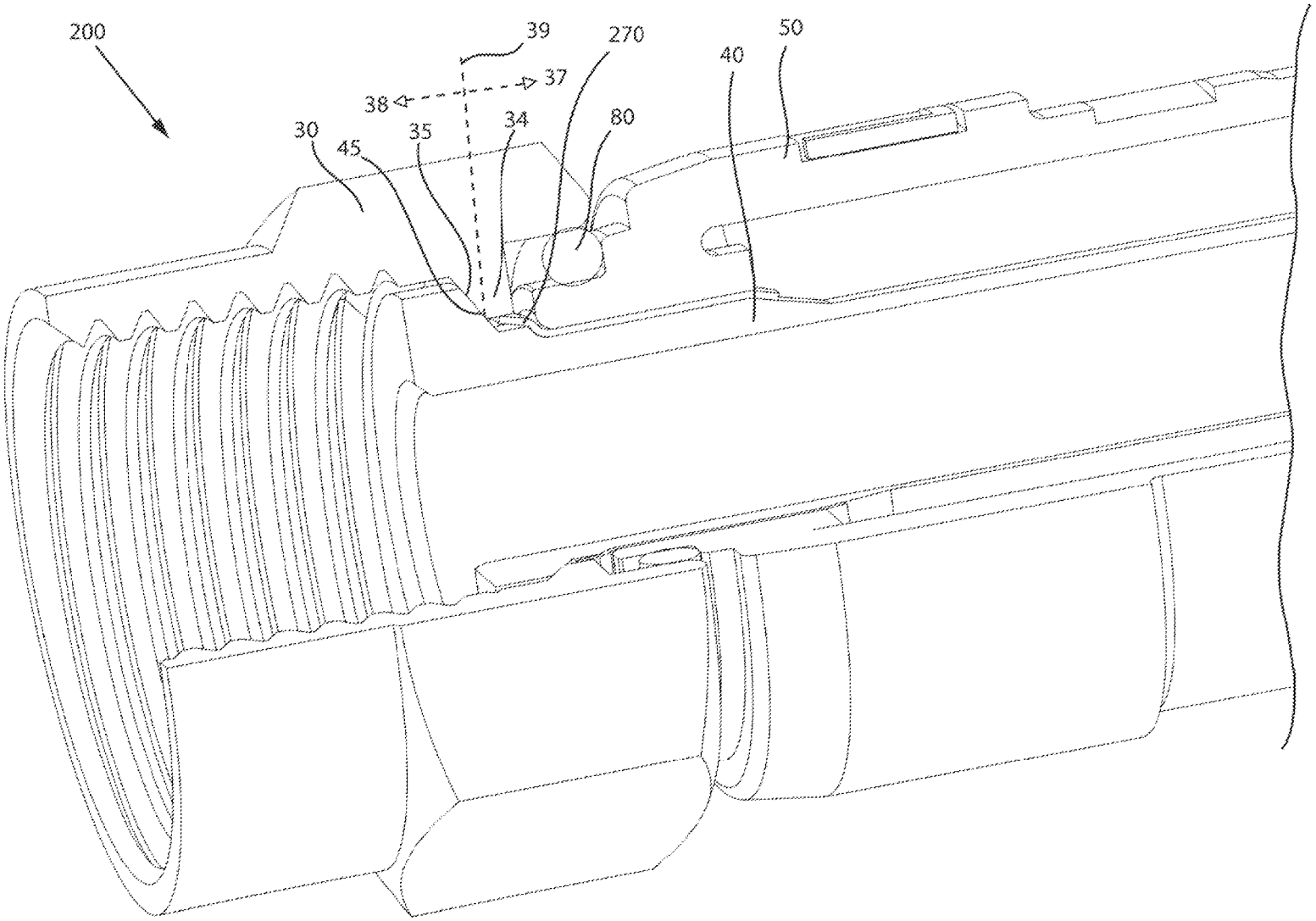
FIG. 11 depicts an isometric cut-away view of a portion of an assembled embodiment of a coaxial cable connector having the electrical continuity member of FIG. 10, in accordance with the present disclosure.
Figure 12:
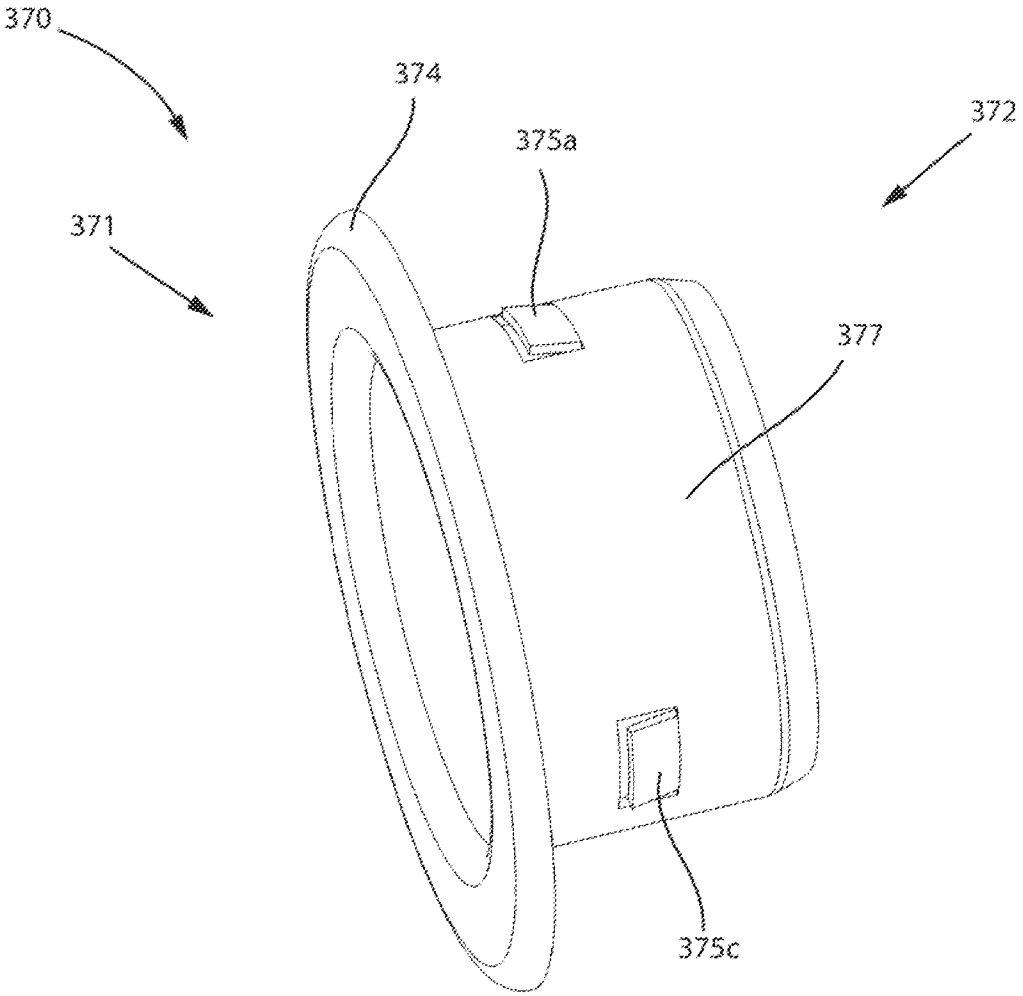
FIG. 12 depicts an isometric view of still another embodiment of an electrical continuity member, in accordance with the present disclosure.
Figure 13:
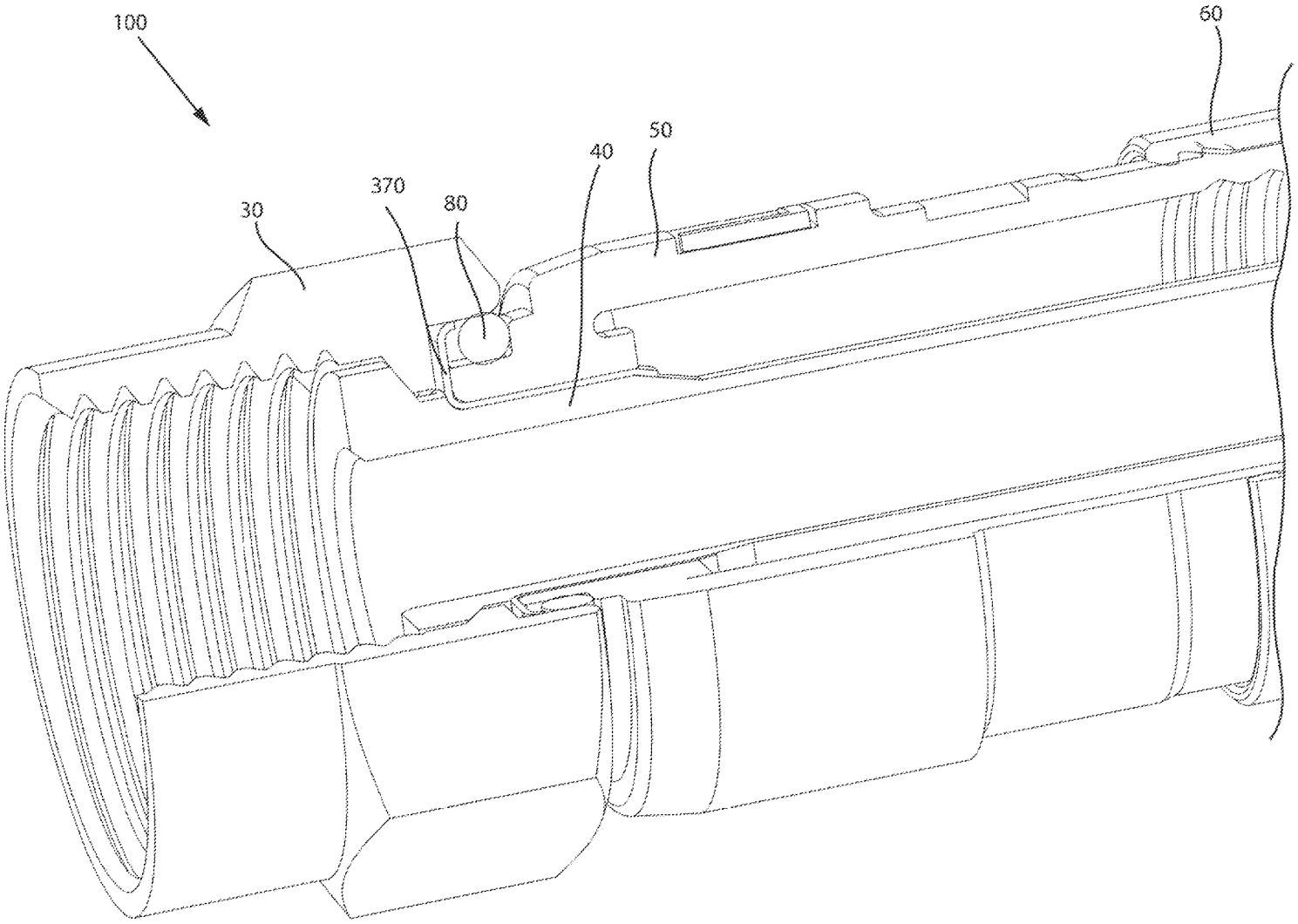
FIG. 13 depicts an isometric cut-away view of a portion of an assembled embodiment of a coaxial cable connector having the electrical continuity member of FIG. 12, in accordance with the present disclosure.
Figure 14:
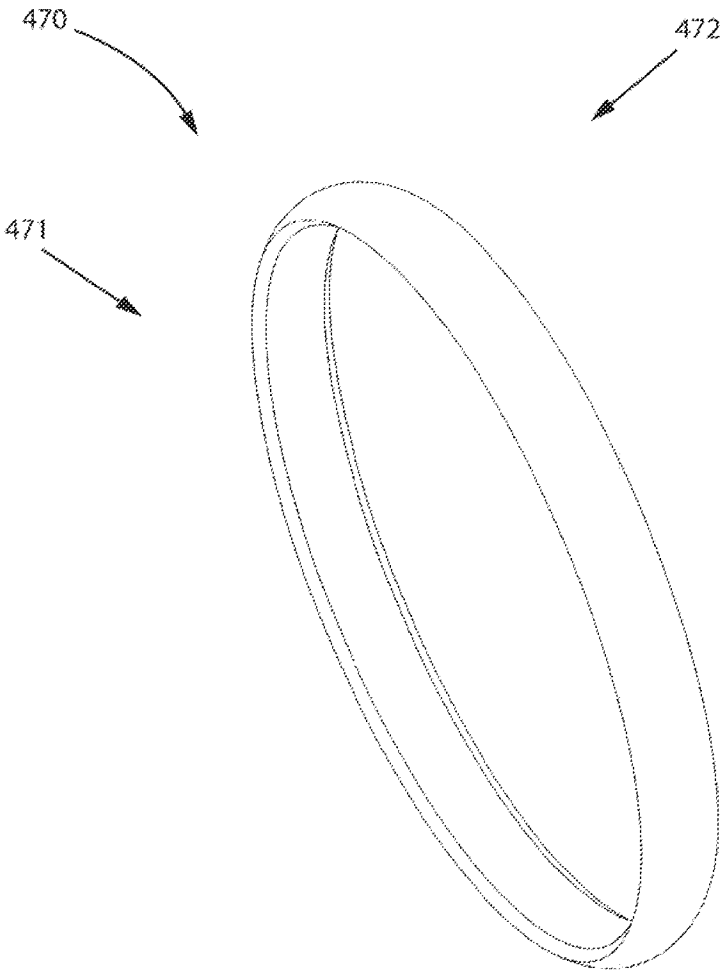
FIG. 14 depicts an isometric view of a still further embodiment of an electrical continuity member, in accordance with the present disclosure.
Figure 15:
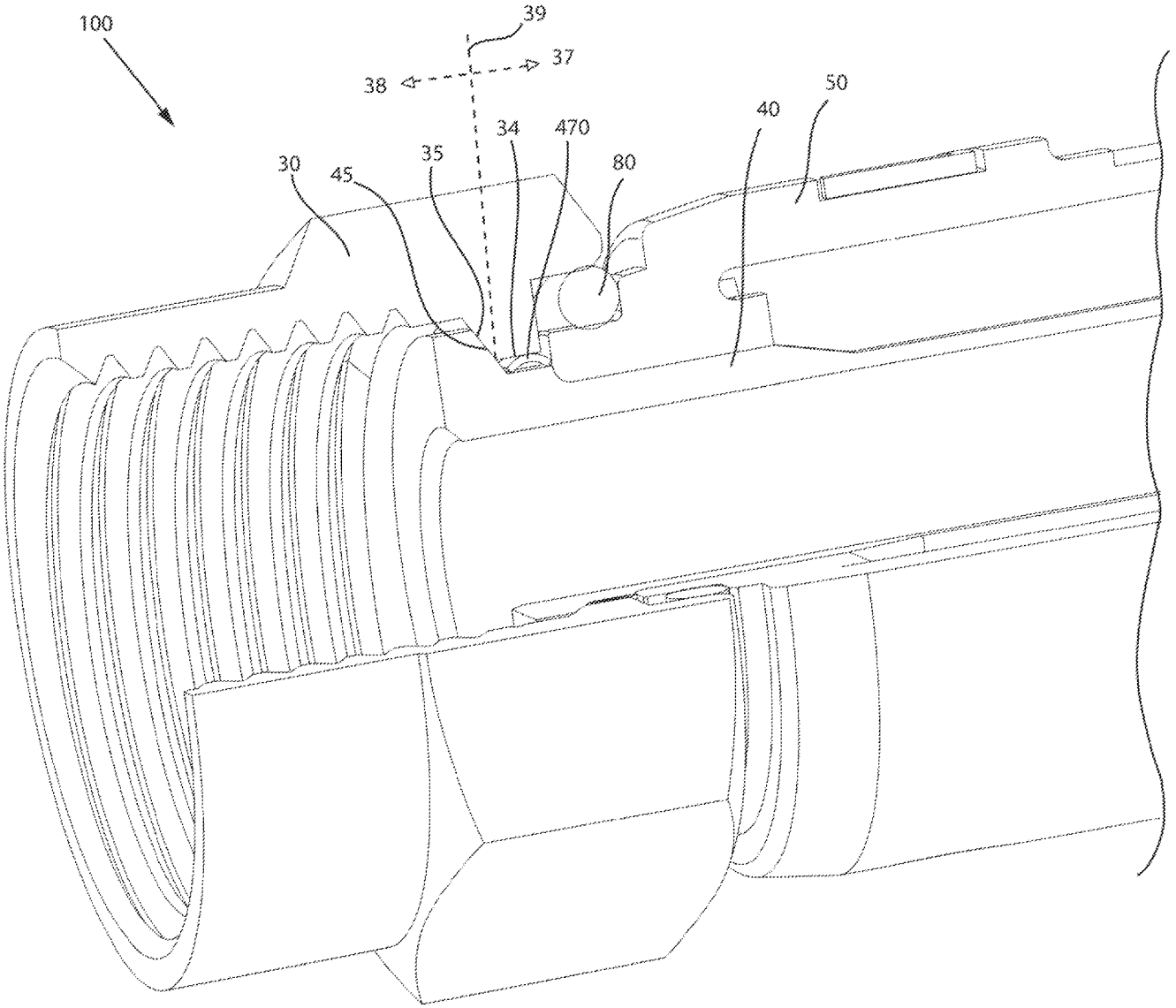
FIG. 15 depicts an isometric cut-away view of a portion of an assembled embodiment of a coaxial cable connector having the electrical continuity member of FIG. 14, in accordance with the present disclosure.
Figure 16:
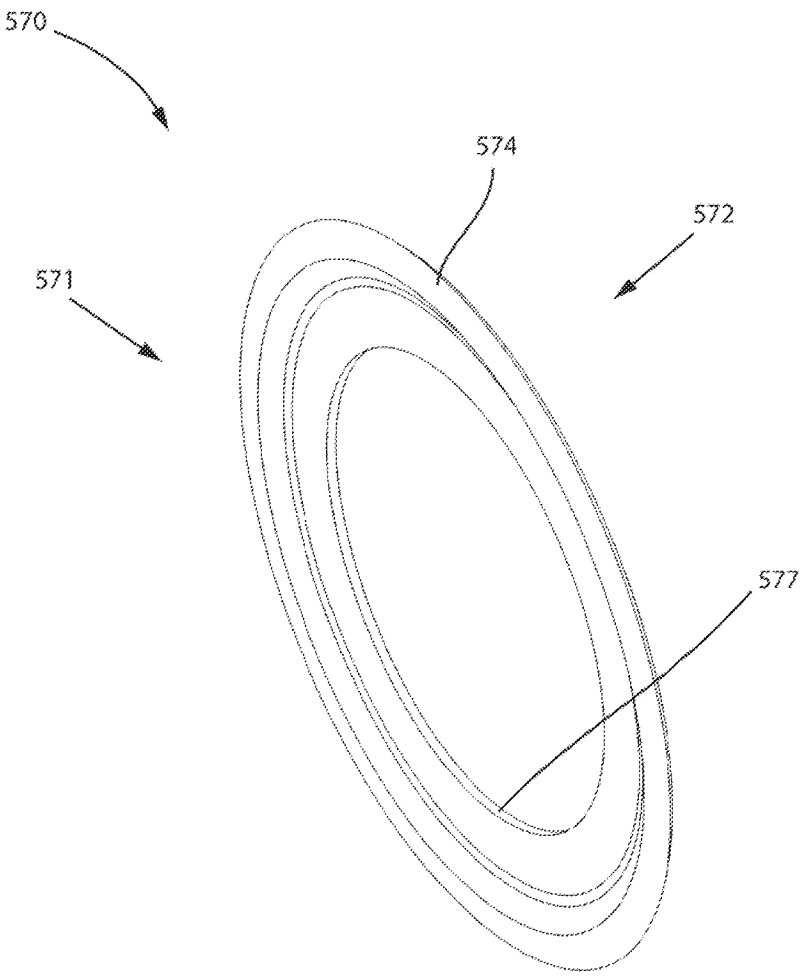
FIG. 16 depicts an isometric view of even another embodiment of an electrical continuity member, in accordance with the present disclosure.
Figure 17:
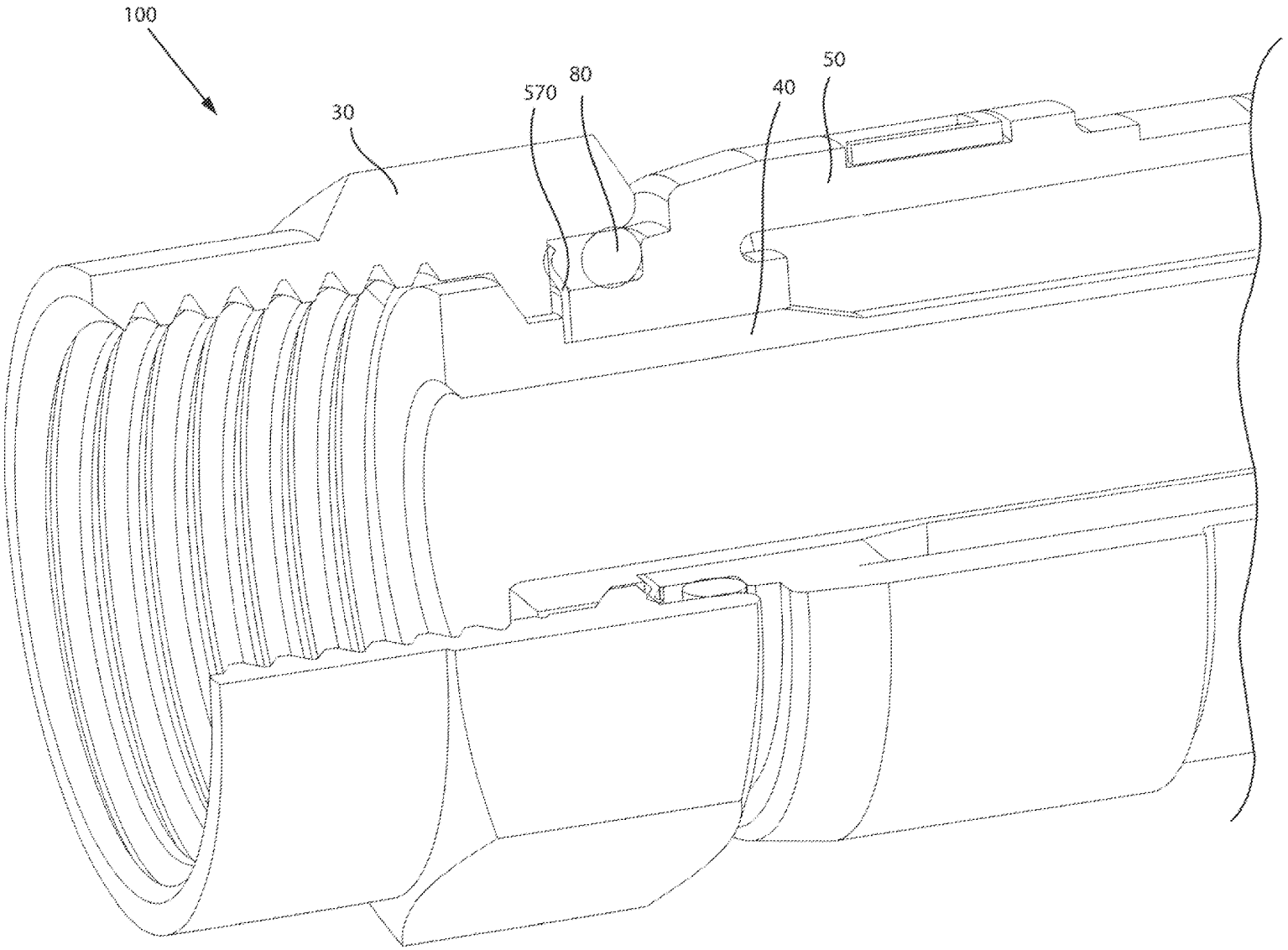
FIG. 17 depicts an isometric cut-away view of a portion of an assembled embodiment of a coaxial cable connector having the electrical continuity member of FIG. 16, in accordance with the present disclosure.
Figure 18:
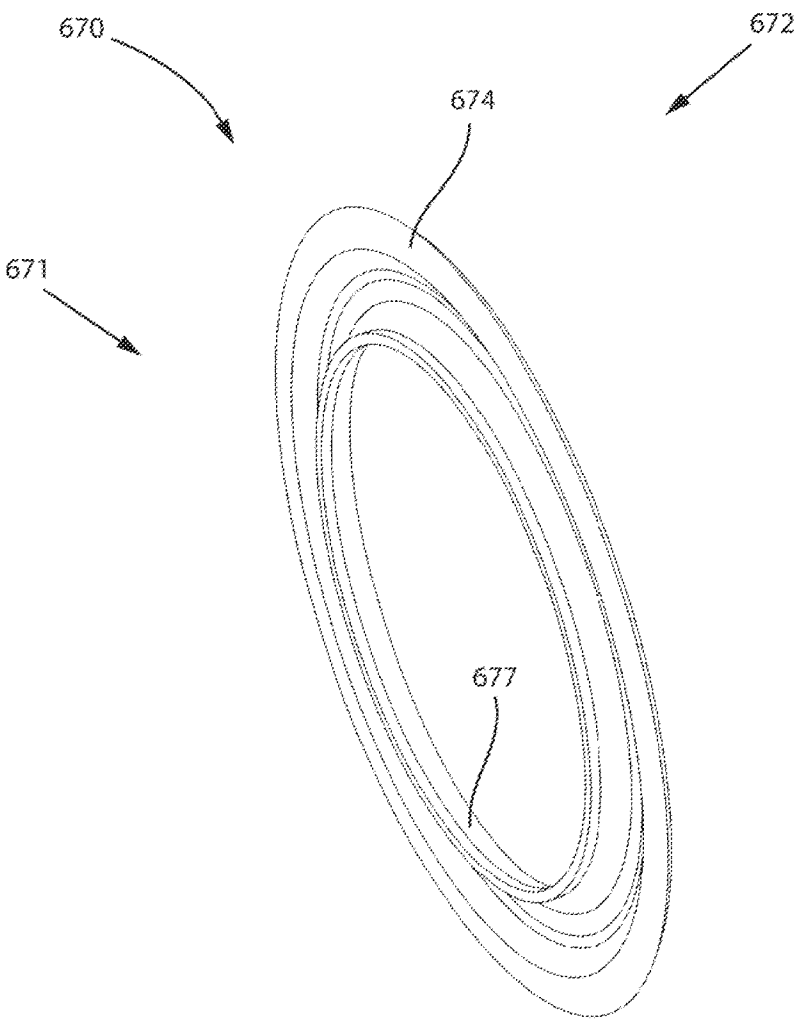
FIG. 18 depicts an isometric view of still even a further embodiment of an electrical continuity member, in accordance with the present disclosure.
Figure 19:
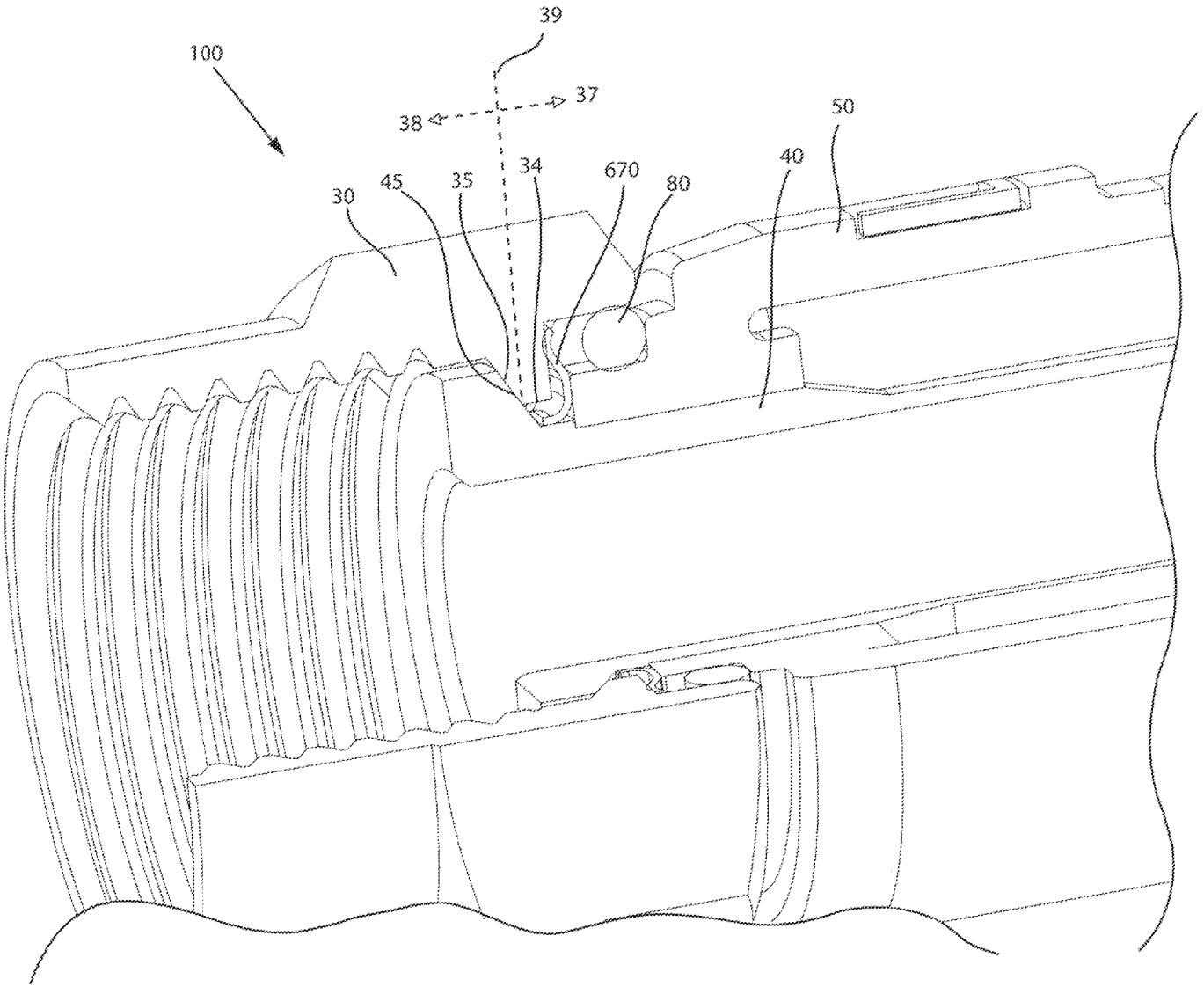
FIG. 19 depicts an isometric cut-away view of a portion of an assembled embodiment of a coaxial cable connector having the electrical continuity member of FIG. 18, in accordance with the present disclosure.

With continued reference to the drawings, FIGS. 5-7 depict perspective cut-away views of portions of embodiments of coaxial cable connectors 100 having an electrical continuity member 70, as assembled, in accordance with the present disclosure. In particular, FIG. 6 depicts a coaxial cable connector embodiment 100 having a shortened nut 30*a*, wherein the second rearward end 32*a* of the nut 30*a* does not extend as far as the second rearward end 32 of nut 30 depicted in FIG. 5. FIG. 7 depicts a coaxial cable connector embodiment 100 including an electrical continuity member 70 that does not touch the connector body 50, because the connector body 50 includes an internal detent 56 that, when assembled, ensures a physical gap between the continuity member 70 and the connector body 50. A continuity member 70 may be positioned around an external surface of the post 40 during assembly, while the post 40 is axially inserted into position with respect to the nut 30. The continuity member 70 should have an inner diameter sufficient to allow it to move up a substantial length of the post body 40 until it contacts a portion of the post 40 proximate the flange 44 at the first end 41 of the post 40.

The continuity member 70 should be configured and positioned so that, when the coaxial cable connector 100 is assembled, the continuity member 70 resides rearward a second end portion 37 of the nut 30, wherein the second end portion 37 starts at a side 35 of the lip 34 of the nut facing the first end 31 of the nut 30 and extends rearward to the second end 32 of the nut 30. The location or the continuity member 70 within a connector 100 relative to the second end portion 37 of the nut being disposed axially rearward of a surface 35 of the internal lip 34 of the nut 30 that faces the flange 44 of the post 40. The second end portion 37 of the nut 30 extends from the second rearward end 32 of the nut 30 to the axial location of the nut 30 that corresponds to the point of the forward facing side 35 of the internal lip 34 that faces the first forward end 31 of the nut 30 that is also nearest the second end 32 of the nut 30. Accordingly, the first end portion 38 of the nut 30 extends from the first end 31 of the nut 30 to that same point of the forward facing side 35 of the lip 34 that faces the first forward end 31 of the nut 30 that is nearest the second end 32 of the nut 30. For convenience, dashed line 39 shown in FIG. 5, depicts the axial point and a relative radial perpendicular plane defining the demarcation of the first end portion 38 and the second end portion 37 of embodiments of the nut 30. As such, the continuity member 70 does not reside between opposing complimentary surfaces 35 and 45 of the lip 34 of the nut 30 and the flange 44 of the post 40. Rather, the continuity member 70 contacts the nut 30 at a location rearward and other than on the side 35 of the lip 34 of the nut 30 that faces the flange 44 of the post 40, at a location only pertinent to and within the second end 37 portion of the nut 30.

With further reference to FIGS. 5-7, a body sealing member 80, such as an O-ring, may be located proximate the second end portion 37 of the nut 30 in front of the internal lip 34 of the nut 30, so that the sealing member 80 may compressibly rest or be squeezed between the nut 30 and the connector body 50. The body sealing member 80 may fit snugly over the portion of the body 50 corresponding to the annular recess 58 proximate the first end 51 of the body 50. However, those in the art should appreciate that other locations of the sealing member 80 corresponding to other structural configurations of the nut 30 and body 50 may be employed to operably provide a physical seal and barrier to ingress of environmental contaminants. For example, embodiments of a body sealing member 80 may be structured and operably assembled with a coaxial cable connector 100 to prevent contact between the nut 30 and the connector body 50.

When assembled, as in FIGS. 5-7, embodiments of a coaxial cable connector 100 may have axially secured components. For example, the body 50 may obtain a physical fit with respect to the continuity member 70 and portions of the post 40, thereby securing those components together both axially and rotationally. This fit may be engendered through press-fitting and/or friction-fitting forces, and/or the fit may be facilitated through structures which physically interfere with each other in axial and/or rotational configurations. Keyed features or interlocking structures on any of the post 40, the connector body 50, and/or the continuity member 70, may also help to retain the components with respect to each other. For instance, the connector body 50 may include an engagement feature 54, such as an internal ridge that may engage the securing member(s) 75, such as tabs 75*a-c*, to foster a configuration wherein the physical structures, once assembled, interfere with each other to prevent axial movement with respect to each other. Moreover, the same securing structure(s) 75, or other structures, may be employed to help facilitate prevention of rotational movement of the component parts with respect to each other. Additionally, the flange 44 of the post 40 and the internal lip 34 of the nut 30 work to restrict axial movement of those two components with respect to each other toward each other once the lip 34 has contacted the flange 44. However, the assembled configuration should not prevent rotational movement of the nut 30 with respect to the other coaxial cable connector 100 components. In addition, when assembled, the fastener member 60 may be secured to a portion of the body 50 so that the fastener member 60 may have some slidable axial freedom with respect to the body 50, thereby permitting operable attachment of a coaxial cable 10. Notably, when embodiments of a coaxial cable connector 100 are assembled, the continuity member 70 is disposed at the second end portion 37 of the nut 30, so that the continuity member 70 physically and electrically contacts both the nut 30 and the post 40, thereby extending ground continuity between the components.

With continued reference to the drawings, FIGS. 8-19 depict various continuity member embodiments 170-670 and show how those embodiments are secured within coaxial cable connector 100 embodiments, when assembled. As depicted, continuity members may vary in shape and functionality. However, all continuity members have at least a conductive portion and all reside rearward of the forward facing surface 35 of the internal lip 34 of the nut 30 and rearward the start of the second end portion 37 of the nut 30 of each coaxial cable connector embodiment 100 into which they are assembled. For example, a continuity member embodiment 170 may have multiple flange cutouts 176*a-c*. A continuity member embodiment 270 includes a nut contact portion 274 configured to reside radially between the nut 30 and the post 40 rearward the start of the second end portion 37 of the nut 30, so as to be rearward of the forward facing surface 35 of the internal lip 34 of the nut. A continuity member embodiment 370 is shaped in a manner kind of like a top hat, wherein the nut contact portion 374 contacts a portion of the nut 30 radially between the nut 30 and the connector body 50. A continuity member embodiment 470 resides primarily radially between the innermost part of the lip 34 of nut 30 and the post 40, within the second end portion 37 of the nut 30. In particular, the nut 30 of the coaxial cable connector 100 having continuity member 470 does not touch the connector body 50 of that same coaxial cable connector 100. A continuity member embodiment 570 includes a post contact portion 577, wherein only a radially inner edge of the continuity member 570, as assembled, contacts the post 40. A continuity member embodiment 670 includes a post contact portion that resides radially between the lip 34 of the nut 30 and the post 40, rearward the start of the second end portion 37 of the nut 30.

Figure 20:
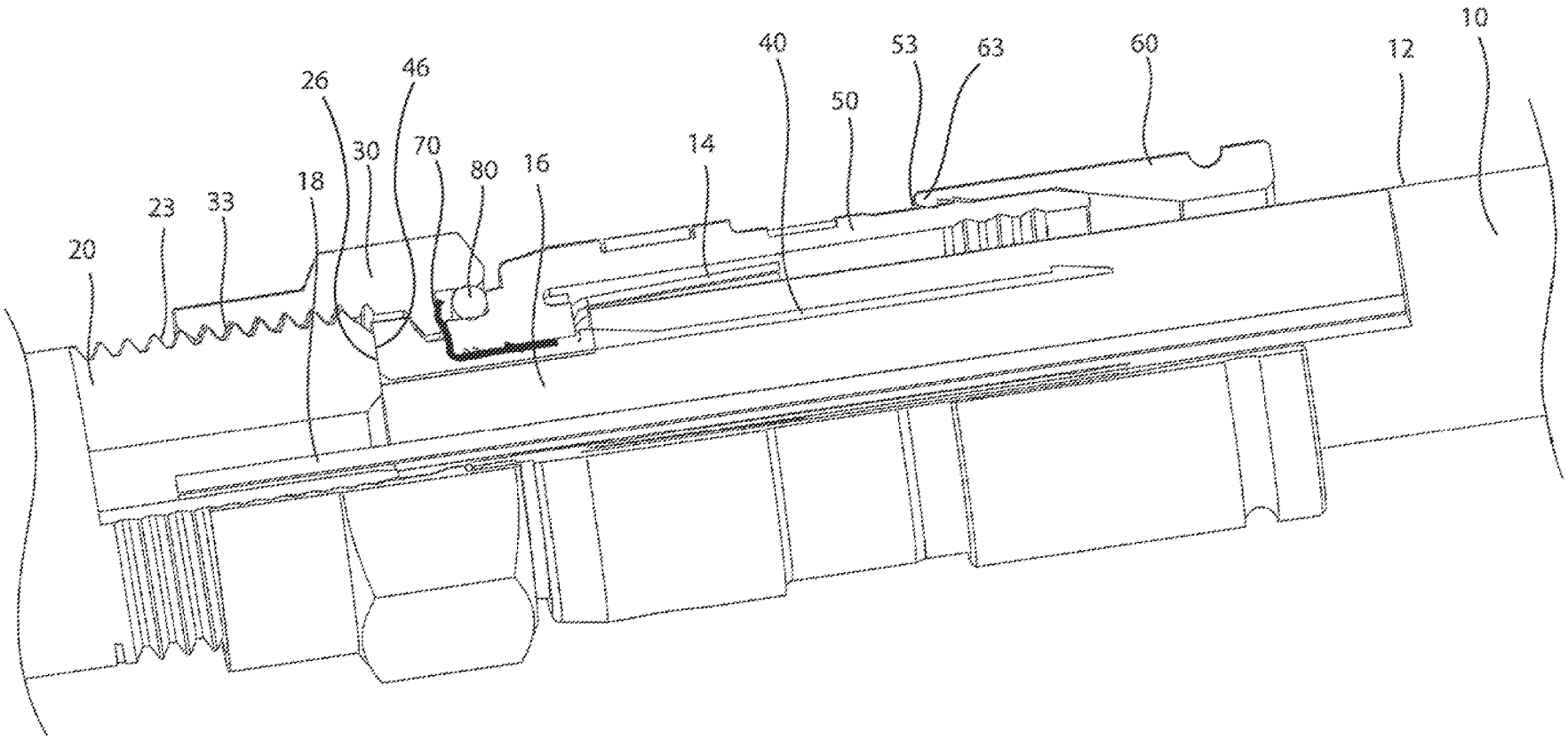
FIG. 20 depicts an isometric cut-away view of an embodiment of a coaxial cable connector including an electrical continuity member and having an attached coaxial cable, the connector mated to an interface port, in accordance with the present disclosure.

Turning now to FIG. 20, an embodiment of a coaxial cable connector 100 is depicted in a mated position on an interface port 20. As depicted, the coaxial cable connector 100 is fully tightened onto the interface port 20 so that the mating edge 26 of the interface port 20 contacts the mating edge 46 of the post 40 of the coaxial cable connector 100. Such a fully tightened configuration provides optimal grounding performance of the coaxial cable connector 100. However, even when the coaxial connector 100 is only partially installed on the interface port 20, the continuity member 70 maintains an electrical ground path between the mating port 20 and the outer conductive shield (ground 14) of cable 10. The ground path extends from the interface port 20 to the nut 30, to the continuity member 70, to the post 40, to the conductive grounding shield 14. Thus, this continuous grounding path provides operable functionality of the coaxial cable connector 100 allowing it to work as it was intended even when the connector 100 is not fully tightened.

Figure 21:
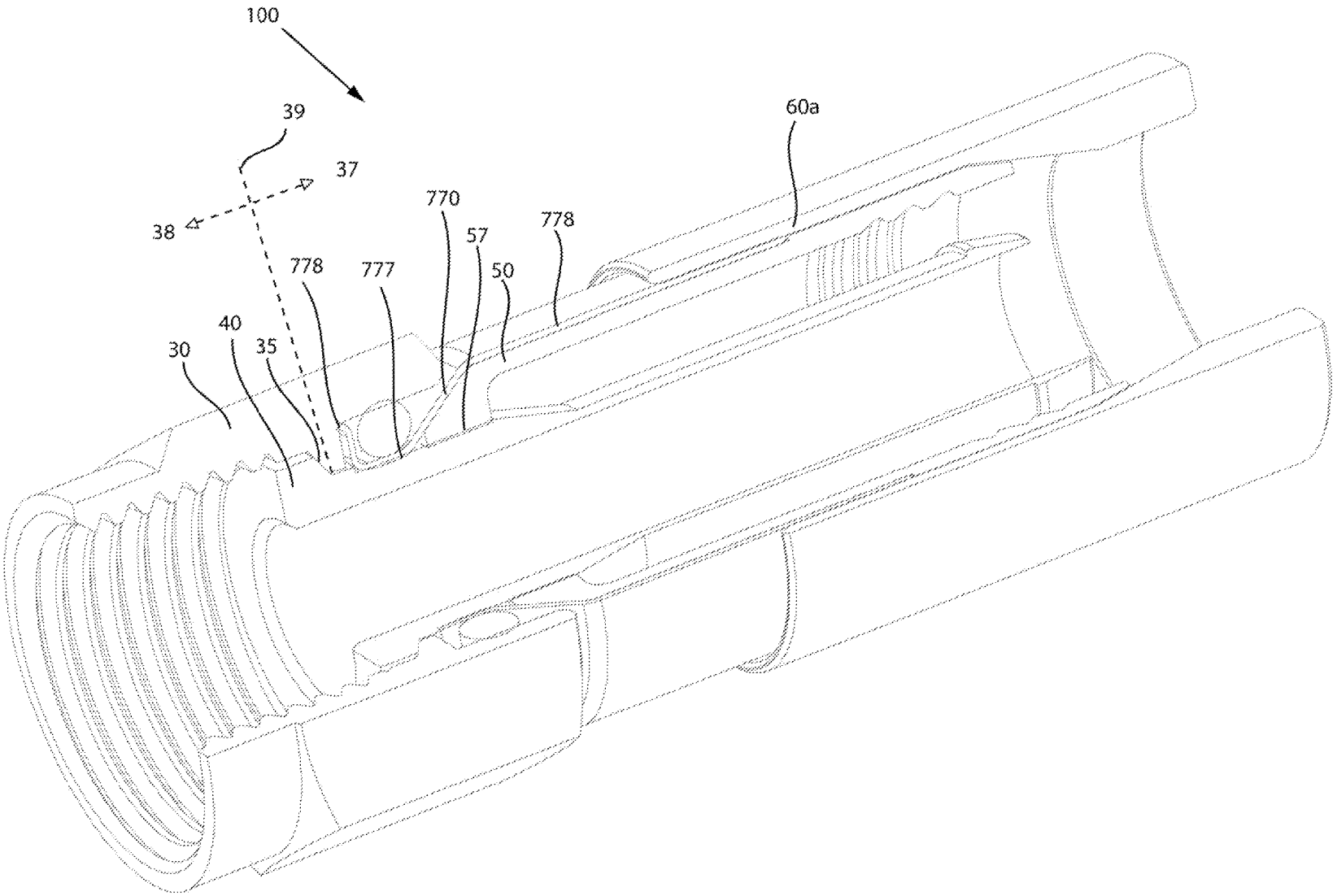
FIG. 21 depicts an isometric cut-away view of an embodiment of a coaxial cable connector having still even another embodiment of an electrical continuity member, in accordance with the present disclosure.
Figure 22:
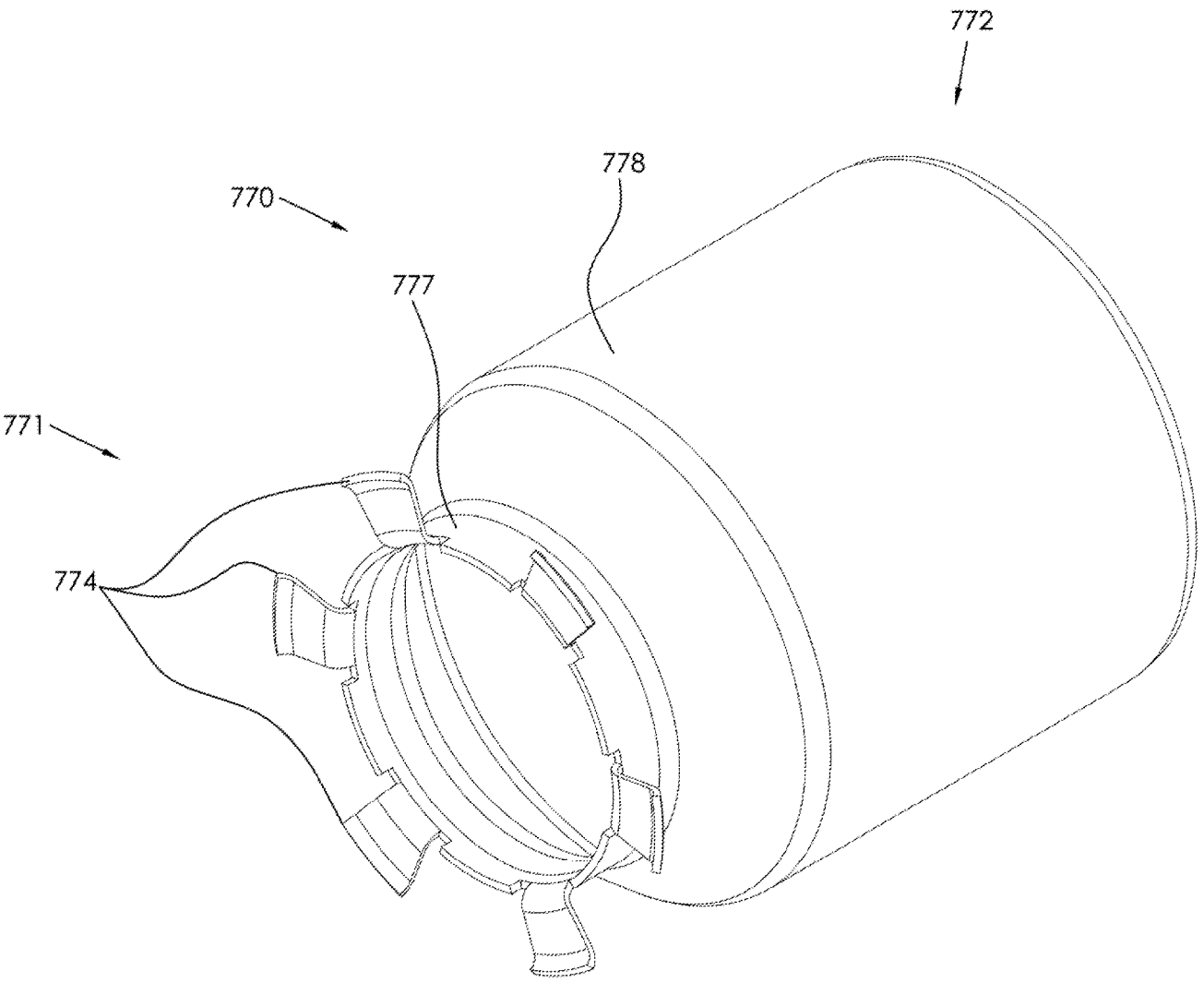
FIG. 22 depicts an isometric view of the embodiment of the electrical continuity member depicted in FIG. 21, in accordance with the present disclosure.
Figure 23:
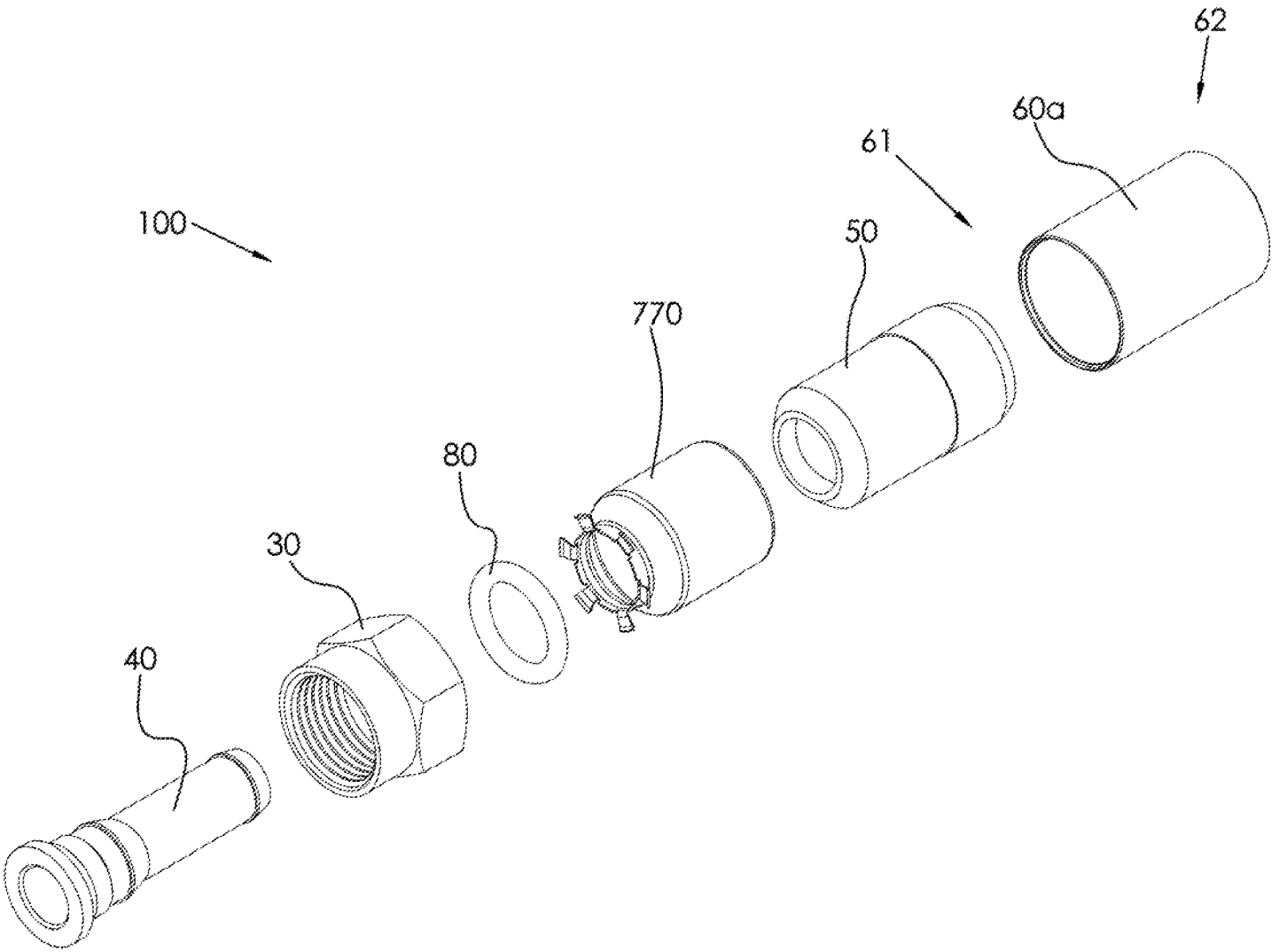
FIG. 23 an exploded perspective view of the embodiment of the coaxial cable connector of FIG. 21, in accordance with the present disclosure.

With continued reference to the drawings, FIG. 21-23 depict cut-away, exploded, perspective views of an embodiment of a coaxial cable connector 100 having still even another embodiment of an electrical continuity member 770, in accordance with the present disclosure. As depicted, the continuity member 770 does not reside in the first end portion 38 of the nut 30. Rather, portions of the continuity member 770 that contact the nut 30 and the post 40, such as the nut contacting portion(s) 774 and the post contacting portion 777, reside rearward the start (beginning at forward facing surface 35) of the second end portion 37 of the nut 30, like all other embodiments of continuity members. The continuity member 770, includes a larger diameter portion 778 that receives a portion of a connector body 50, when the coaxial cable connector 100 is assembled. In essence, the continuity member 770 has a sleeve-like configuration and may be press-fit onto the received portion of the connector body 50. When the coaxial cable connector 100 is assembled, the continuity member 770 resides between the nut 30 and the connector body 50, so that there is no contact between the nut 30 and the connector body 50. The fastener member 60*a* may include an axially extended first end 61. The first end 61 of the fastener member 60 may extend an axial distance so that, when the fastener member 60*a* is compressed into sealing position on the coaxial cable 100 (not shown, but readily comprehensible by those of ordinary skill in the art), the fastener member 60*a* touches or otherwise resides substantially proximate or very near the nut 30. This touching, or otherwise close contact between the nut 30 and the fastener member 60 coupled with the in-between or sandwiched location of the continuity member 770 may facilitate enhanced prevention of RF ingress and/or ingress of other environmental contaminants into the coaxial cable connector 100 at or near the second end 32 of the nut 30. As depicted, the continuity member 770 and the associated connector body 50 may be press-fit onto the post 40, so that the post contact portion 777 of the continuity member 770 and the post mounting portion 57 of the connector body 50 are axially and rotationally secured to the post 40. The nut contacting portion(s) 774 of the continuity member 770 are depicted as resilient members, such as flexible fingers, that extend to resiliently engage the nut 30. This resiliency of the nut contact portions 774 may facilitate enhanced contact with the nut 30 when the nut 30 moves during operation of the coaxial cable connector 100, because the nut contact portions 774 may flex and retain constant physical and electrical contact with the nut 30, thereby ensuring continuity of a grounding path extending through the nut 30.

Figure 24:
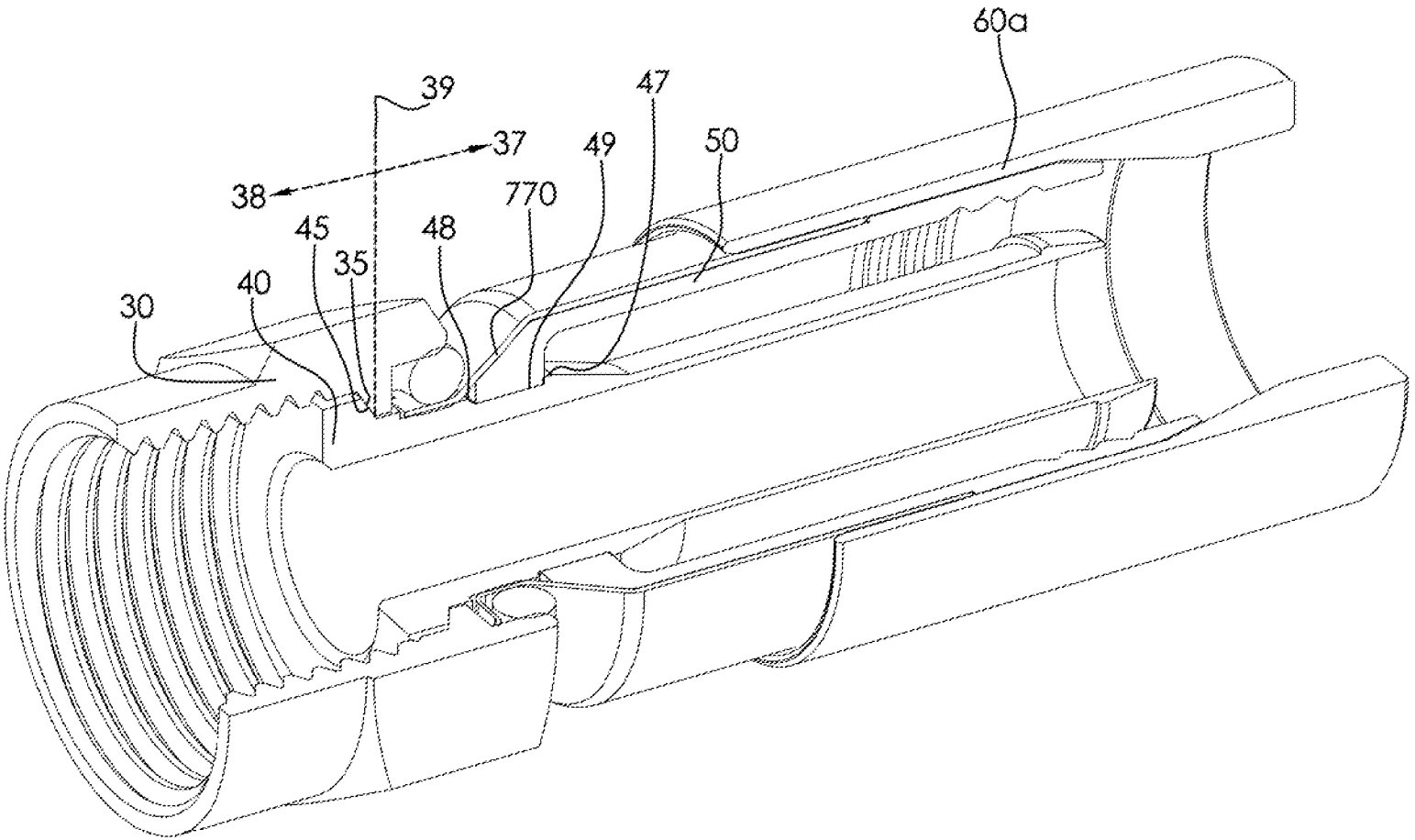
FIG. 24 depicts an isometric cut-away view of another embodiment of a coaxial cable connector having the embodiment of the electrical continuity member depicted in FIG. 22, in accordance with the present disclosure.
Figure 25:
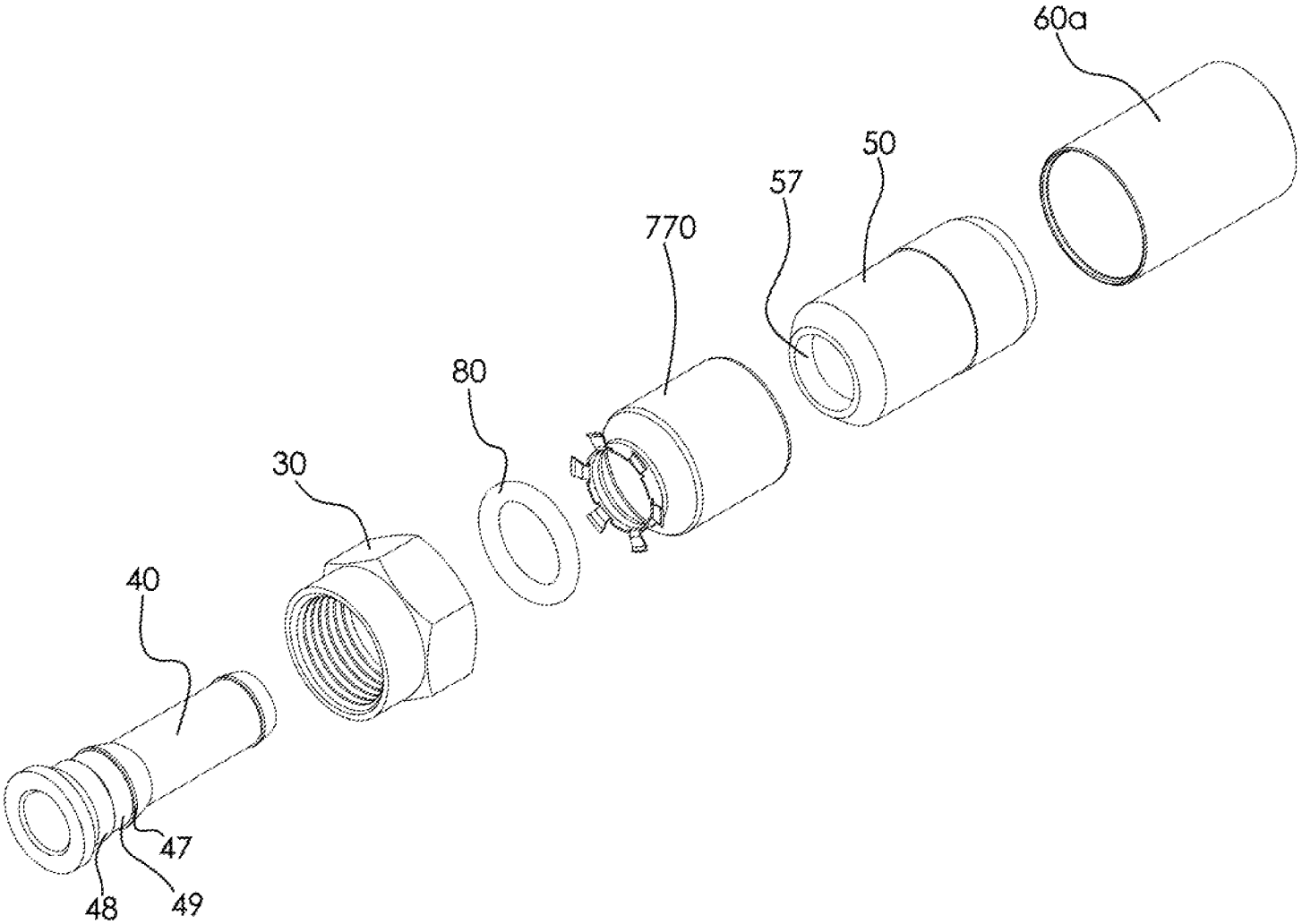
FIG. 25 depicts an exploded perspective view of the embodiment of the coaxial cable connector of FIG. 24, in accordance with the present disclosure.

Referring still further to the drawings, FIGS. 24-25 depict perspective views of another embodiment of a coaxial cable connector 100 having a continuity member 770. As depicted, the post 40 may include a surface feature 47, such as a lip extending from a connector body engagement portion 49 having a diameter that is smaller than a diameter of a continuity member engagement portion 48. The surface feature lip 47, along with the variably-diametered continuity member and connector body engagement portions 48 and 49, may facilitate efficient assembly of the connector 100 by permitting various component portions having various structural configurations and material properties to move into secure location, both radially and axially, with respect to one another.

Figure 26:
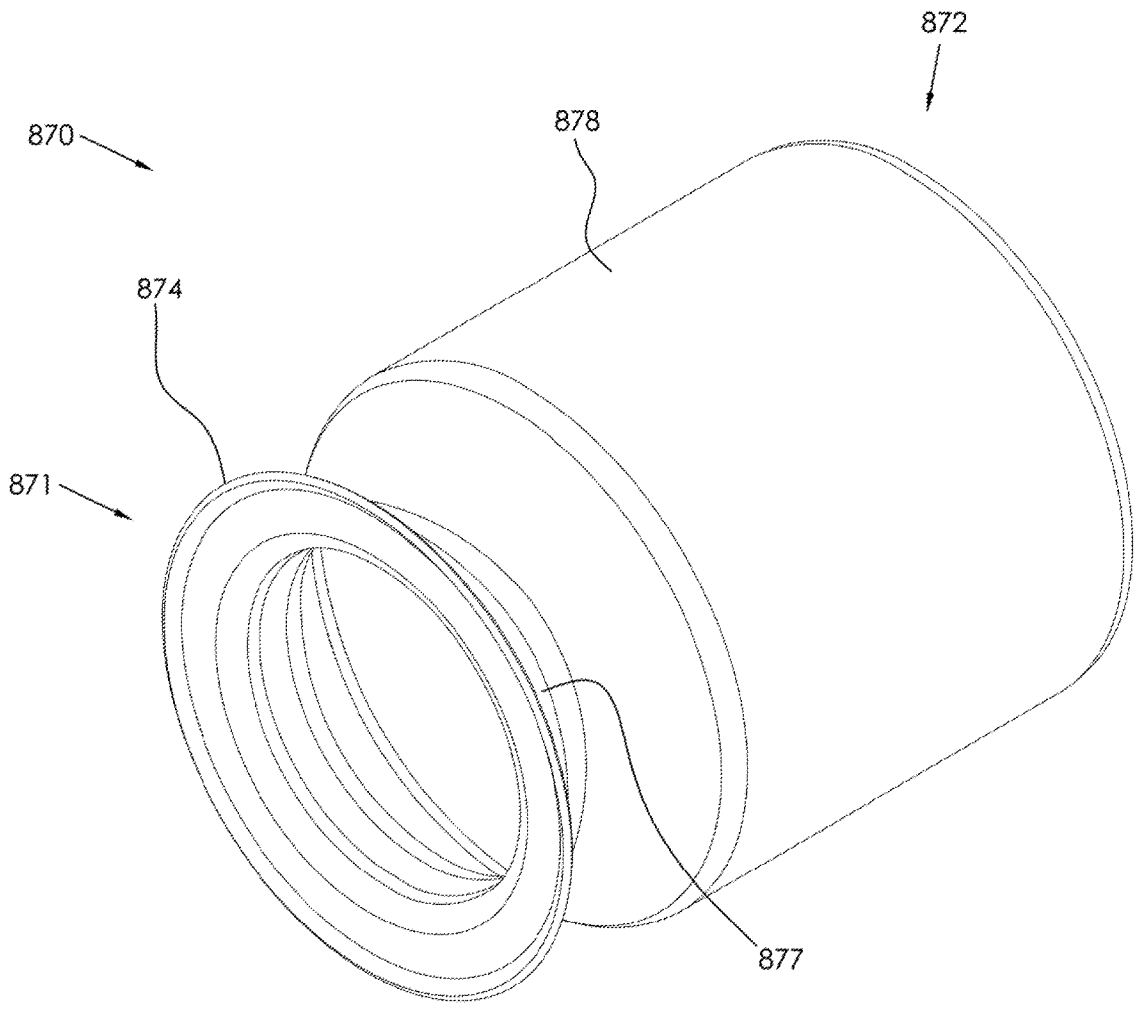
FIG. 26 depicts an isometric view of still further even another embodiment of an electrical continuity member, in accordance with the present disclosure.
Figure 27:
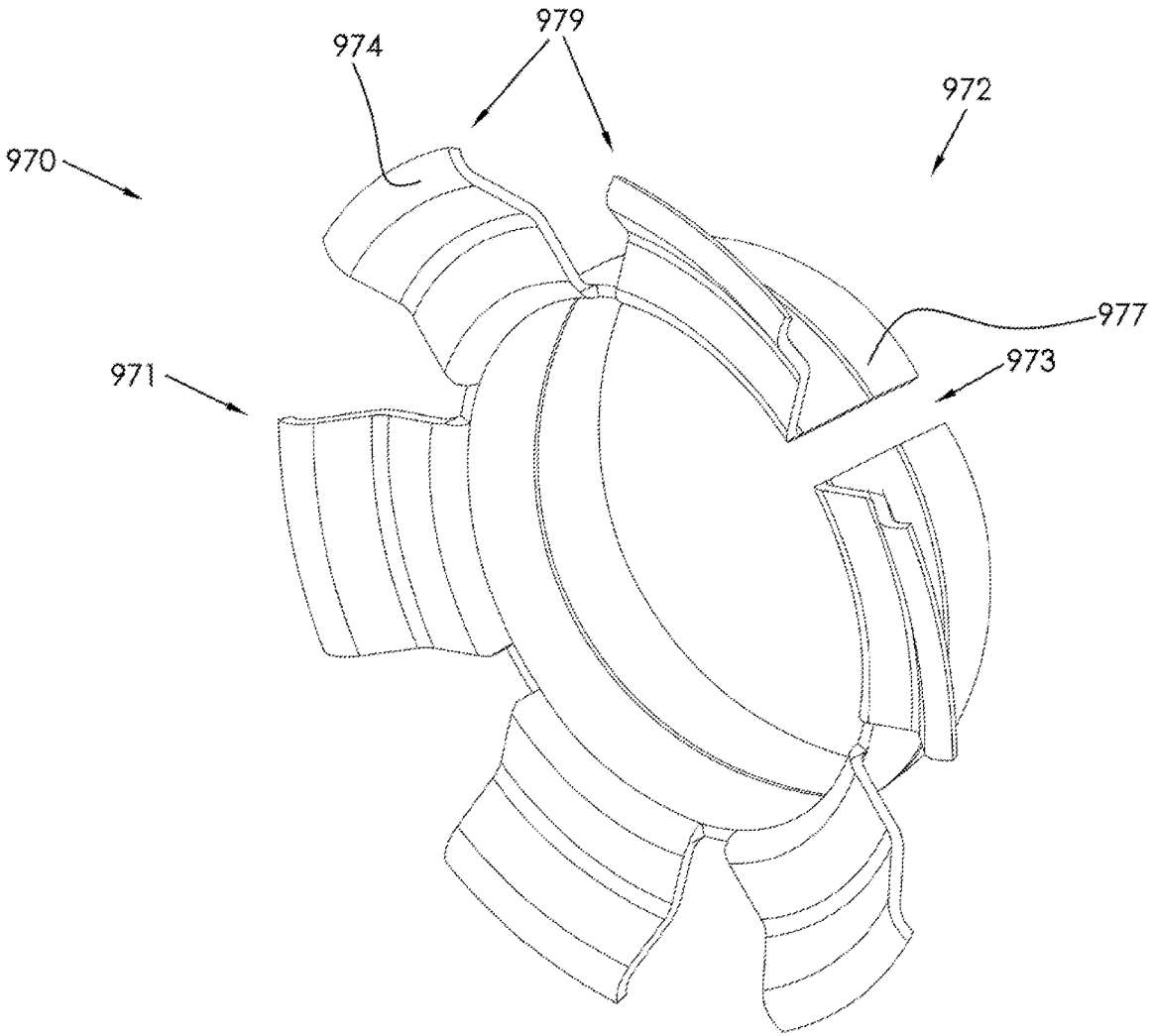
FIG. 27 depicts an isometric view of another embodiment of an electrical continuity member, in accordance with the present disclosure.
Figure 28:
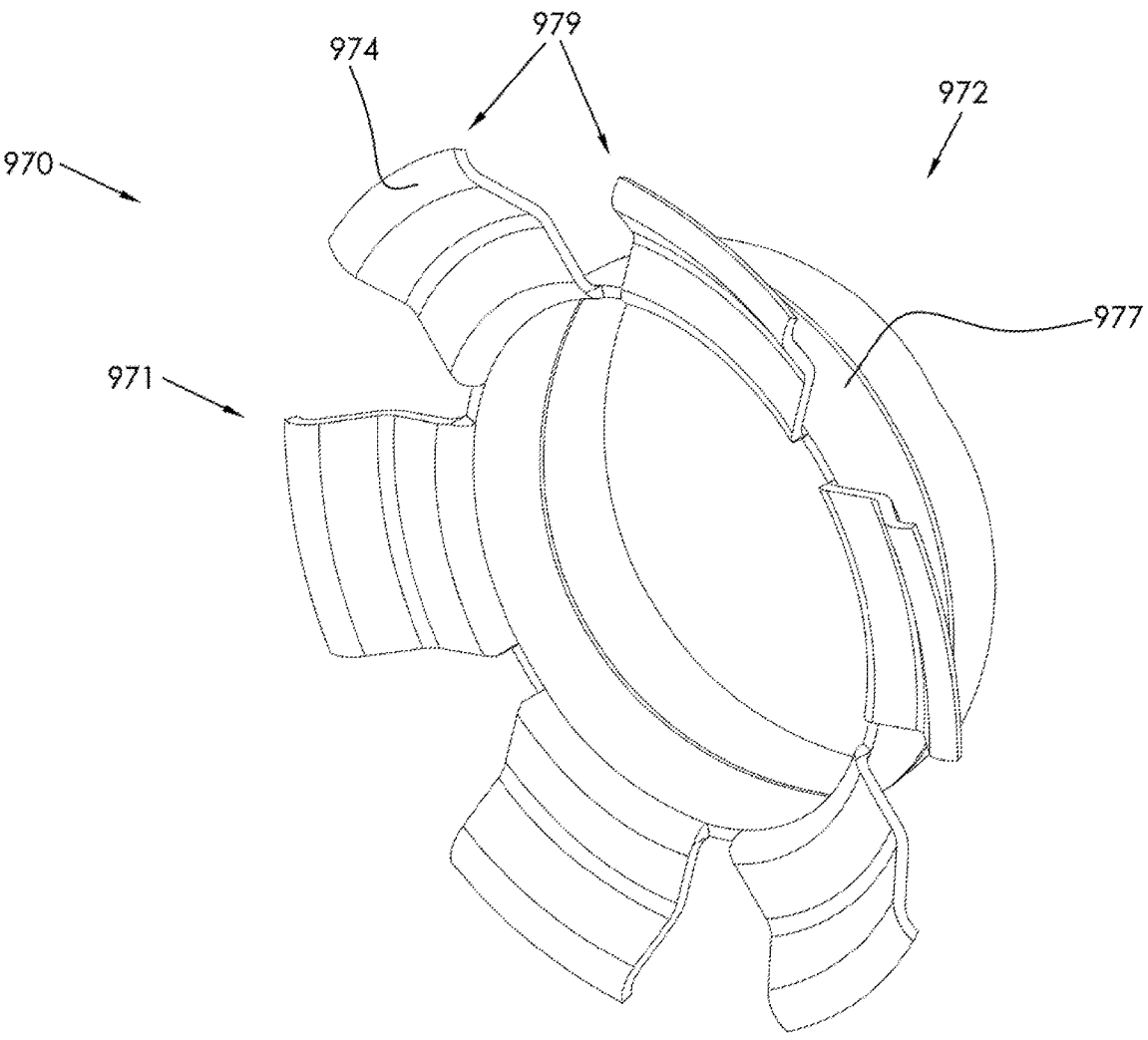
FIG. 28 depicts an isometric view of an embodiment of an electrical continuity depicted in FIG. 27, yet comprising a completely annular post contact portion with no through-slit, in accordance with the present disclosure.
Figure 29:
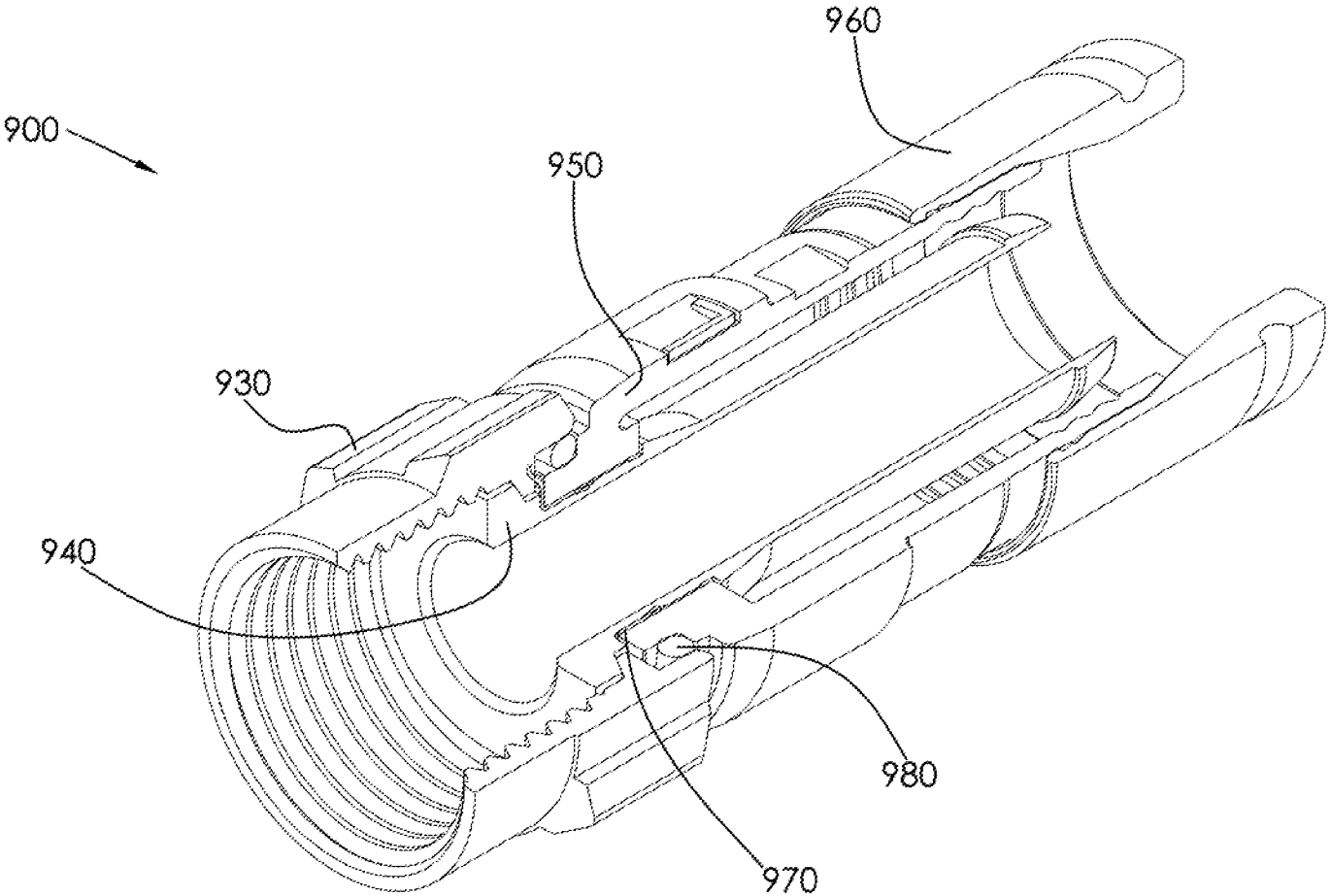
FIG. 29 depicts an isometric cut-away view of another embodiment of a coaxial cable connector operably having either of the embodiments of the electrical continuity member depicted in FIG. 27 or 28, in accordance with the present disclosure.
Figure 30:
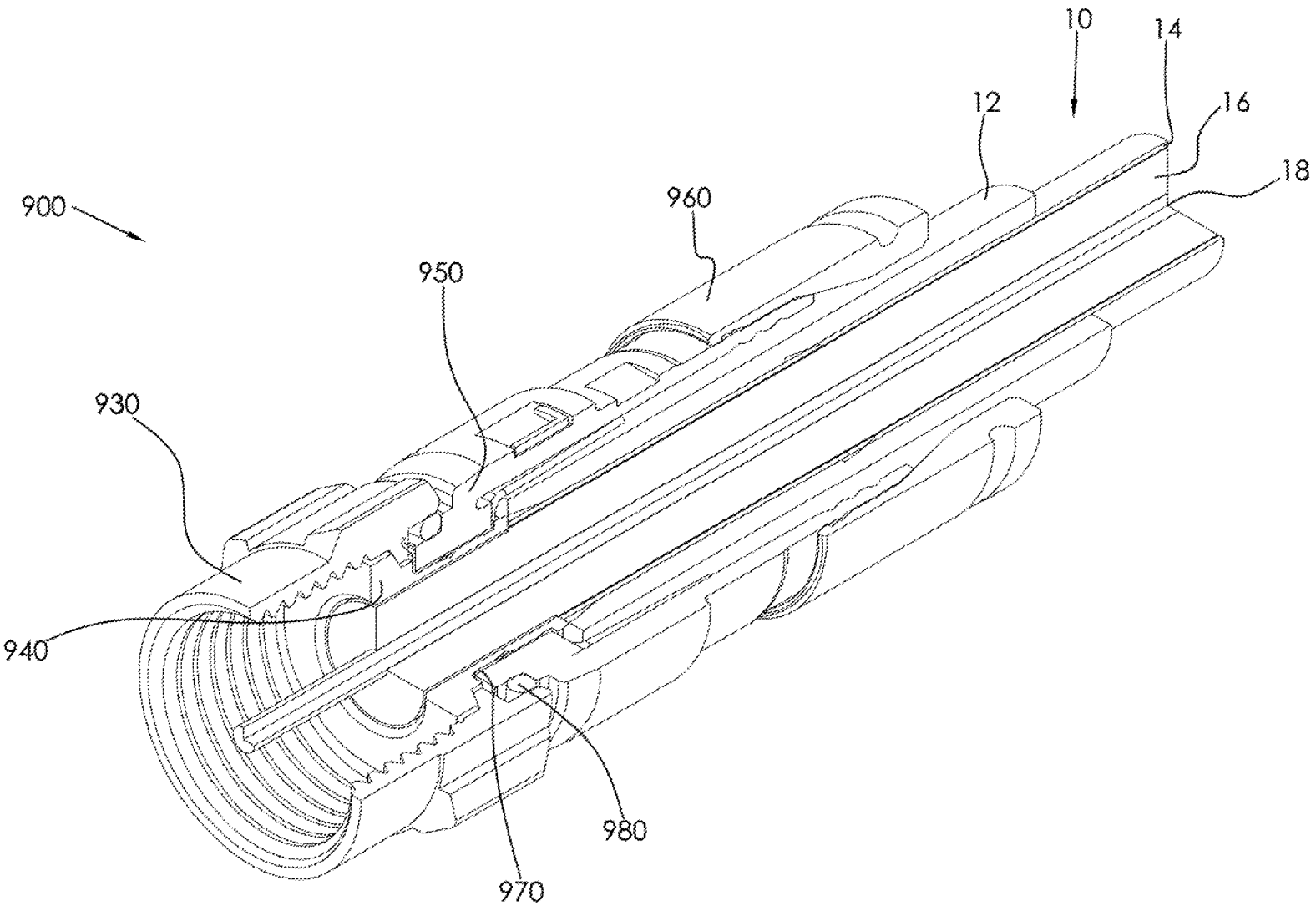
FIG. 30 depicts an isometric cut-away view of the embodiment of a coaxial cable connector of FIG. 29, wherein a cable is attached to the connector, in accordance with the present disclosure.
Figure 31:
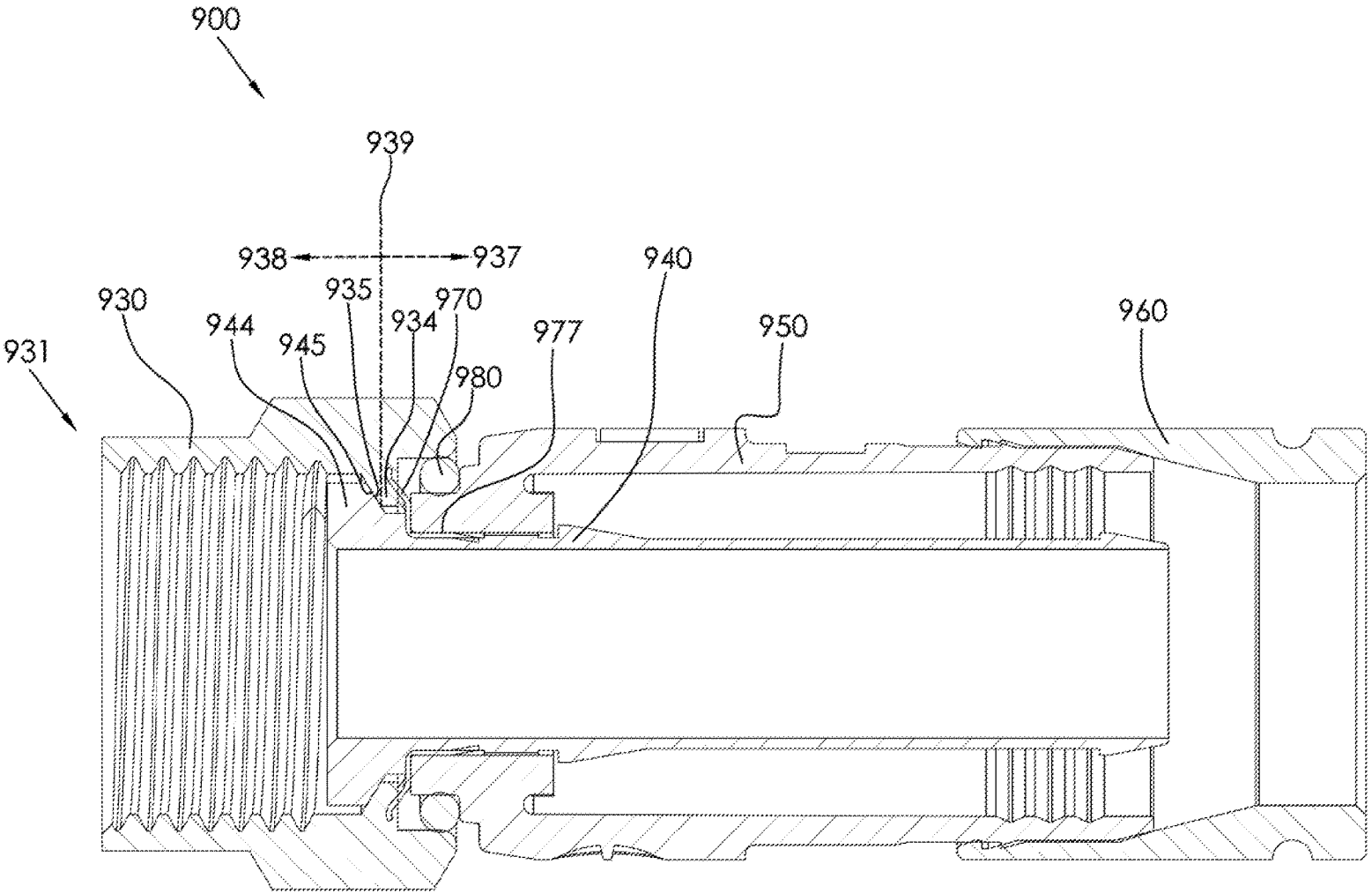
FIG. 31 depicts a side cross-section view of the embodiment of a coaxial cable connector of FIG. 29, in accordance with the present disclosure.
Figure 32:
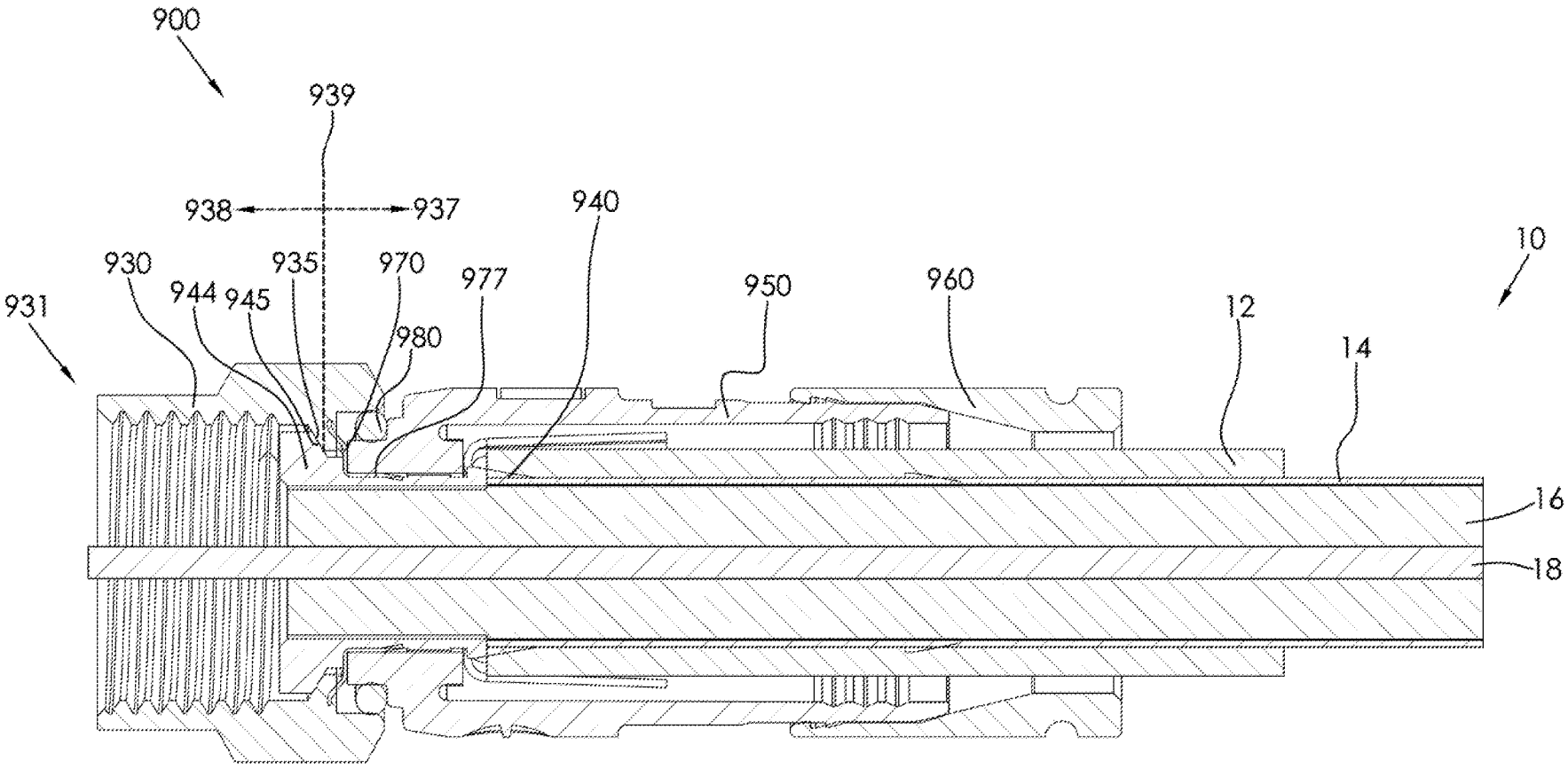
FIG. 32 depicts an isometric cut-away view of the embodiment of a coaxial cable connector of FIG. 29, wherein a cable is attached to the connector, in accordance with the present disclosure.
Figure 33:
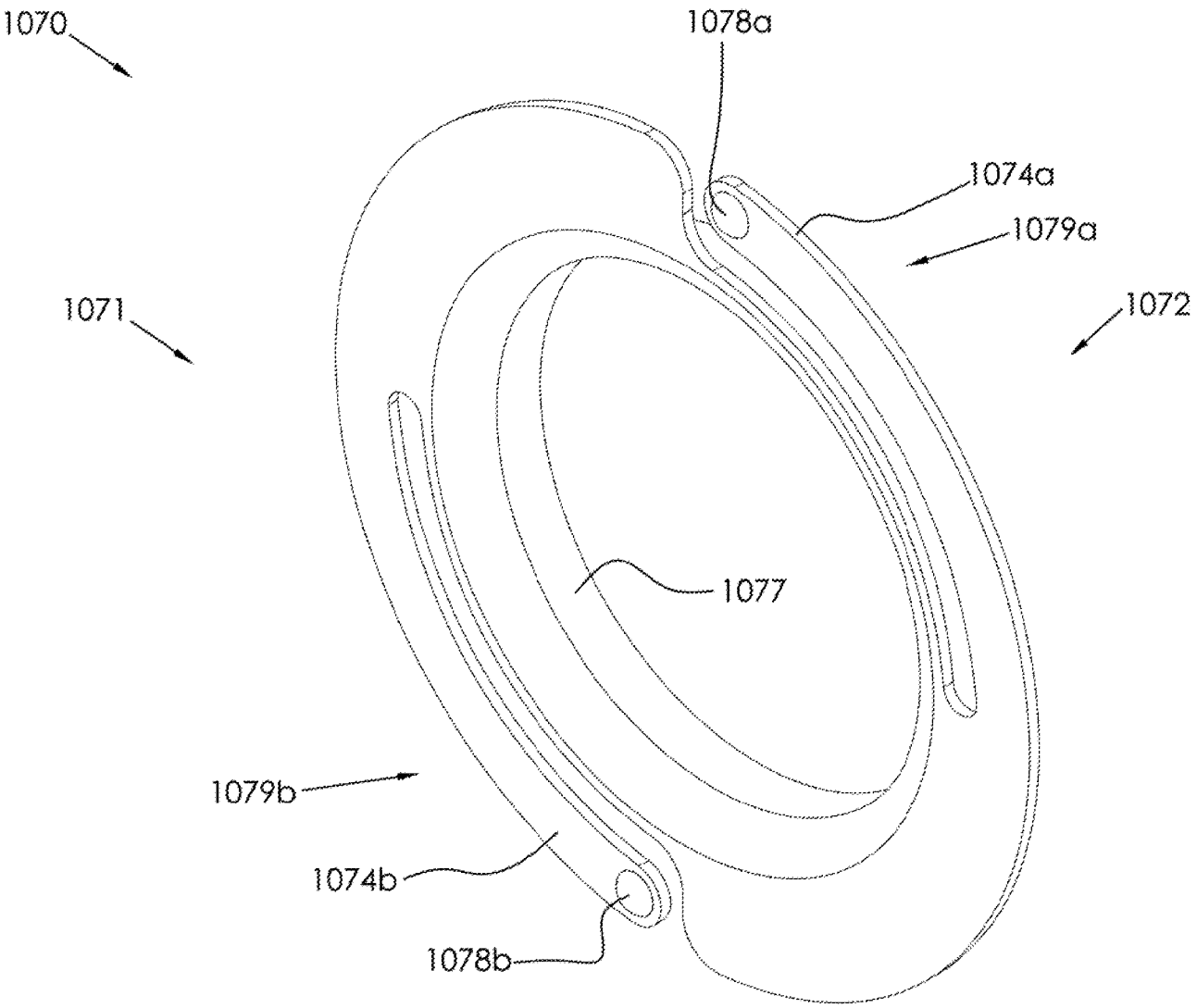
FIG. 33 depicts an isometric view of yet another embodiment of an electrical continuity member, in accordance with the present disclosure.
Figure 34:
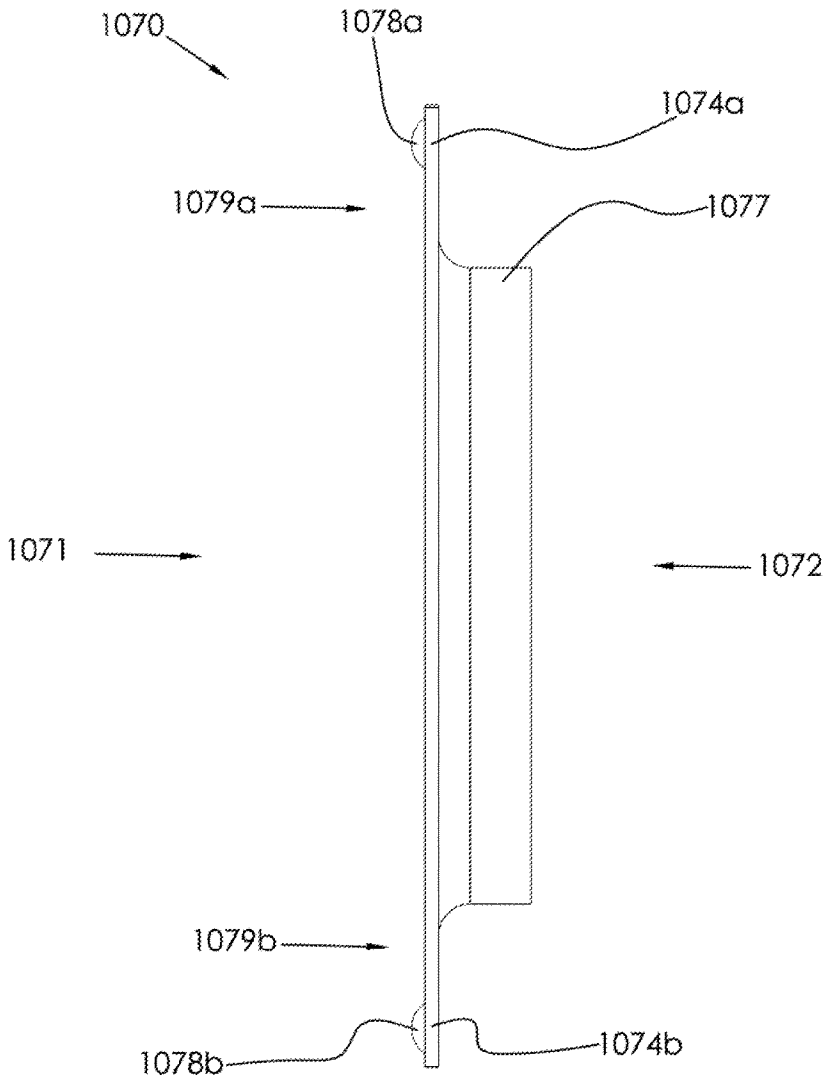
FIG. 34 depicts a side view of the embodiment of an electrical continuity member depicted in FIG. 33, in accordance with the present disclosure.

With still further reference to the drawings, FIG. 26 depicts an isometric view of still further even another embodiment of an electrical continuity member 870, in accordance with the present disclosure. The continuity member 870 may be similar in structure to the continuity member 770, in that it is also sleeve-like and extends about a portion of connector body 50 and resides between the nut 30 and the connector body 50 when the coaxial cable connector 100 is assembled. However, the continuity member 870 includes an unbroken flange-like nut contact portion 874 at the first end 871 of the continuity member 870. The flange-like nut contact portion 874 may be resilient and include several functional properties that are very similar to the properties of the finger-like nut contact portion(s) 774 of the continuity member 770. Accordingly, the continuity member 870 may efficiently extend electrical continuity through the nut 30.

With an eye still toward the drawings and with particular respect to FIGS. 27-32, another embodiment of an electrical continuity member 970 is depicted in several views, and is also shown as included in a further embodiment of a coaxial cable connector 900. The electrical continuity member 970 has a first end 971 and a second end 972. The first end 971 of the electrical continuity member 970 may include one or more flexible portions 979. For example, the continuity member 970 may include multiple flexible portions 979, each of the flexible portions 979 being equidistantly arranged so that in perspective view the continuity member 970 looks somewhat daisy-like. However, those knowledgeable in the art should appreciate that a continuity member 970 may only need one flexible portion 979 and associated not contact portion 974 to obtain electrical continuity for the connector 900. Each flexible portion 979 may associate with a nut contact portion 974 of the continuity member 970. The nut contact portion 974 is configured to engage a surface of the nut 930, wherein the surface of the nut 930 that is engaged by the nut contact portion 974 resides rearward the forward facing surface 935 of nut 930 and the start of the second end portion 937 of the nut 930. A post contact portion 977, may physically and electrically contact the post 940. The electrical continuity member 970 may optionally include a through-slit 973, which through-slit 973 may facilitate various processes for manufacturing the member 970, such as those described in like manner above. Moreover, a continuity member 970 with a through-slit 973 may also be associated with different assembly processes and/or operability than a corresponding electrical continuity member 970 that does not include a through-slit.

When in operation, an electrical continuity member 970 should maintain electrical contact with both the post 940 and the nut 930, as the nut 930 operably moves rotationally about an axis with respect to the rest of the coaxial cable connector 900 components, such as the post 940, the connector body 950 and the fastener member 960. Thus, when the connector 900 is fastened with a coaxial cable 10, a continuous electrical shield may extend from the outer grounding sheath 14 of the cable 10, through the post 940 and the electrical continuity member 970 to the nut or coupler 930, which coupler 930 ultimately may be fastened to an interface port (see, for example port 20 of FIG. 1), thereby completing a grounding path from the cable 10 through the port 20. A sealing member 980 may be operably positioned between the nut 930, the post 940, and the connector body 950, so as to keep environmental contaminants from entering within the connector 900, and to further retain proper component placement and prevent ingress of environmental noise into the signals being communicated through the cable 10 as attached to the connector 900. Notably, the design of various embodiments of the coaxial cable connector 900 includes elemental component configuration wherein the nut 930 does not (and even can not) contact the body 950.

Figure 35:
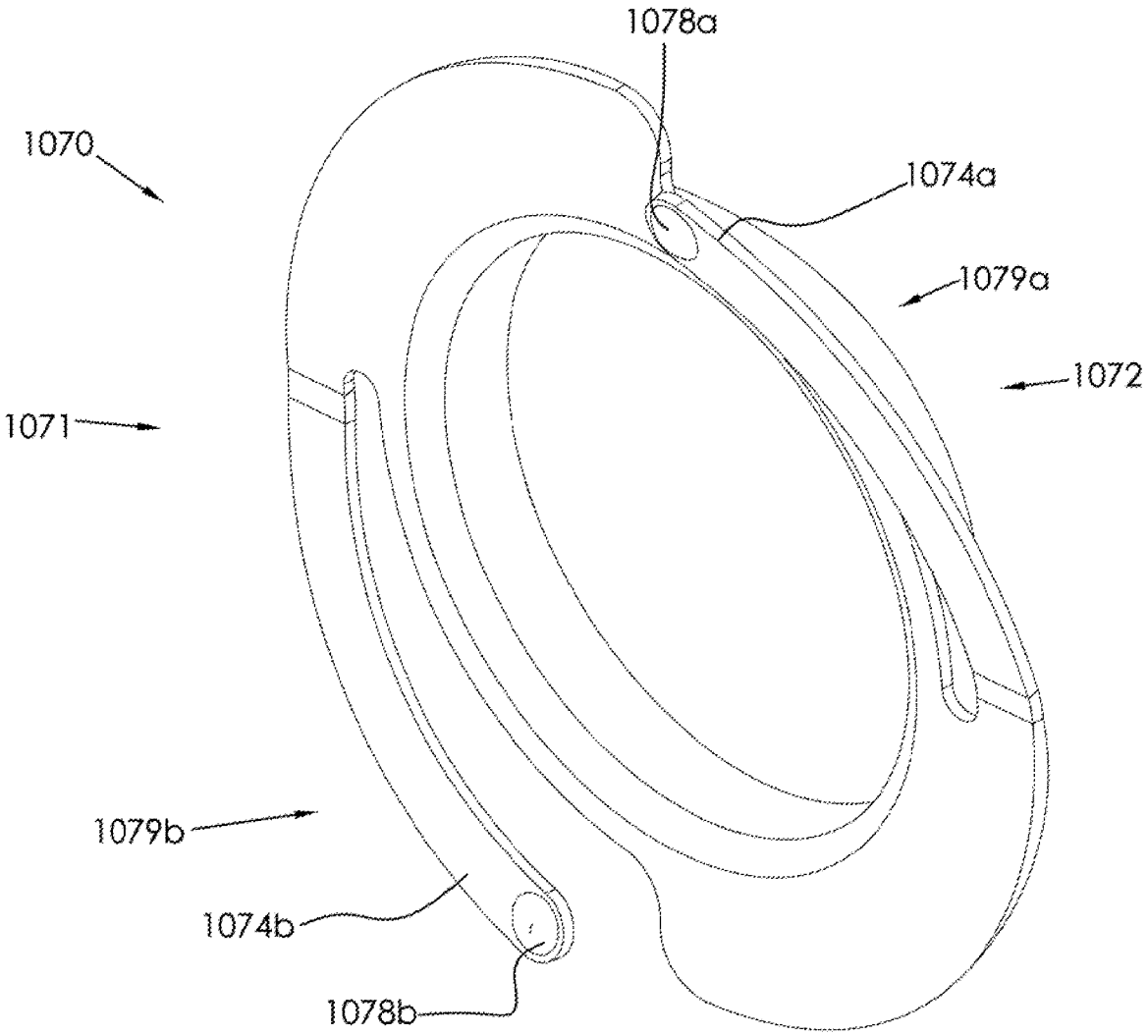
FIG. 35 depicts an isometric view of the embodiment of an electrical continuity member depicted in FIG. 33, wherein nut contact portions are bent, in accordance with the present disclosure.
Figure 36:
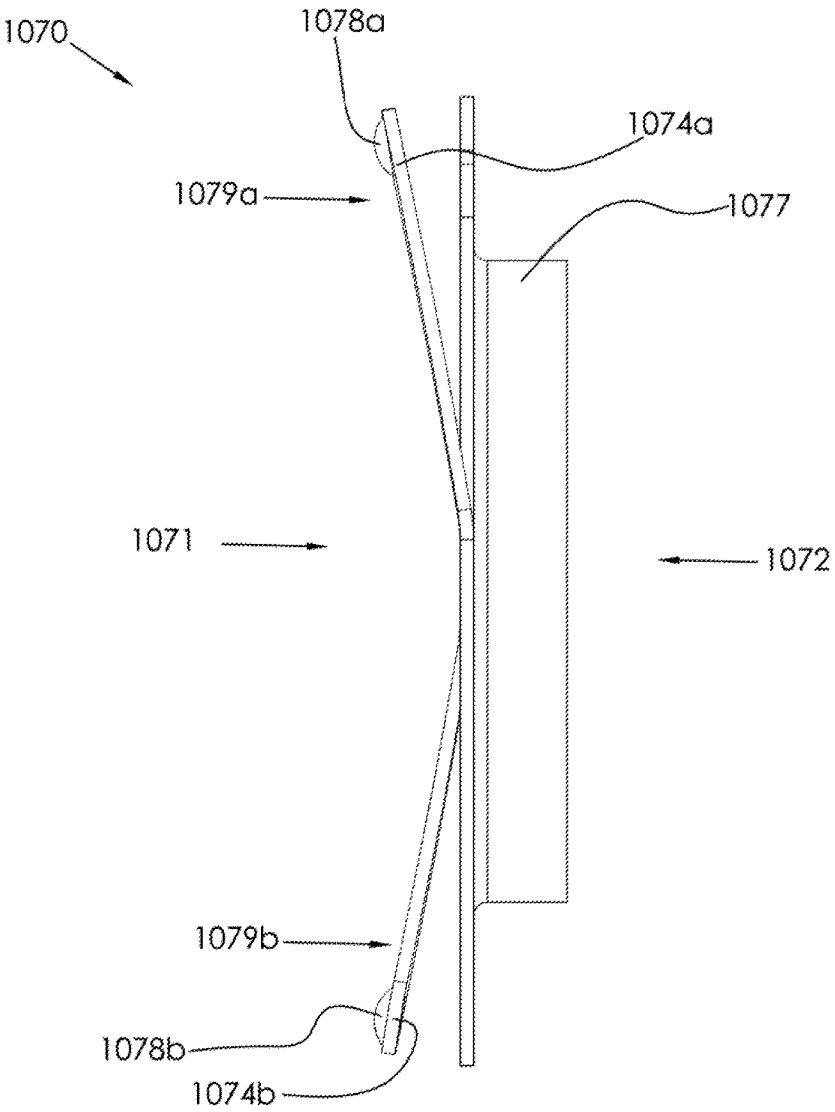
FIG. 36 depicts a side view of the embodiment of an electrical continuity member depicted in FIG. 33, wherein nut contact portions are bent, in accordance with the present disclosure.
Figure 37:
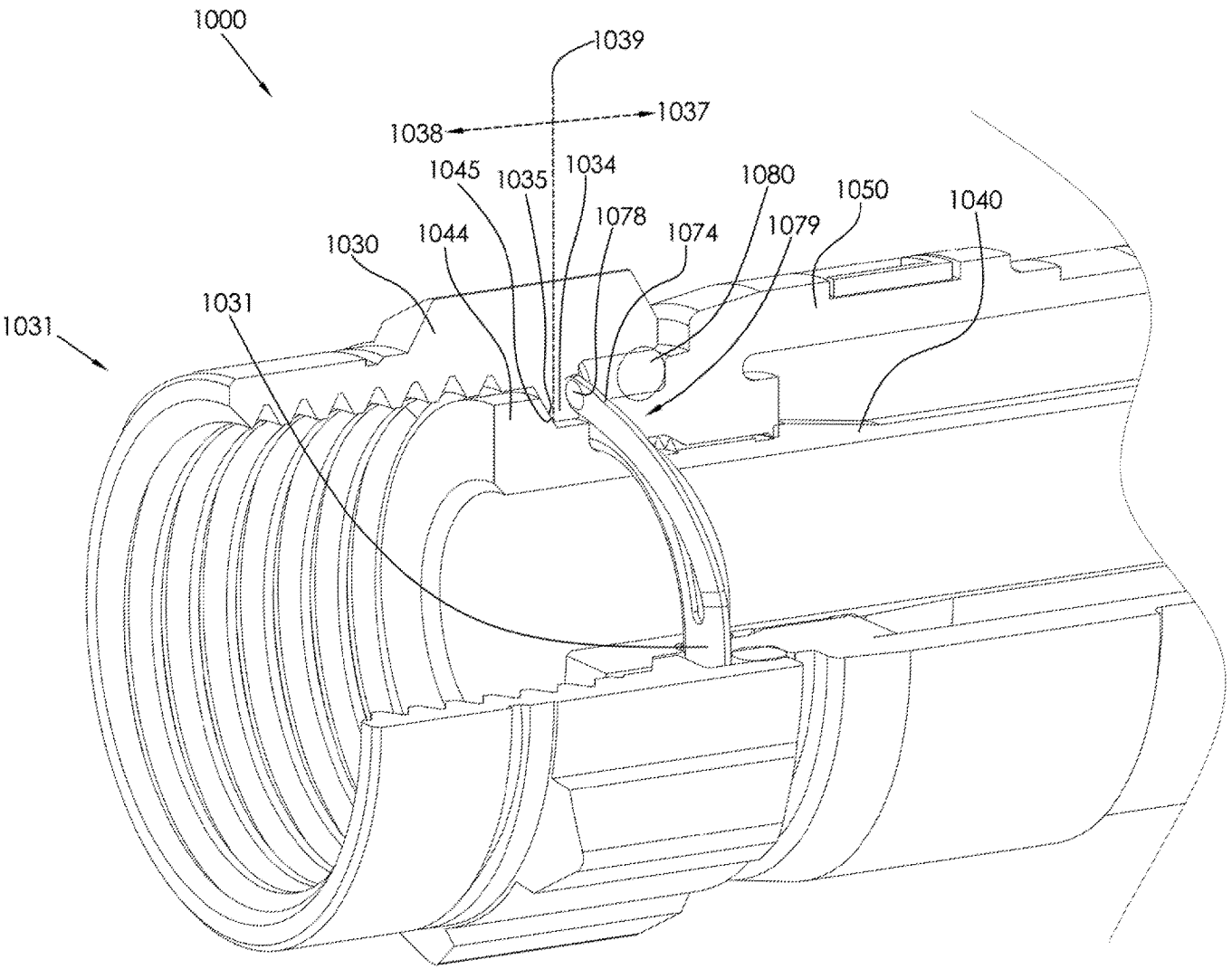
FIG. 37 depicts an isometric cut-away view of a portion of a further embodiment of a coaxial cable connector having the embodiment of the electrical continuity member depicted in FIG. 33, in accordance with the present disclosure.
Figure 38:
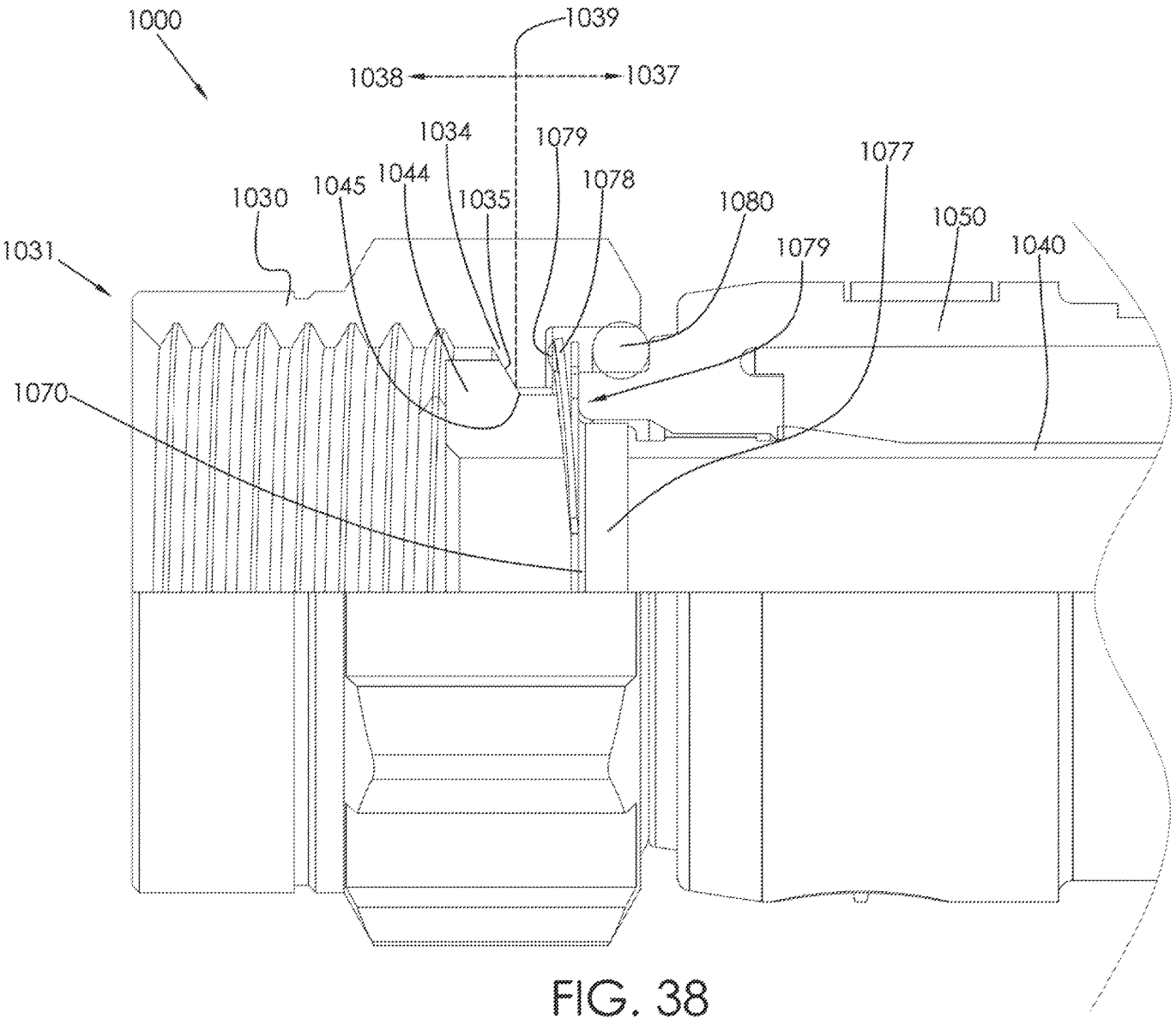
FIG. 38 depicts a cut-away side view of a portion of the further embodiment of a coaxial cable connector depicted in FIG. 37 and having the embodiment of the electrical continuity member depicted in FIG. 33, in accordance with the present disclosure.
Figure 39:
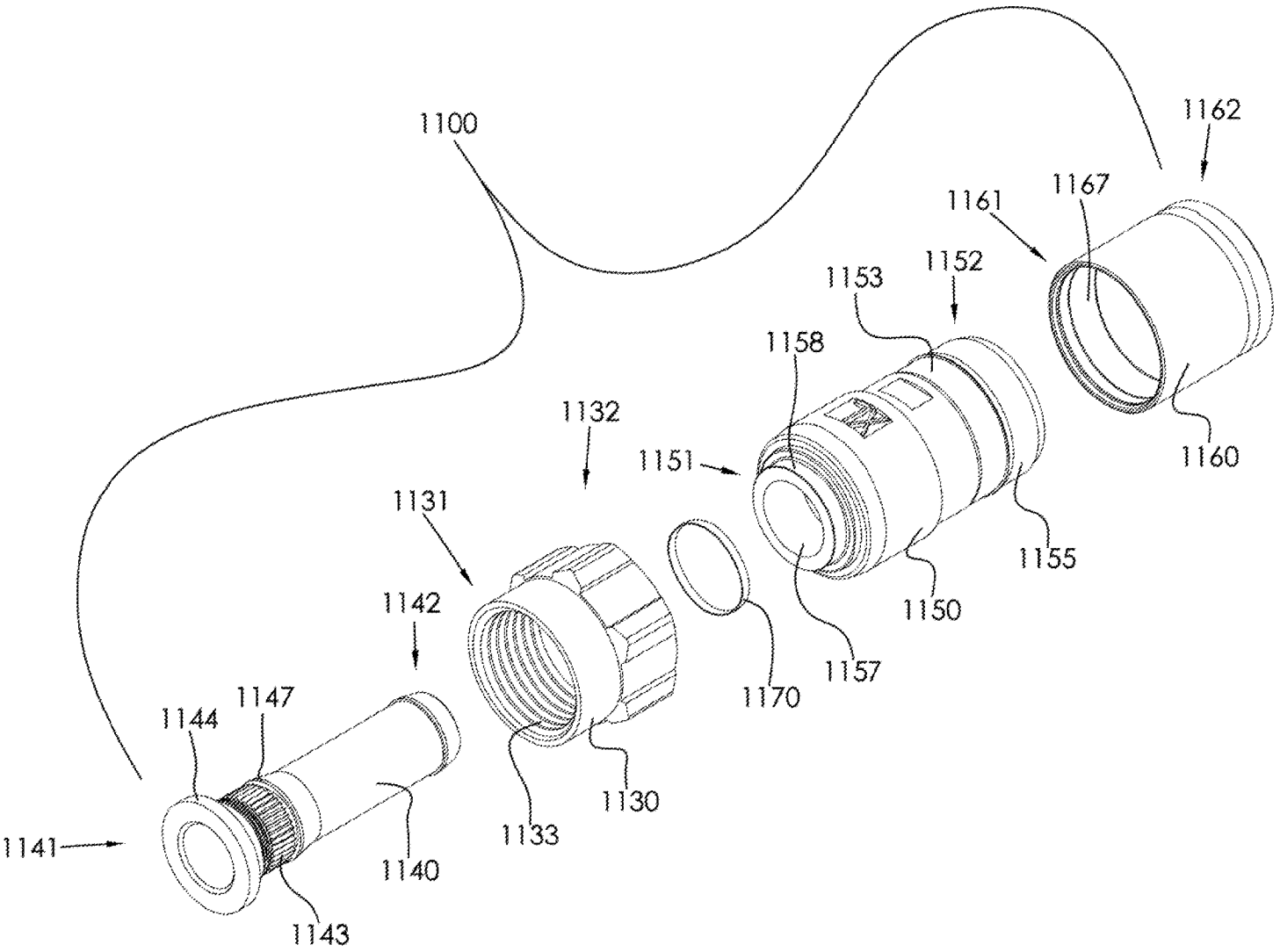
FIG. 39 depicts an exploded perspective cut-away view of another embodiment of the elements of an embodiment of a coaxial cable connector having an embodiment of an electrical continuity member, in accordance with the present disclosure.
Figure 40:
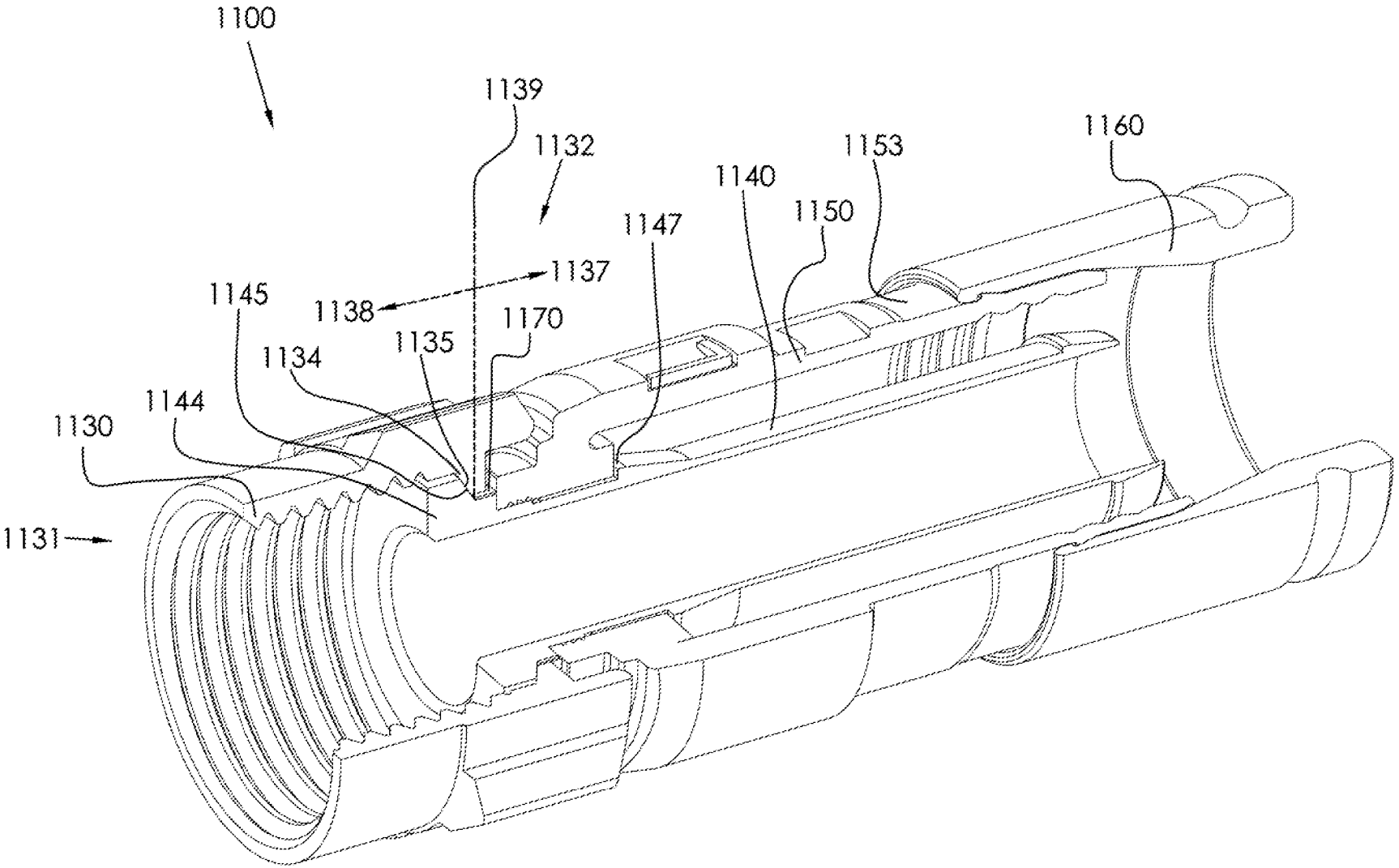
FIG. 40 depicts a side perspective cut-away view of the other embodiment of the coaxial cable connector of FIG. 39, in accordance with the present disclosure.
Figure 41:
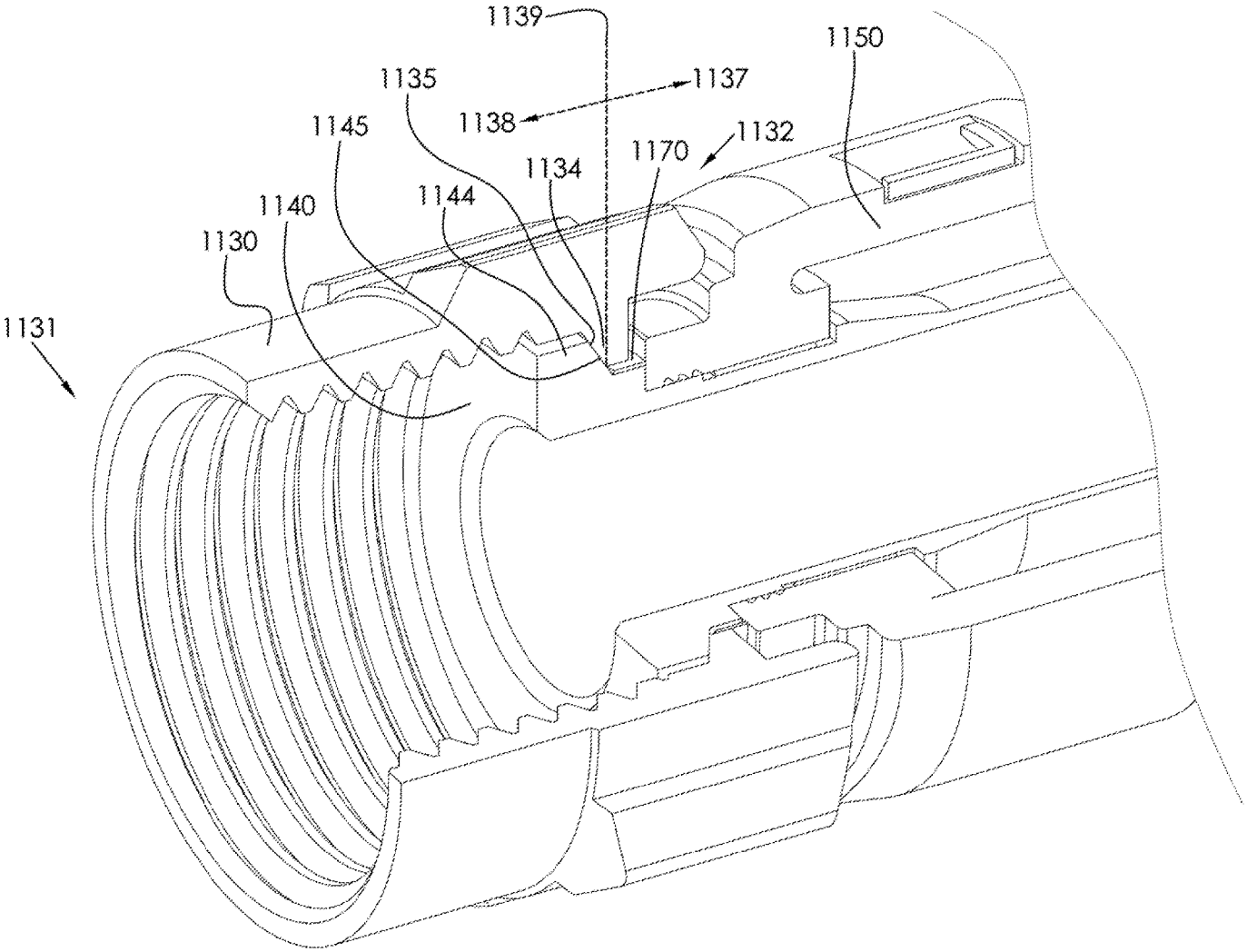
FIG. 41 depicts a blown-up side perspective cut-away view of a portion of the other embodiment of the coaxial cable connector of FIG. 39, in accordance with the present disclosure.

Turning further to the drawings, FIGS. 33-38 depict yet another embodiment of an electrical continuity member 1070. The electrical continuity member 1070 is operably included, to help facilitate electrical continuity in an embodiment of a coaxial cable connector 1000 having multiple component features, such as a coupling nut 1030, an inner post 1040, a connector body 1050, and a sealing member 1080, along with other like features, wherein such component features are, for the purposes of description herein, structured similarly to corresponding structures (referenced numerically in a similar manner) of other coaxial cable connector embodiments previously discussed herein above, in accordance with the present disclosure. The electrical continuity member 1070 has a first end 1071 and opposing second end 1072, and includes at least one flexible portion 1079 associated with a nut contact portion 1074. The nut contact portion 1074 may include a nut contact tab 1078. As depicted, an embodiment of an electrical continuity member 1070 may include multiple flexible portions 1079*a-b* associated with corresponding nut contact portions 1074*a-b*. The nut contact portions 1074*a-b* may include respective corresponding nut contact tabs 1078*a-b*. Each of the multiple flexible portions 1079*a-b*, nut contact portions 1074*a-b*, and nut contact tabs 1078*a-b* may be located so as to be oppositely radially symmetrical about a central axis of the electrical continuity member 1070. A post contact portion 1077 may be formed having an axial length, so as to facilitate axial lengthwise engagement with the post 1040, when assembled in a coaxial cable connector embodiment 1000. The flexible portions 1079*a-b* may be pseudo-coaxially curved arm members extending in yin/yang like fashion around the electrical continuity member 1070. Each of the flexible portions 1079*a-b* may independently bend and flex with respect to the rest of the continuity member 1070. For example, as depicted in FIGS. 35 and 36, the flexible portions 1079*a-b* of the continuity member are bent upwards in a direction towards the first end 1071 of the continuity member 1070. Those skilled in the relevant art should appreciate that a continuity member 1070 may only need one flexible portion 1079 to efficiently obtain electrical continuity for a connector 1000.

When operably assembled within an embodiment of a coaxial cable connector 1000, electrical continuity member embodiments 1070 utilize a bent configuration of the flexible portions 1079*a-b*, so that the nut contact tabs 1078*a-b* associated with the nut contact portions 1074*a-b* of the continuity member 1070 make physical and electrical contact with a surface of the nut 1030, wherein the contacted surface of the nut 1030 resides rearward of the forward facing surface 1035 of the inward lip 1034 of nut 1030, and rearward of the start (at surface 1035) of the second end portion 1037 of the nut 1030. For convenience, dashed line 1039 (similar, for example, to dashed line 39 shown in FIG. 5) depicts the axial point and a relative radial perpendicular plane defining the demarcation of the first end portion 1038 and the second end portion 1037 of embodiments of the nut 1030. As such, the continuity member 1070 does not reside between opposing complimentary surfaces of the lip 1034 of the nut 1030 and the flange 1044 of the post 1040. Rather, the electrical continuity member 1070 contacts the nut 1030 at a rearward location other than on the forward facing side of the lip 1034 of the nut 1030 that faces the flange 1044 of the post 1040, at a location only pertinent to the second end 1037 portion of the nut 1030.

Referring still to the drawings, FIGS. 39-42 depict various views of another embodiment of a coaxial cable connector 1100 having an embodiment of an electrical continuity member 1170, in accordance with the present disclosure. Embodiments of an electrical continuity member, such as embodiment 1170, or any of the other embodiments 70, 170, 270, 370, 470, 570, 670, 770, 870, 970, 1070, 1270 and other like embodiments, may utilize materials that may enhance conductive ability. For instance, while it is critical that continuity member embodiments be comprised of conductive material, it should be appreciated that continuity members may optionally be comprised of alloys, such as cuprous alloys formulated to have excellent resilience and conductivity. In addition, part geometries, or the dimensions of component parts of a connector 1100 and the way various component elements are assembled together in coaxial cable connector 1100 embodiments may also be designed to enhance the performance of embodiments of electrical continuity members. Such part geometries of various component elements of coaxial cable connector embodiments may be constructed to minimize stress existent on components during operation of the coaxial cable connector, but still maintain adequate contact force, while also minimizing contact friction, but still supporting a wide range of manufacturing tolerances in mating component parts of embodiments of electrical continuity coaxial cable connectors.

Figure 42:
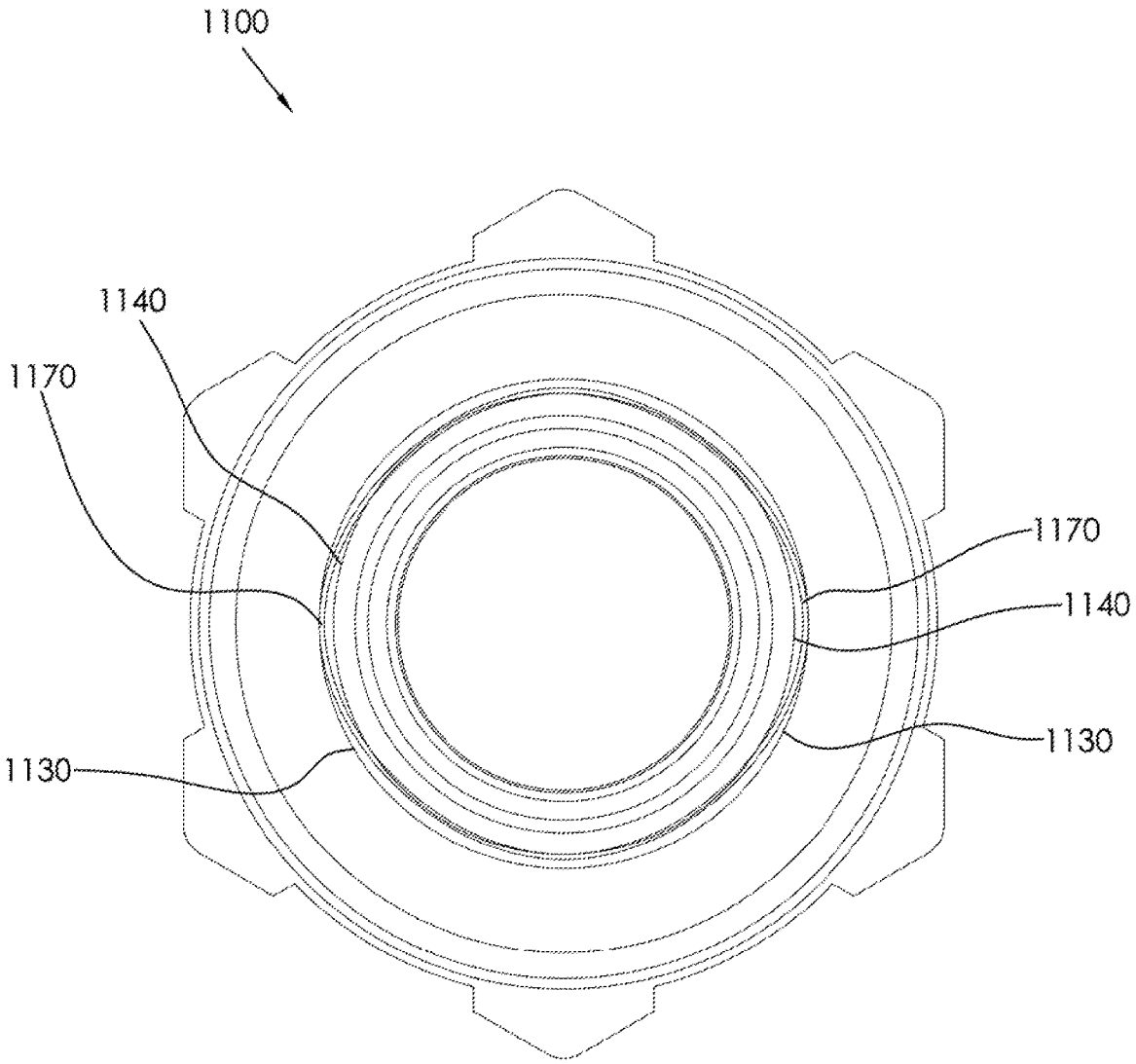
FIG. 42 depicts a front cross-section view, at the location between the first end portion of the nut and the second end portion of the nut, of the other embodiment of the coaxial cable connector of FIG. 39, in accordance with the present disclosure.
Figure 43:
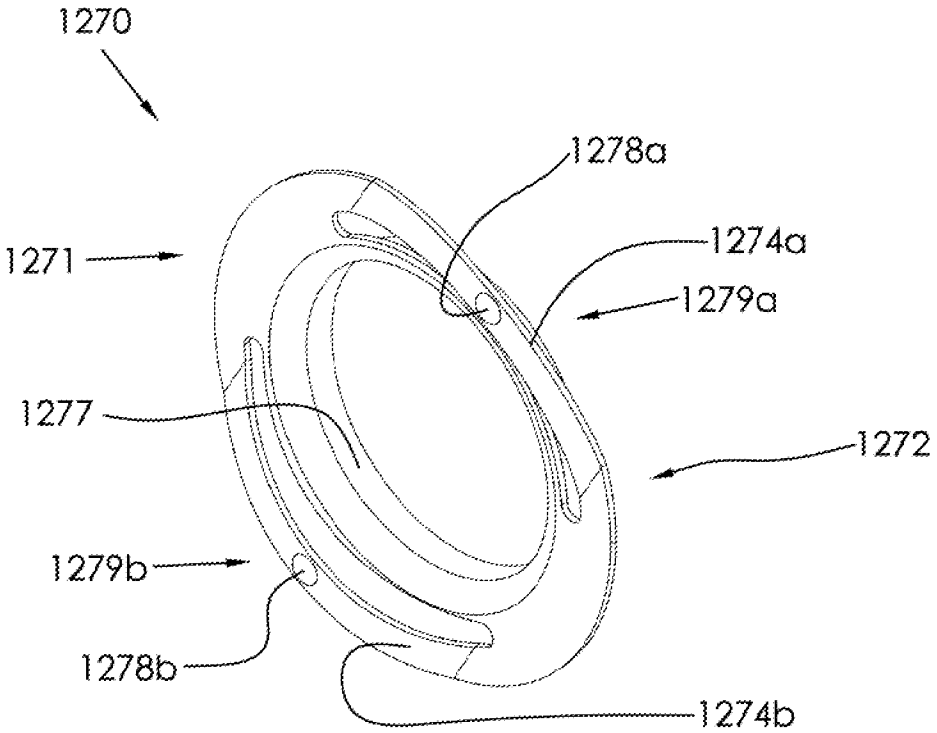
FIG. 43 depicts a front perspective view of yet still another embodiment of an electrical continuity member, in accordance with the present disclosure.
Figure 44:
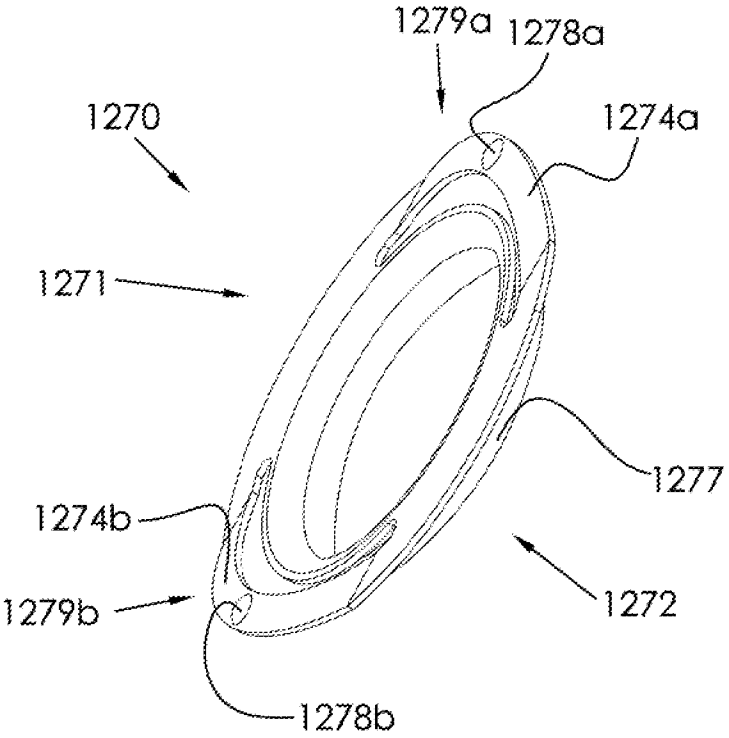
FIG. 44 depicts another front perspective view of the embodiment of the electrical continuity member depicted in FIG. 43, in accordance with the present disclosure.
Figure 45:
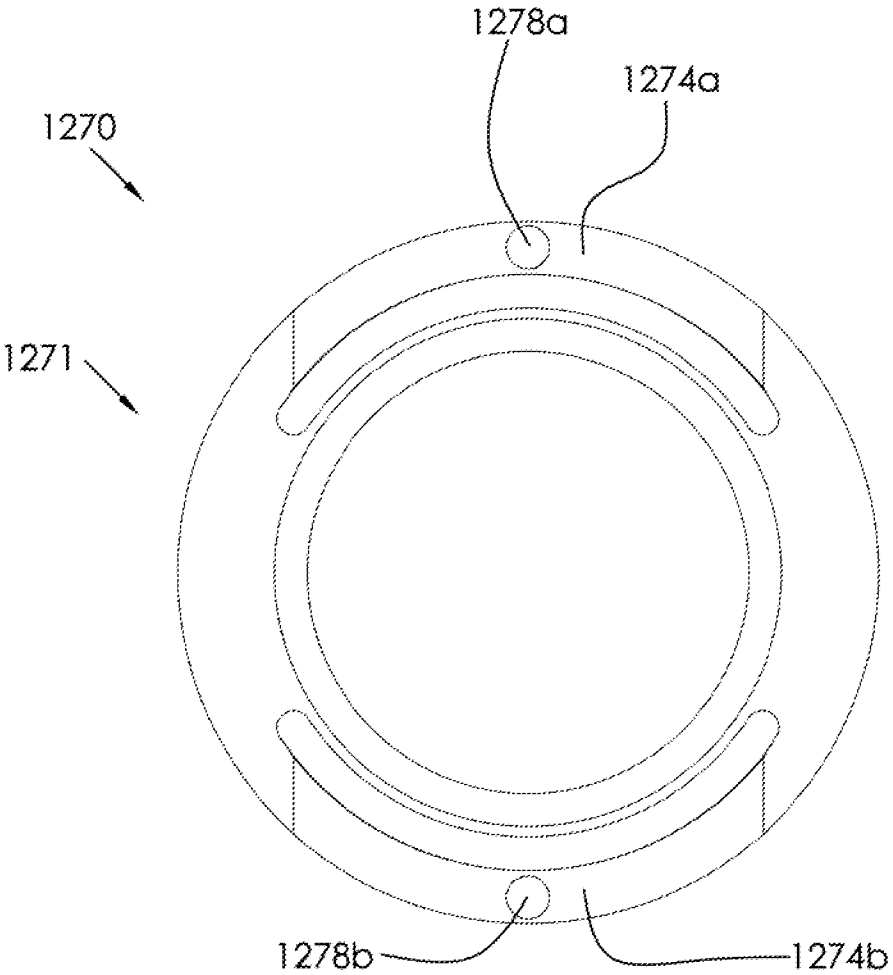
FIG. 45 depicts a front view of the embodiment of the electrical continuity member depicted in FIG. 43, in accordance with the present disclosure.
Figure 46:
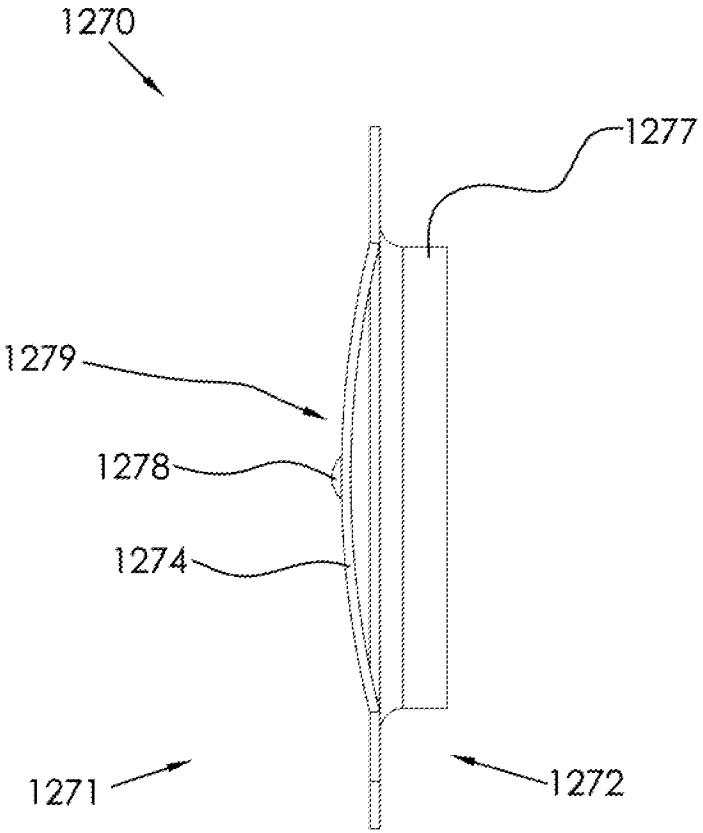
FIG. 46 depicts a side view of the embodiment of the electrical continuity member depicted in FIG. 43, in accordance with the present disclosure.
Figure 47:
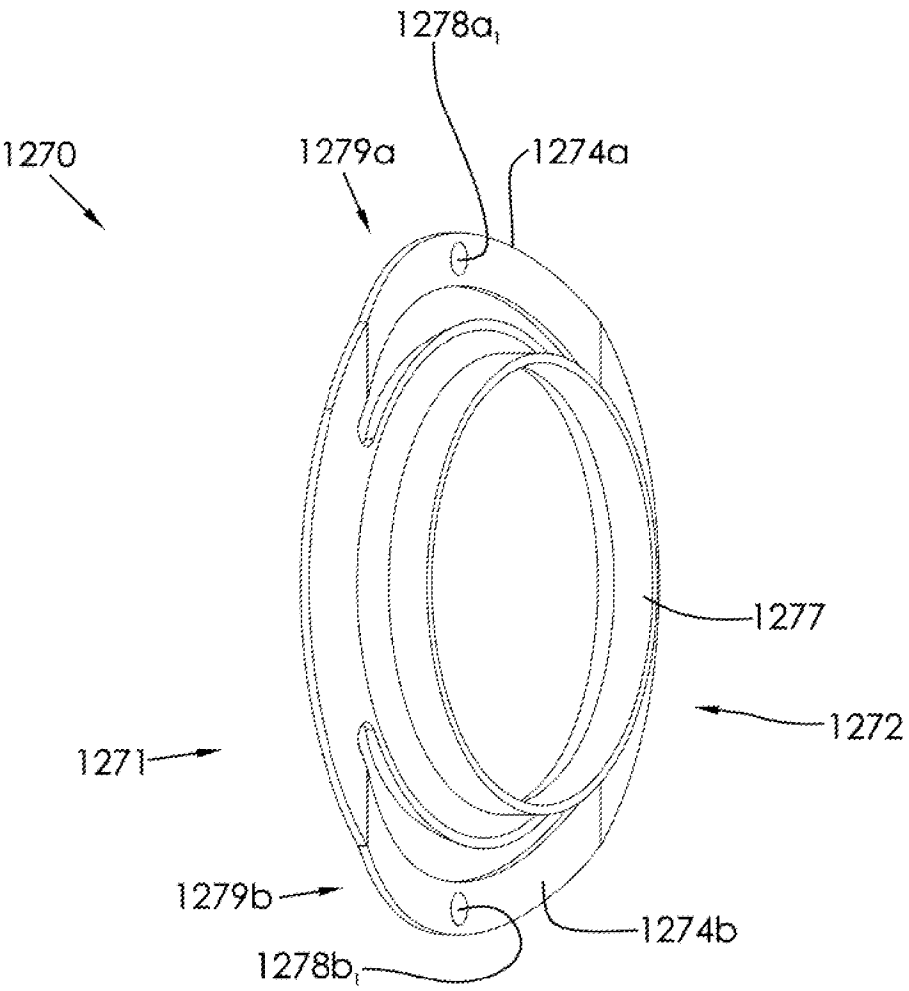
FIG. 47 depicts a rear perspective view of the embodiment of the electrical continuity member depicted in FIG. 43, in accordance with the present disclosure.
Figure 48:
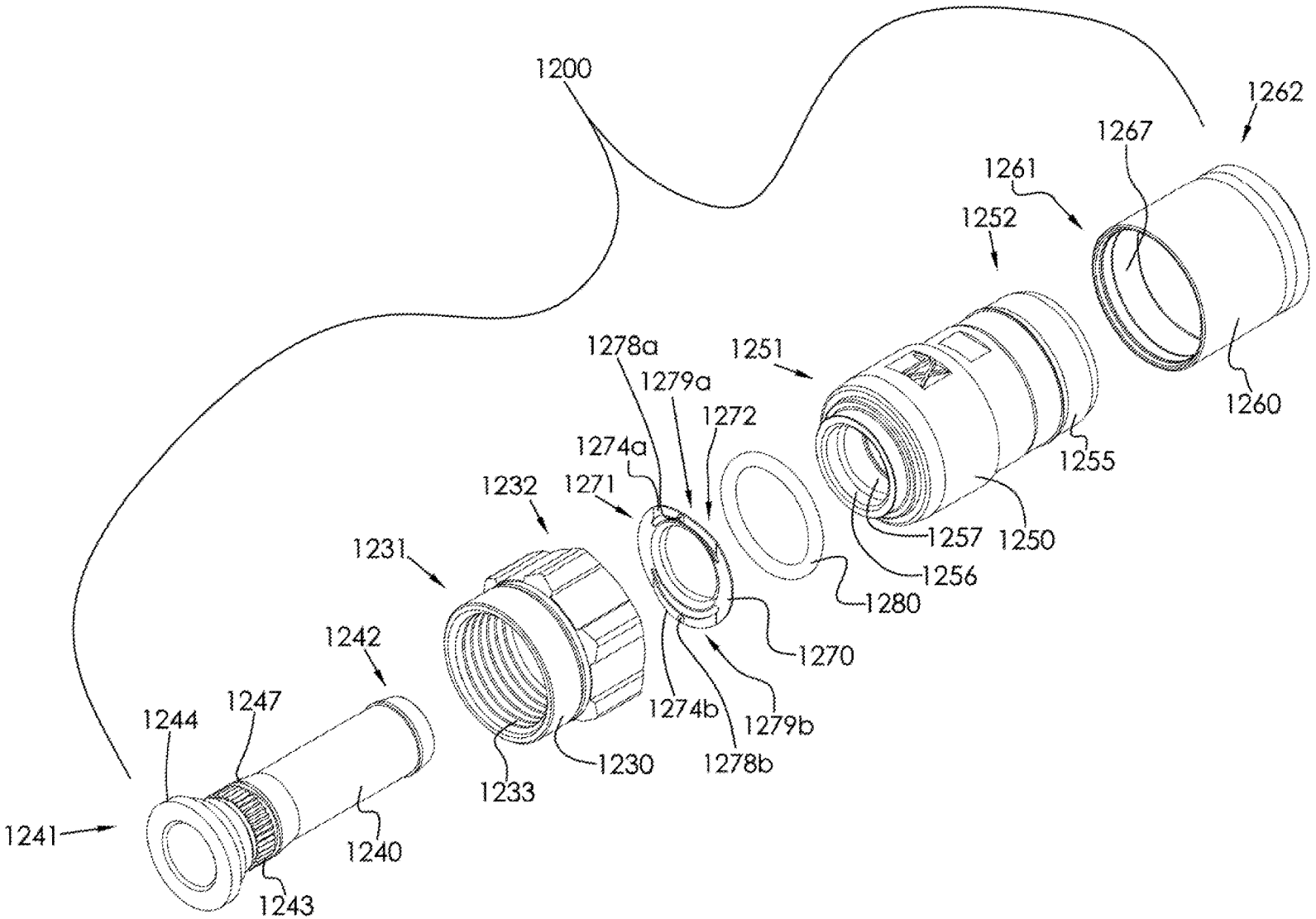
FIG. 48 depicts an exploded perspective cut-away view of a yet still other embodiment of the coaxial cable connector having the embodiment of the yet still other electrical continuity member depicted in FIG. 43, in accordance with the present disclosure.
Figure 49:
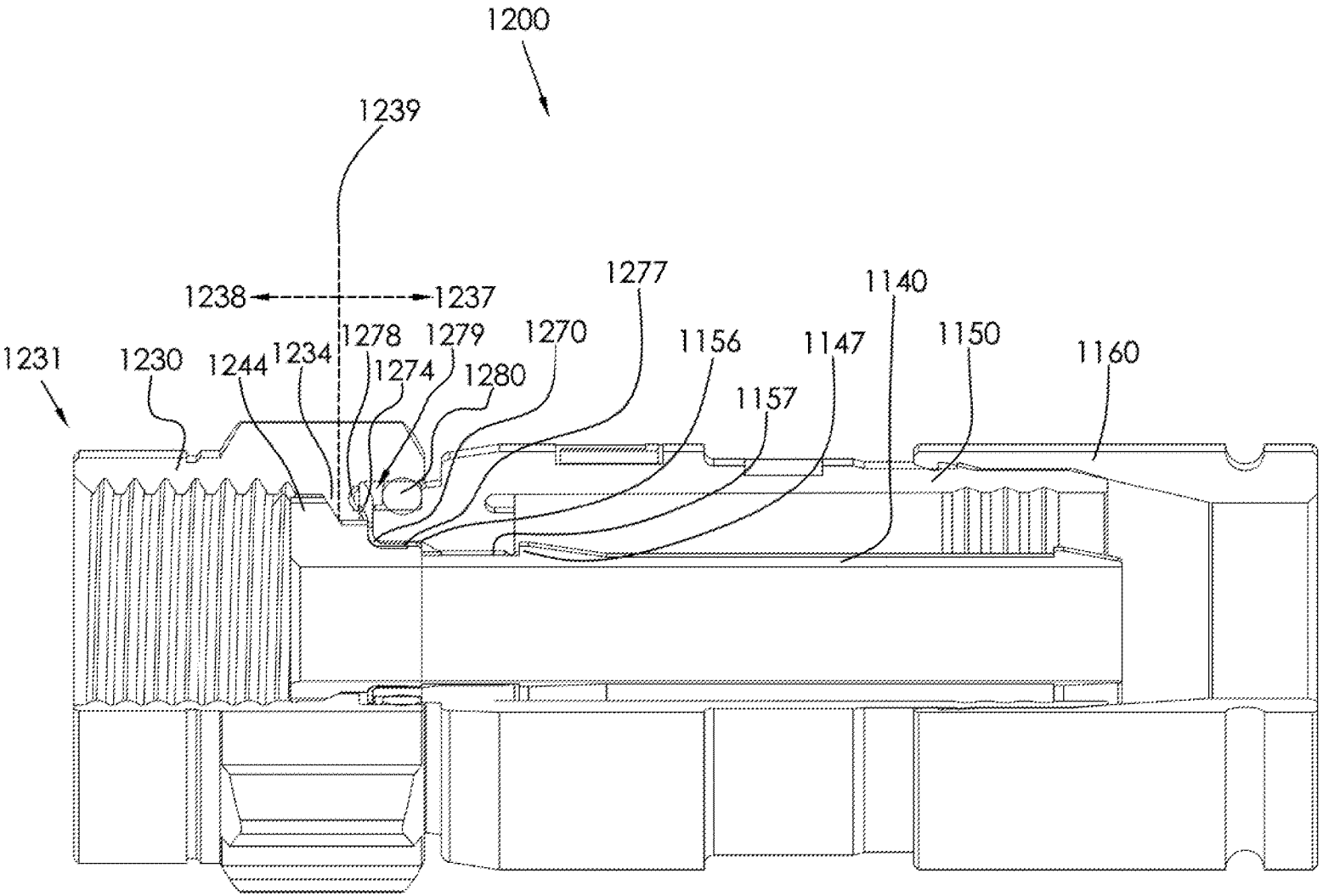
FIG. 49 depicts an isometric cut-away view of a the yet still other embodiment of a coaxial cable connector depicted in FIG. 48 and having the embodiment of the yet still other electrical continuity member depicted in FIG. 43, in accordance with the present disclosure.
Figure 50:
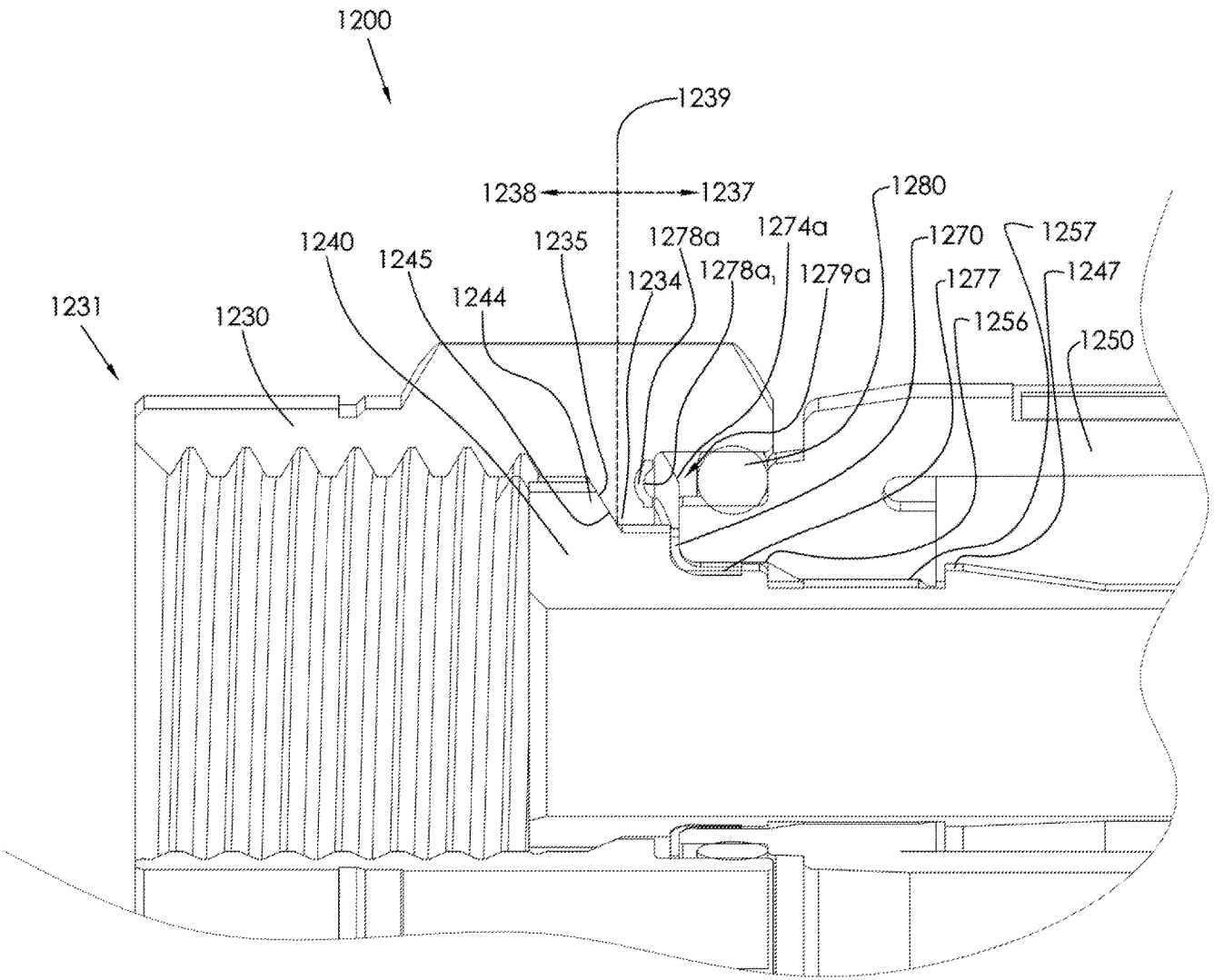
FIG. 50 depicts a blown-up perspective cut-away view of a portion of the yet still other embodiment of a coaxial cable connector depicted in FIG. 48 and having the embodiment of the yet still other electrical continuity member depicted in FIG. 43, in accordance with the present disclosure.
Figure 51:
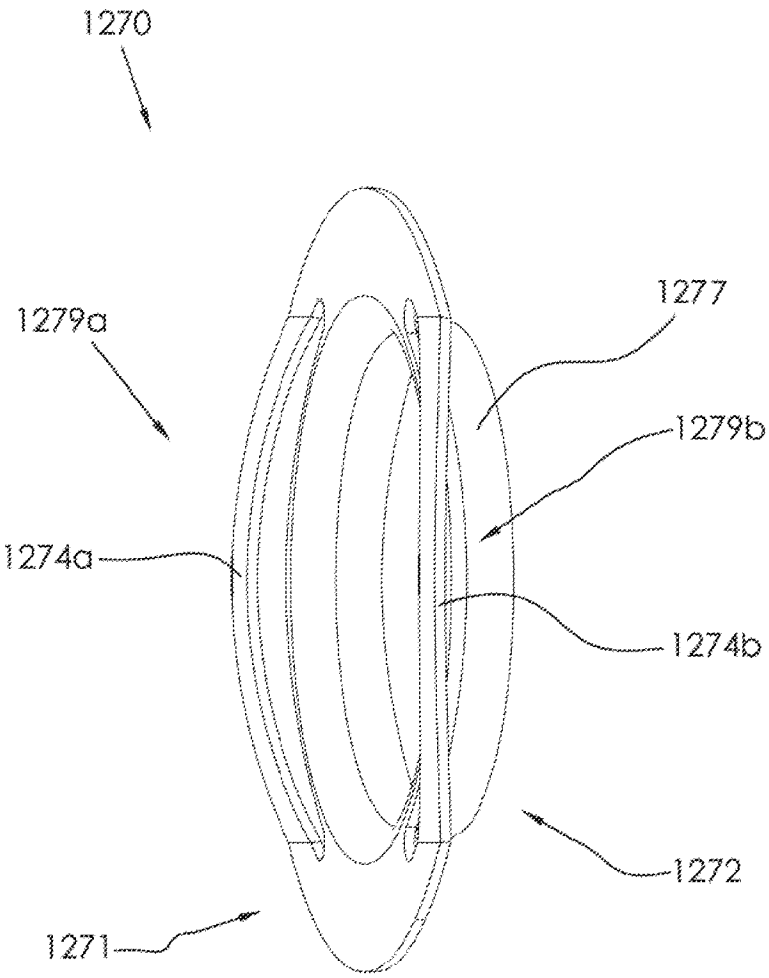
FIG. 51 depicts an isometric view of the embodiment of an electrical continuity member depicted in FIG. 43, yet without nut contact tabs, in accordance with the present disclosure.
Figure 52:
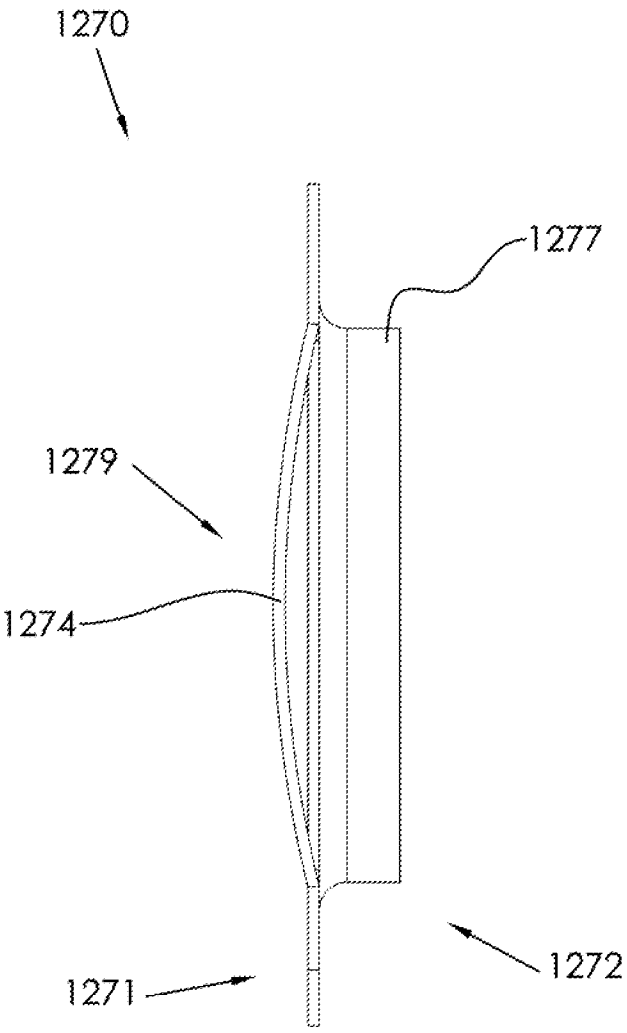
FIG. 52 depicts a side view of the embodiment of the electrical continuity member depicted in FIG. 51, in accordance with the present disclosure.

An embodiment of an electrical continuity member 1170 may comprise a simple continuous band, which, when assembled within embodiments of a coaxial cable connector 1100, encircles a portion of the post 1140, and is in turn surrounded by the second end portion 1137 of the nut 1130. The band-like continuity member 1170 resides rearward a second end portion 1137 of the nut that starts at a side 1135 of the lip 1134 of the nut 1130 facing the first end 1131 of the nut 1130 and extends rearward to the second end 1132 of the nut. The simple band-like embodiment of an electrical continuity member 1170 is thin enough that it occupies an annular space between the second end portion 1137 of the nut 1130 and the post 1140, without causing the post 1140 and nut 1130 to bind when rotationally moved with respect to one another. The nut 1130 is free to rotate, and has some freedom for slidable axial movement, with respect to the connector body 1150. The band-like embodiment of an electrical continuity member 1170 can make contact with both the nut 1130 and the post 1140, because it is not perfectly circular (see, for example, FIG. 42 depicted the slightly oblong shape of the continuity member 1170). This non-circular configuration may maximize the beam length between contact points, significantly reducing stress in the contact between the nut 1130, the post 1140 and the electrical continuity member 1170. Friction may also be significantly reduced because normal force is kept low based on the structural relationship of the components; and there are no edges or other friction enhancing surfaces that could scrape on the nut 1130 or post 1140. Rather, the electrical continuity member 1170 comprises just a smooth tangential-like contact between the component elements of the nut 1130 and the post 1140. Moreover, if permanent deformation of the oblong band-like continuity member 1170 does occur, it will not significantly reduce the efficacy of the electrical contact, because if, during assembly or during operation, continuity member 1170 is pushed out of the way on one side, then it will only make more substantial contact on the opposite side of the connector 1100 and corresponding connector 1100 components. Likewise, if perchance the two relevant component surfaces of the nut 1130 and the post 1140 that the band-like continuity member 1170 interacts with have varying diameters (a diameter of a radially inward surface of the nut 1130 and a diameter of a radially outward surface of the post 1140) vary in size between provided tolerances, or if the thickness of the band-like continuity member 1170 itself varies, then the band-like continuity member 1170 can simply assume a more or less circular shape to accommodate the variation and still make contact with the nut 1130 and the post 1140. The various advantages obtained through the utilization of a band-like continuity member 1170 may also be obtained, where structurally and functionally feasible, by other embodiments of electrical continuity members described herein, in accordance with the objectives and provisions of the present disclosure.

Referencing the drawings still further, it is noted that FIGS. 43-53 depict different views of another coaxial cable connector 1200, the connector 1200 including various embodiments of an electrical continuity member 1270. The electrical continuity member 1270, in a broad sense, has some physical likeness to a disc having a central circular opening and at least one section being flexibly raised above the plane of the disc; for instance, at least one raised portion 1279 of the continuity member 1270 is prominently distinguishable in the side views of both FIG. 46 and FIG. 52, as being arched above the general plane of the disc, in a direction toward the first end 1271 of the continuity member 1270. The electrical continuity member 1270 may include two symmetrically radially opposite flexibly raised portions 1279*a-b* physically and/or functionally associated with nut contact portions 1274*a-b*, wherein nut contact portions 1274*a-b* may each respectively include a nut contact tab 1278*a-b*. As the flexibly raised portions 1279*a-b* arch away from the more generally disc-like portion of the electrical continuity member 1270, the flexibly raised portions (being also associated with nut contact portions 1274*a-b*) make resilient and consistent physical and electrical contact with a conductive surface of the nut 1230, when operably assembled to obtain electrical continuity in the coaxial cable connector 1200. The surface of the nut 1230 that is contacted by the nut contact portion 1274 resides within the second end portion 1237 of the nut 1230.

The electrical continuity member 1270 may optionally have nut contact tabs 1278*a-b*, which tabs 1278*a-b* may enhance the member's 1270 ability to make consistent operable contact with a surface of the nut 1230. As depicted, the tabs 1278*a-b* comprise a simple bulbous round protrusion extending from the nut contact portion. However, other shapes and geometric design may be utilized to accomplish the advantages obtained through the inclusion of nut contact tabs 1278*a-b*. The opposite side of the tabs 1278*a-b* may correspond to circular detents or dimples 1278*a*.sub.1-*b*.sub.1. These oppositely structured features 1278*a*.sub.1-*b*.sub.1 may be a result of common manufacturing processes, such as the natural bending of metallic material during a stamping or pressing process possibly utilized to create a nut contact tab 1278.

As depicted, embodiments of an electrical continuity member 1270 include a cylindrical section extending axially in a lengthwise direction toward the second end 1272 of the continuity member 1270, the cylindrical section comprising a post contact portion 1277, the post contact portions 1277 configured so as to make axially lengthwise contact with the post 1240. Those skilled in the art should appreciated that other geometric configurations may be utilized for the post contact portion 1277, as long as the electrical continuity member 1270 is provided so as to make consistent physical and electrical contact with the post 1240 when assembled in a coaxial cable connector 1200.

The continuity member 1270 should be configured and positioned so that, when the coaxial cable connector 1200 is assembled, the continuity member 1270 resides rearward the start of a second end portion 1237 of the nut 1230, wherein the second end portion 1237 begins at a side 1235 of the lip 1234 of the nut 1230 facing the first end 1231 of the nut 1230 and extends rearward to the second end 1232 of the nut 1230. The continuity member 1270 contacts the nut 1230 in a location relative to a second end portion 1237 of the nut 1230. The second end portion 1237 of the nut 1230 extends from the second end 1232 of the nut 1230 to the axial location of the nut 1230 that corresponds to the point of the forward facing side 1235 of the internal lip 1234 that faces the first forward end 1231 of the nut 1230 that is also nearest the second rearward end 1232 of the nut 1230. Accordingly, the first end portion 1238 of the nut 1230 extends from the first end 1231 of the nut 1230 to that same point of the side of the lip 1234 that faces the first end 1231 of the nut 1230 that is nearest the second end 1232 of the nut 1230. For convenience, dashed line 1239 (see FIGS. 49-50, and 53), depicts the axial point and a relative radial perpendicular plane defining the demarcation of the first end portion 1238 and the second end portion 1237 of embodiments of the nut 1230. As such, the continuity member 1270 does not reside between opposing complimentary surfaces 1235 and 1245 of the lip 1234 of the nut 1230 and the flange 1244 of the post 40. Rather, the continuity member 1270 contacts the nut 1230 at a location other than on the side of the lip 1234 of the nut 1230 that faces the flange 1244 of the post 1240, at a rearward location only pertinent to the second end 1237 portion of the nut 1230.

Various other component features of a coaxial cable connector 1200 may be included with a connector 1200. For example, the connector body 1250 may include an internal detent 1256 positioned to help accommodate the operable location of the electrical continuity member 1270 as located between the post 1240, the body 1250, and the nut 1230. Moreover, the connector body 1250 may include a post mounting portion 1257 proximate the first end 1251 of the body 1250, the post mounting portion 1257 configured to securely locate the body 1250 relative to a portion 1247 of the outer surface of post 1240, so that the connector body 1250 is axially secured with respect to the post 1240. Notably, the nut 1230, as located with respect to the electrical continuity member 1270 and the post 1240, does not touch the body. A body sealing member 1280 may be positioned proximate the second end portion of the nut 1230 and snugly around the connector body 1250, so as to form a seal in the space therebetween.

Figure 53:
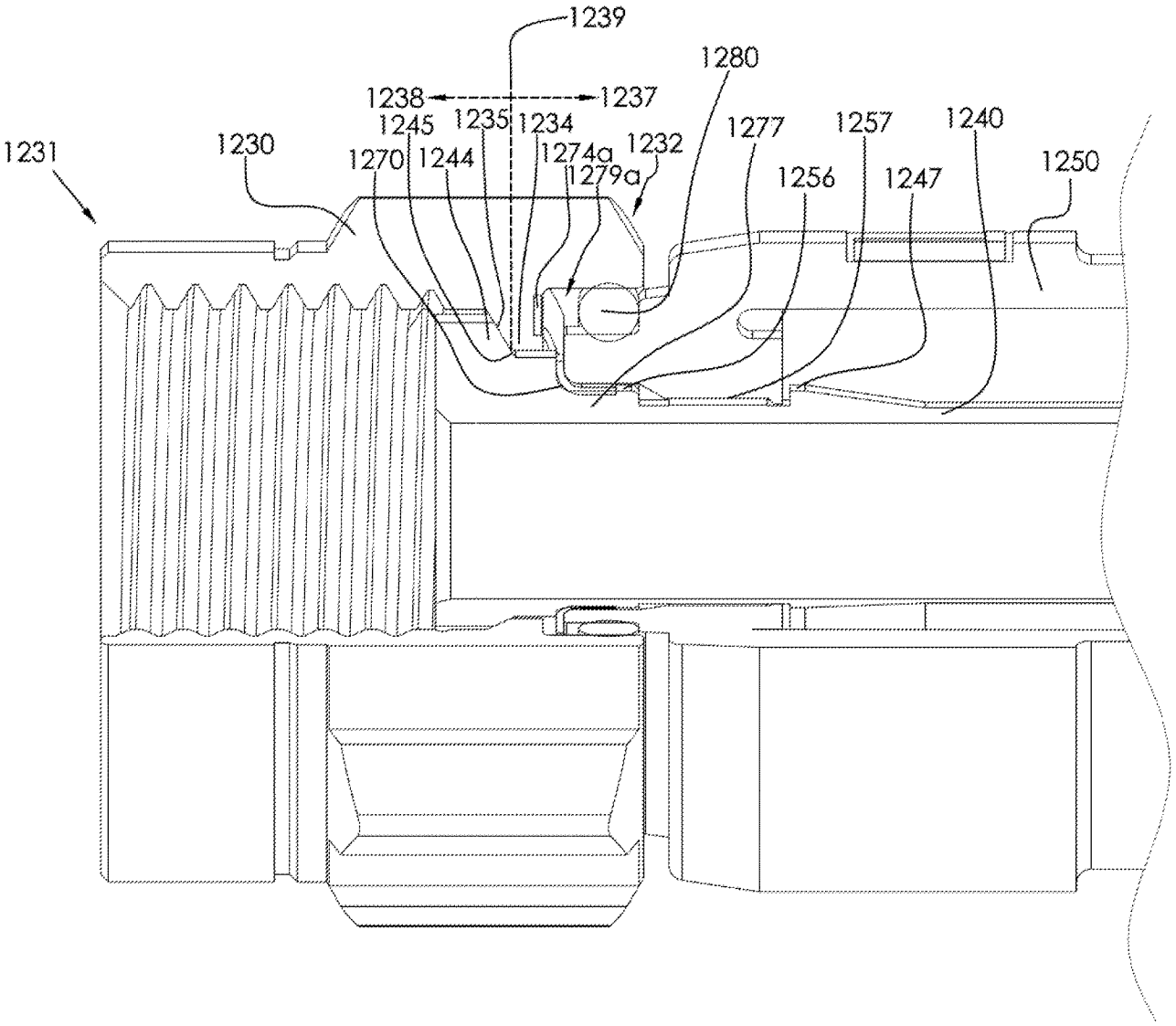
FIG. 53 depicts an isometric cut-away view of a portion of an embodiment of a coaxial cable connector having the embodiment of the electrical continuity member depicted in FIG. 51, in accordance with the present disclosure.

With respect to FIGS. 1-53, a method of obtaining electrical continuity for a coaxial cable connection is described. A first step includes providing a coaxial cable connector 100/900/1000/1100/1200 operable to obtain electrical continuity. The provided coaxial cable connector 100/900/1000/1100/1200 includes a connector body 50/950/1050/1150/1250 and a post 40/940/1040/1140/1240 operably attached to the connector body 50/950/1050/1150/1250, the post 40/940/1040/1140/1240 having a flange 44/944/1044/1144/1244. The coaxial cable connector 100/900/1000/1100/1200 also includes a nut 30/930/1030/1130/1230 axially rotatable with respect to the post 40/940/1040/1140/1240 and the connector body 50/950/1050/1150/1250, the nut 30/930/1030/1130/1230 including an inward lip 34/934/1034/1134/1234. In addition, the provided coaxial cable connector includes an electrical continuity member 70/170/270/370/470/570/670/770/870/970/1070/1170/1270 disposed axially rearward of a surface 35/935/1035/1135/1235 of the internal lip 34/934/1034/1134/1234 of the nut 30/930/1030/1130/1230 that faces the flange 44/944/1044/1144/1244 of the post 40/940/1040/1140/1240. A further method step includes securely attaching a coaxial cable 10 to the connector 100/900/1000/1100/1200 so that the grounding sheath or shield 14 of the cable electrically contacts the post 40/940/1040/1140/1240. Moreover, the methodology includes extending electrical continuity from the post 40/940/1040/1140/1240 through the continuity member 70/170/270/370/470/570/670/770/870/970/1070/1170/1270 to the nut 30/930/1030/1130/1230. A final method step includes fastening the nut 30/930/1030/1130/1230 to a conductive interface port 20 to complete the ground path and obtain electrical continuity in the cable connection, even when the nut 30/930/1030/1130/1230 is not fully tightened onto the port 20, because only a few threads of the nut onto the port are needed to extend electrical continuity through the nut 30/930/1030/1130/1230 and to the cable shielding 14 via the electrical interface of the continuity member 70/170/270/370/470/570/670/770/870/970/1070/1170/1270 and the post 40/940/1040/1140/1240.

Part II

Referring now to FIGS. 54-60, in one embodiment the connector 1300 includes a radially biasing continuity member or element 1301. Depending upon the embodiment, the radially biasing continuity member 1301 can be the continuity element 270, 370 or 470 illustrated in FIGS. 10-15, or the radially biasing continuity member 1301 can be the continuity member 1470, 1570, 1670, 1770 or 1870 described below.

In one embodiment, the radially biasing continuity member 1301 is positioned between the nut or coupler 1330 and the post 1340. By relying on the radial contact, the continuity member 1301 is subject to little or no axial force, resulting in a relatively simple part design and greater robustness. Also, continuity member 1301 facilitates a relatively low resistance or drag force against the coupler 1330.

The radially biasing continuity member 1301 is positionable directly in the high-force area between the coupler 1330 and post 1340. In one embodiment illustrated in FIGS. 54-56, the continuity member 1370 has: (a) at least one coupler engager or radial biasing section 1378 configured to produce a biasing force radially outward from the axial or longitudinal axis 1302, for example along the radial line 1304; (b) at least one post holder, post engager or post holding section 1379; and (c) an axial load bearer or axial loading bearing section 1377 configured to bear a load or force along the axial or longitudinal axis 1302. When the post engager 1379 is engaged with the post 1340, the coupler engager 1378 is simultaneously engaged with the coupler 1330. The post holding section 1379 aids in the engagement of the post 1340 during such simultaneous engagement.

In one embodiment, the axial load bearing section 1377 has no or substantially no resilience or compressibility along the axial axis 1302. Therefore, the axial load bearing section 1377 is configured to withstand relatively high coupler tightening forces without affecting the capability of the continuity member 1370 to establish and maintain radial contact with both the coupler 1330 and the post 1340 independent of whether the coupler 1330 is loose or tight on the port 20.

This axial load bearing section 1377 enables continuity member 1301 to withstand some amount of axial contact by action of the coupler 1330 and post 1340 which could otherwise damage a smaller, more delicate resilient continuity element. The continuity member 1301 may be placed in an area of the connector 1300 which bears the full extent of the tightening force between the coupler 1330 and port 20 or in an area which must accommodate a relatively high amount of axial travel of the coupler 1330 relative to the post 1340 or body 1350 of the connector 1300. The continuity member 1301 is also operable to resist damage resulting from frequent use or mishandling.

Figure 54:
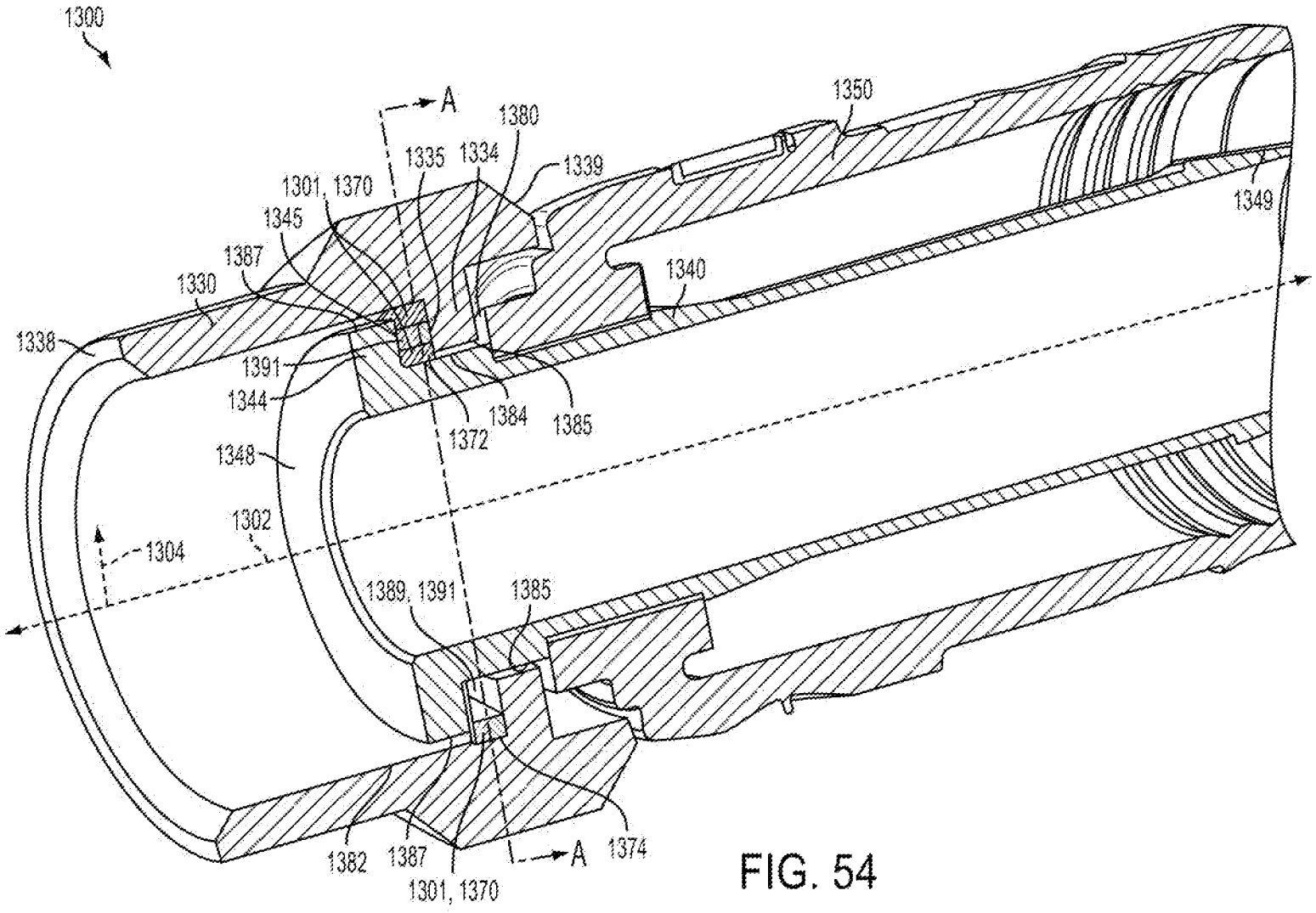
FIG. 54 is an isometric, cut-away view of a portion of another embodiment of a coaxial cable connector having a continuity member.
Figure 55:
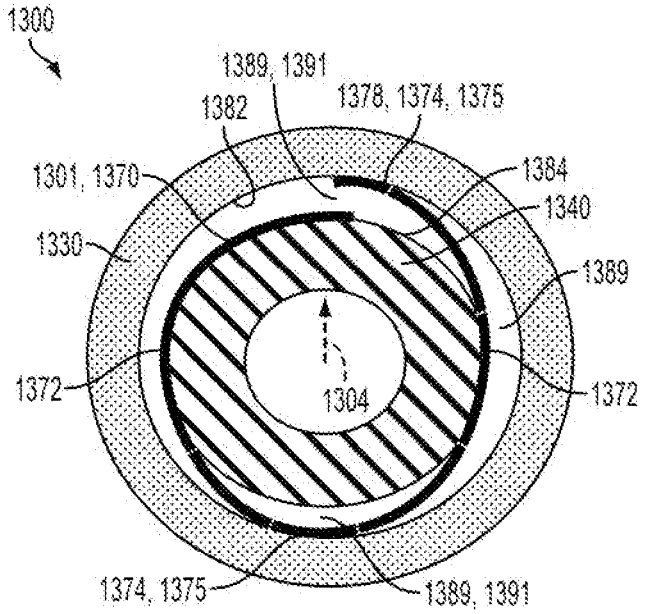
FIG. 55 is a cross sectional view of the coaxial cable connector of FIG. 54, taken substantially along line A-A, having one embodiment of the continuity member.
Figure 56:
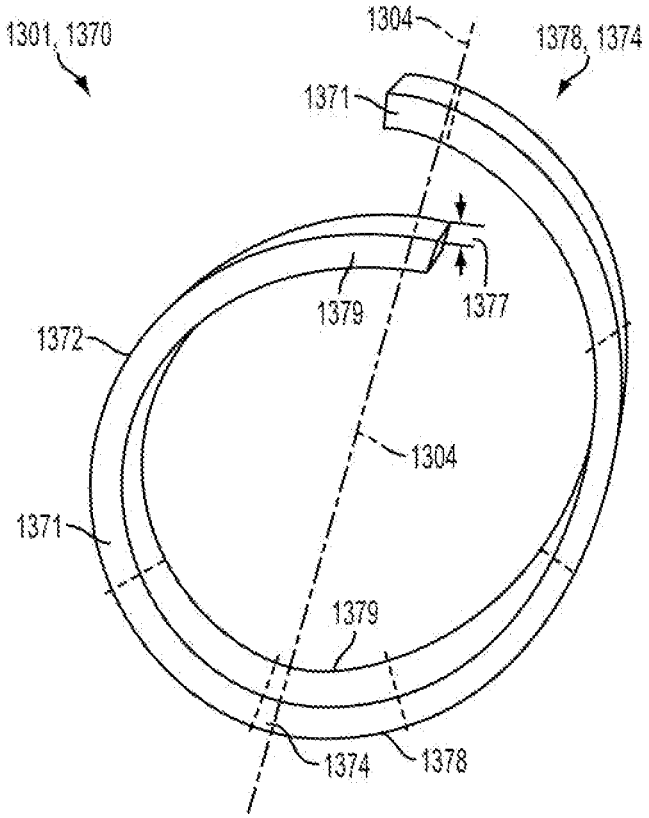
FIG. 56 is an isometric view of the continuity member of FIG. 55.

In the embodiment shown in FIGS. 54-56, the continuity member 1370 has an oval shape with a partial spiral or helical configuration. It should be understood, however, that the continuity member 1301 can have any suitable, alternate shape, including, but not limited to, an asymmetric shape.

As illustrated in FIG. 54 the coaxial cable connector 1300 may be operably affixed, or otherwise functionally attached, to a coaxial cable 10 (as shown in FIG. 1) having a protective outer jacket 12, a conductive grounding shield 14, an interior dielectric 16 and a center conductor 18. The connector 1300 has the coupler 1330, the post 1340, a connector body 1350 and the continuity member 1301, such as the spiral continuity member 1370 shown in FIGS. 54-56.

In one embodiment, the coupler 1330 of coaxial cable connector 1300 includes an internal or inner lip 1334, such as an annular protrusion, located close to a rearward end 1339 of the coupler 1330. The internal lip 1334 includes a surface 1335 facing the forward end 1338 of the coupler 1330. The forward facing surface 1335 of the lip 1334 may be perpendicular to the central axis 1302 of the coupler 1330. The structural configuration of the coupler 1330 may vary according to differing connector design parameters to accommodate different functionality of a coaxial cable connector 1300. For instance, the forward end 1338 of the coupler 1330 may include internal and/or external structures such as ridges, grooves, curves, detents, slots, openings, chamfers, or other structural features which may facilitate the operable joining of an environmental sealing member, such a water-tight seal or other attachable component element, that may help inhibit ingress of environmental contaminants, such as moisture, oils, and dirt, at the forward end 1338 of the coupler 1330, when mated with an interface port 20.

Also, the rearward end 1339 of the coupler 1330 may extend a significant axial distance to partially surround a portion of the connector body 1350, although the extended portion of the coupler 1330 need not contact the connector body 1350. The forward facing surface 1335 of the lip 1334 of the coupler 1330 faces a flange 1344 of the post 1340 when operably assembled in a connector 1300, so as to enable the coupler 1330 to rotate with respect to the other component elements, such as the post 1340 and the connector body 1350, of the connector 1300.

The coupler 1330 may be formed of conductive materials, such as copper, brass, aluminum, or other metals or metal alloys, facilitating grounding through the coupler 1330. Accordingly, the coupler 1330 may be configured to extend an electromagnetic buffer by electrically contacting conductive surfaces of an interface port 20 when a connector 1300 is advanced onto the port 20. In addition, the coupler 1330 may be formed of both conductive and non-conductive materials. For example the external surface of the coupler 1330 may be formed of a polymer, while the remainder of the coupler 1330 may be comprised of a metal or other conductive material. The coupler 1330 may be formed of metals or polymers or other materials that would facilitate a rigidly formed nut body. Manufacture of the coupler 1330 may include casting, extruding, cutting, knurling, turning, tapping, drilling, injection molding, blow molding, combinations thereof, or other fabrication methods that may provide efficient production of the component.

Referring still to FIG. 54, the post 1340 has a forward end 1348 and an opposing rearward end 1349. Furthermore, the post 1340 may comprise a flange 1344, such as an externally (or radially outwardly) extending annular protrusion, located at the forward end of the post 1340. The flange 1344 includes a rearward facing surface 1345 that faces the lip 1334 of the coupler 1330, when operably assembled in a coaxial cable connector 1300, so as to enable the coupler 1330 to rotate with respect to the other component elements, such as the post 1340 and the connector body 1350, of the connector 1300. The rearward facing surface 1345 of flange 1344 may be perpendicular to the longitudinal or central axis 1302 of the post 1340.

The post 1340 may be conductive and may be formed of metals or may be formed of other conductive materials that would facilitate a rigidly formed post body. In addition, the post 1340 may be formed of a combination of both conductive and non-conductive materials. For example, a metal coating or layer may be applied to a polymer of other non-conductive material. Manufacture of the post 1340 may include casting, extruding, cutting, turning, drilling, knurling, injection molding, spraying, blow molding, component overmolding, combinations thereof, or other fabrication methods that may provide efficient production of the component.

The connector body 1350 may be formed of materials such as plastics, polymers, bendable metals or composite materials that facilitate a semi-rigid, yet compliant outer surface. Further, the connector body 1350 may be formed of conductive or non-conductive materials or a combination thereof. Manufacture of the connector body 1350 may include casting, extruding, cutting, turning, drilling, knurling, injection molding, spraying, blow molding, component overmolding, combinations thereof, or other fabrication methods that may provide efficient production of the component.

As shown in FIGS. 54-56, the electrical continuity member 1370 exerts a biasing force (such as an inward spring-like force) on the post 1340 at post contact section 1372. This radially inward force is applied against a radially outward facing surface 1384 (or outer surface) of the post 1340. The electrical continuity member 1370 also exerts a second biasing force (such as an outward spring-like force) against the radially inward facing surface 1382 of the coupler 1330 at the coupler contact point 1375.

The coupler 1330 is shown advanced forward along the connector 1300. This axial advancement may result in a force applied against the continuity member 1370, crushing it between the inner lip 1334 and the flange 1344. The continuity member 1370 may be formed of a suitable material so as to be axially non-resilient and able to withstand such crushing force.

When the coupler 1330 is so advanced along the axis 1302, this creates a gap 1380 rearward of the coupler 1330. Moving the coupler 1330 rearward allows additional space between the inner lip 1334, the flange 1344 and the continuity member 1370. In such arrangement, the continuity member 1370 may be situated so as to not axially contact either the inner lip 1334 or the flange 1344. However, the continuity member 1370 still has radial contact with the coupler 1330 and the post 1340 establishing (or maintaining) an electrical contact between the coupler 1330 and the post 1340.

Additionally, when assembling the connector 1300, the continuity member 1370 may be placed loosely between the coupler 1330 and the post 1340 enabling greater assembly tolerances. Furthermore, while the inner lip 1334 and the flange 1344 restrict the axial movement of the continuity member 1370, the radially-extending surfaces 1385 and 1387 of the inner lip 1334 and flange 1344, respectively, protect the continuity member 1370 from excess forces in the radial direction. In this way, the surfaces 1385 and 1387 act as stops defining a radial cavity, gap or space 1389 for the continuity member 1370.

As illustrated in FIGS. 54-56, in one embodiment, the continuity member 1301 may be a split ring washer. The washer may have an irregular shape, asymmetry or eccentricity (or deviation from perfectly circular) such that it contacts both the coupler 1330 and the post 1340 (or body 1350) while leaving unoccupied space 1391 of the cavity 1389. The unoccupied space 1391 of the cavity 1389 enables the continuity member 1301 to axially deform during its spring action.

In one embodiment illustrated in FIGS. 55-56, the continuity member 1370 has a spiral shape. The inner part, such as post engager 1379 of the spiral continuity member 1370, grabs the post 1340 while the outer edge, such as coupler engager 1378, pushes against the coupler 1330. Additionally, the spiral continuity member 1370 may have an eccentricity so that the spiral is oblong or based on an oval shape. As such, the continuity member 1370 engages the post 1340 at several points on the outer perimeter of the post 1340 while being disengaged from some of the points on the outer perimeter of the post 1340. Likewise, the continuity member 1370 engages the coupler 1330 at several points on the inner perimeter of the coupler 1330 while being disengaged from some of the points on the inner perimeter of the coupler 1330. For example, two sections 1372 squeeze the post 1340, and two sections 1374 press against the coupler 1330.

The spiral continuity member 1370 fits within the radial space or gap 1389 between the coupler 1330 and the post 1340. Where the spiral continuity member 1370 contacts the post 1340, such as in sections 1372, the radial gap 1389 separates the coupler engager 1378 of sections 1372 from the coupler 1330. Likewise, where the section 1374 of spiral continuity member 1370 contacts the coupler 1330, the radial space or gap 1389 separates the post engager 1379 from the post 1340.

Figure 57:
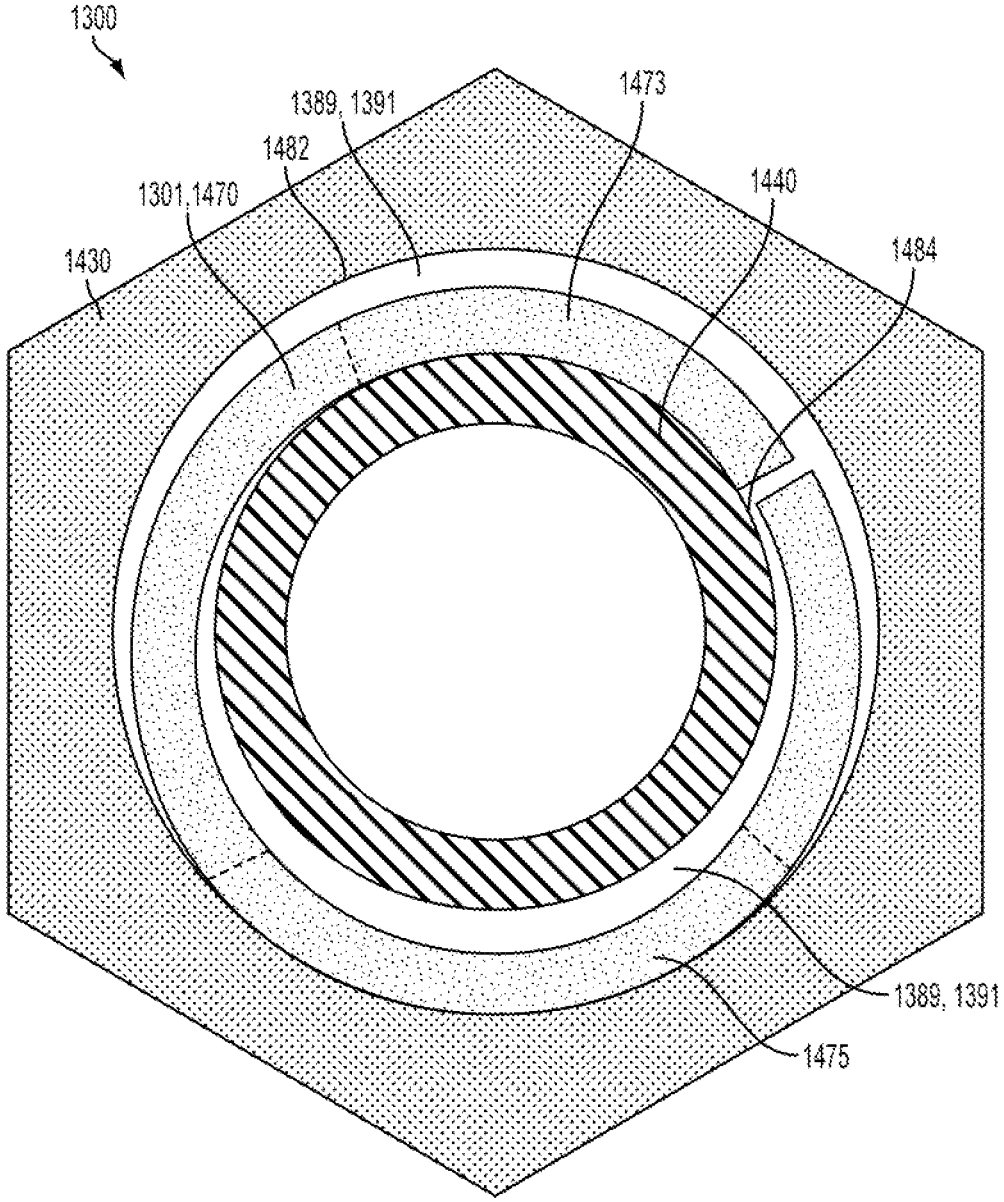
FIG. 57 is a cross sectional view of the coaxial cable connector of FIG. 54, taken substantially along line A-A, having a different embodiment of the continuity member.

As illustrated in FIG. 57, in one embodiment, the continuity member 1301 is continuity member 1470. Continuity member 1470 partially encircles the post 1440, and the coupler 1430 encircles the continuity member 1470. The continuity member 1470 includes various portions for example, post contacting portion 1473 and coupler contacting portion 1475. The post contacting portion 1473 contacts and exerts a force against the outer surface 1484 of the post 1440. In this embodiment, the post contacting portion 1473 of the continuity member 1470 does not touch the inner or radially facing surface 1482 of the coupler 1430. In contrast, the coupler contacting portion 1475 exerts a force against the inner surface 1482 while not pressing against the outer surface 1484 of the post 1440.

In further embodiments, the continuity element 1301 may be square or rectangular. The continuity element 1301 could also be a round wire or some other suitable shape. In the embodiment illustrated in FIG. 56, the continuity element 1370 has a non-resilient material, formed in a radially-elastic configuration. As a result, the axial edges 1371 are stiff and resistant to becoming damaged or distorted when subject to high axial forces.

Figure 58:
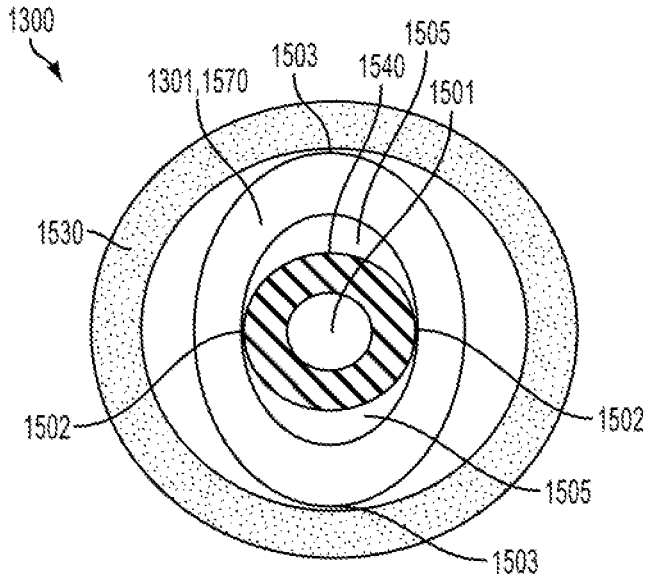
FIG. 58 is a cross sectional view of the coaxial cable connector of FIG. 54, taken substantially along line A-A, having another embodiment of the continuity member.

As illustrated in FIG. 58, in one embodiment, the continuity member 1301 is continuity member 1570. In this view, the coupler 1530 surrounds the post 1540. The continuity member 1570 has an oblong or elliptical shape. At a limited number of points 1502 closer to the center 1501, the continuity member 1570 contacts the post 1540 while at other limited points 1504 farther from the center 1501, the continuity member 1570 contacts the coupler 1530. The gaps 1505 provide room for the radial contraction and expansion of the continuity member 1570 during its spring action.

At these contact points 1502 and 1503, the continuity member 1570 may exert a force against the coupler 1530 or the post 1540. For example, the continuity member 1570 may apply a radially inward force (or squeezing force) against the outer surface of the post 1540. Additionally, the continuity member 1570 may apply a radially outward force (or pushing force) against the outer surface of the post 1540.

Numerous bent forms can suffice for the continuity member 1301, including spirals and rings, but also including oblong; semi-straight-sided polygons and/or shapes that make use of asymmetrical geometries. Regardless of the specific shape, some portion of the continuity member 1301, such as post holding section 1379 of spiral continuity member 1370, contacts the radially facing surface 1382 of the inner connector component (such as the post 1340 or body 1350). Simultaneously, another portion, such as radial biasing section 1378 of spiral continuity member 1370, contacts the radially facing surface 1482 of the coupler 1330 with some slight or suitable amount of force, tension or stress. Furthermore, the continuity member 1301 may be a three dimensional shape, such as an expanding, radial spiral which advances in the axial direction.

Figure 59:
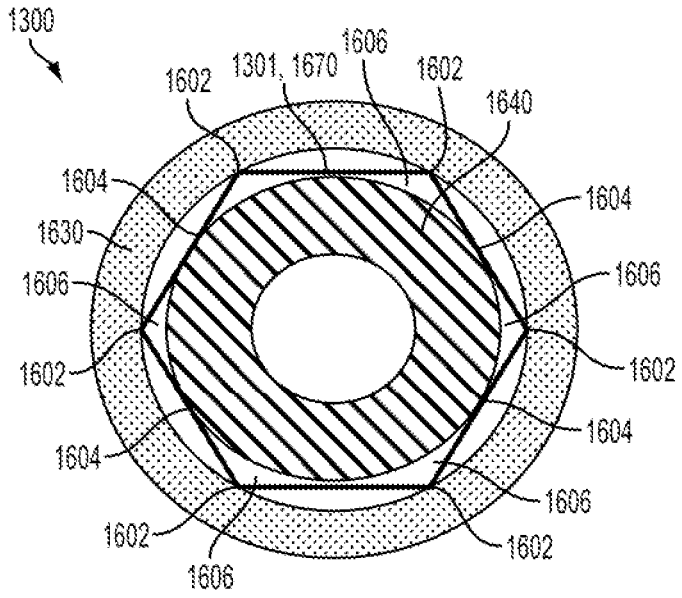
FIG. 59 is a cross sectional view of the coaxial cable connector of FIG. 54, taken substantially along line A-A, having yet another embodiment of the continuity member.

As illustrated in FIG. 59, in one embodiment, the continuity member 1301 is continuity member 1670. A coupler 1630 surrounds a post 1640 and the continuity member 1670. In this embodiment, the continuity member 1670 is a wire which has a bent form of a polygon. The corners 1602 of the polygonal continuity member 1670 press against the coupler 1630 while the walls or edges 1604 squeeze the post 1640. The gaps 1606 provide room for the radial contraction and expansion of the continuity member 1570 during its spring action.

Figure 60:
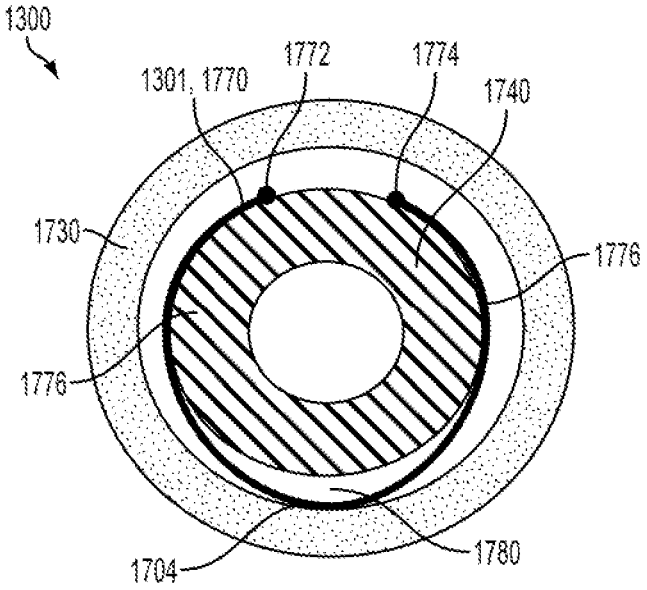
FIG. 60 is a cross sectional view of the coaxial cable connector of FIG. 54, taken substantially along line A-A, having still another embodiment of the continuity member.

As illustrated in FIG. 60, in one embodiment, the continuity member 1301 is continuity member 1770. The continuity member 1770 is a ring having an elliptical shape. The eccentric formation enables the continuity member 1770 to continue to grip the post 1740 while simultaneously extending to press against the coupler 1730 to provide continuity. The inner part of the ring continuity member 1770 grabs the post 1740 while the elliptical shape creates an elliptical bulge part 1704 that pushes against the coupler 1730. The ring continuity member 1770 includes ends 1772 and 1774 which may be engaged (such as with pliers) in order to attach or remove the continuity member 1770. In the embodiment shown, the walls 1776 contact or engage the post 1740. At the same time, the wall 1778 engages the coupler 1730 while being disengaged from the post 1740. The gap 1780 provides room for the radial contraction and expansion of the continuity member 1770 during its spring action.

Figure 61:
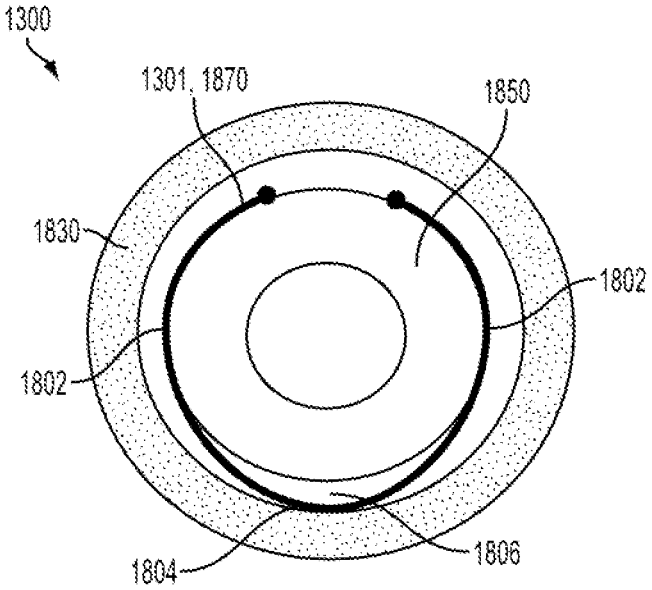
FIG. 61 is a cross sectional view of the coaxial cable connector of FIG. 54, taken substantially along line A-A, having another embodiment of the continuity member.

As illustrated in FIG. 61, in one embodiment, the continuity member 1301 is continuity member 1870. In this embodiment, the continuity member 1301 exerts a force against the body 1850. The continuity member 1870 is a ring having an elliptical shape. In this embodiment a coupler 1830 surrounds a body 1850 and the continuity member 1870. The inner part 1802 of the ring continuity member 1870 grabs the body 1850 while the elliptical bulge part

1804 pushes against the coupler 1830. The gap 1806 provides room for the radial contraction and expansion of the continuity member 1870 during its spring action.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A connector comprising:

a post portion having an outer surface;

a coupler portion having an inner surface that facers radially inward, the coupler portion being configured to receive at least part of the post portion so that there is a space between the inner surface of the coupler portion and the outer surface of the post portion; and an electrical grounding portion configured to be positioned within the space such that a continuous length of the electrical grounding portion is curved about a periphery of the post portion, the curved continuous length of the electrical grounding portion including:

(a) a first portion configured to be engaged with the post portion while being disengaged from the inner surface of the coupler portion; and (b) a second portion configured to be disengaged from the post portion while being engaged with the inner surface of the coupler portion, wherein the post portion includes a flange portion extending radially outward at a forward portion of the post portion;

wherein the coupler portion includes an internal lip portion extending radially inward at a portion of the coupler portion that is rearward of the forward portion of the post portion; and wherein the space is between the flange portion and the internal lip portion in an axial direction of the connector.

2. The connector of claim 1, wherein the electrical grounding portion is configured to:

(a) simultaneously exert (i) a first biasing force directed radially inward against the outer surface of the post portion; and (ii) a second biasing force directed radially outward against the inner surface of the coupler portion; and (b) establish an electrical connection between the post portion and the coupler portion.

3. The connector of claim 1, further comprising a sealing portion positioned between the coupler portion and a connector body, the sealing portion being configured to provide an environmental seal.

4. The connector of claim 1, wherein the coupler portion is configured to axially move between a first axial position relative to the post portion and a second axial position relative to the post portion, the electrical grounding portion being configured to establish the electrical connection when the coupler portion is in the first axial position and when the coupler portion is in the second axial position, the second axial position corresponding to a fully tightened position on an interface port.

5. The connector of claim 1, wherein the electrical grounding portion is deformable in a radial direction.

6. The connector of claim 1, wherein the electrical grounding portion comprises one of: a ring, a split washer, a leaf spring and a coil spring.

7. The connector of claim 1, wherein the electrical grounding portion comprises a shape being one of: a spiral, an oblong, a polygon, an oval, a helix, a square, a hexagon, a rectangle, an irregular shape, a non-uniform shape, and an asymmetric shape.

8. The connector of claim 1, wherein the coupler portion is configured to move between a non-fully tightened position on an interface port and a fully tightened position on the interface port, the electrical grounding portion being configured to establish an electrical connection between the post portion and the coupler portion even when the coupler portion is in the non-fully tightened position.

9. The connector of claim 8, wherein the electrical grounding portion is configured to maintain electrical continuity when the coupler portion is in both the non-fully tightened position and in the fully tightened position.

10. A connector comprising:

a post portion;

a coupler portion configured to receive the post portion; and an electrical grounding portion configured to be establish an electrical connection between the post portion and the coupler portion;

wherein the electrical grounding portion is configured to be positioned in a space between a radially inner surface of the coupler portion that faces radially inward and a radially outer surface of the post portion;

wherein a continuous length of the electrical grounding portion is curved about a periphery of the post portion;

wherein the curved continuous length of the electrical grounding portion includes a first portion configured to be engaged with the post portion while being disengaged from the radially inner surface of the coupler portion and a second portion configured to be disengaged from the post portion while being engaged with the radially inner surface of the coupler portion;

wherein the post portion includes a flange portion extending radially outward at a forward portion of the post portion;

wherein the coupler portion includes an internal lip portion extending radially inward at a portion of the coupler portion that is rearward of the forward portion of the post portion; and wherein the space is between the flange portion and the internal lip portion in an axial direction of the connector.

11. The connector of claim 10, wherein the electrical grounding portion is configured to simultaneously exert a first biasing force directed radially inward against the outer surface of the post portion and a second biasing force directed radially outward against the inner surface of the coupler portion.

12. The connector of claim 10, wherein the coupler portion is configured to move between a non-fully tightened position on an interface port and a fully tightened position on the interface port, the electrical grounding portion being configured to establish an electrical connection between the post portion and the coupler portion even when the coupler portion is in the non-fully tightened position.

13. The connector of claim 10, wherein the coupler portion is configured to move axially between a first axial position relative to the post portion and a second axial position relative to the post portion, the electrical grounding portion being configured to establish the electrical connection when the coupler portion is in the first axial position and when the coupler portion is in the second axial position, the second axial position corresponding to a fully tightened position on an interface port.

14. The connector of claim 10, wherein the electrical grounding portion is deformable in a radial direction.

15. A connector comprising:

a post portion;

a coupler portion configured to receive the post portion; and an electrical grounding portion configured to establish an electrical connection between the post portion and a radially-inward facing surface of the coupler portion;

wherein a continuous length of the electrical grounding portion is curved about a periphery of the post portion and includes a first portion configured to be engaged with the post portion while being disengaged from the radially-inward facing surface of coupler portion and a second portion configured to be disengaged from the post portion while being engaged with the radially-inward facing surface of the coupler portion;

wherein the post portion includes a flange portion extending radially outward at a forward portion of the post portion;

wherein the coupler portion includes an internal lip portion extending radially inward at a portion of the coupler portion that is rearward of the forward portion of the post portion; and wherein the space is between the flange portion and the internal lip portion in an axial direction of the connector.

16. The connector of claim 15, wherein the electrical grounding portion is configured to simultaneously exert a first biasing force directed radially inward against the outer surface of the post portion and a second biasing force directed radially outward against the inner surface of the coupler portion.

17. The connector of claim 15, wherein the coupler portion is configured to move between a non-fully tightened position on an interface port and a fully tightened position on the interface port, the electrical grounding portion being configured to establish an electrical connection between the post portion and the coupler portion even when the coupler portion is in the non-fully tightened position.

18. The connector of claim 15, wherein the coupler portion is configured to move axially between a first axial position relative to the post portion and a second axial position relative to the post portion, the electrical grounding portion being configured to establish the electrical connection when the coupler portion is in the first axial position and when the coupler portion is in the second axial position, the second axial position corresponding to a fully tightened position on an interface port.

19. The connector of claim 15, wherein the electrical grounding portion is deformable in a radial direction.

* * * * *